US011773701B1

(12) United States Patent
Juenke et al.

(10) Patent No.: US 11,773,701 B1
(45) **Date of Patent: *Oct. 3, 2023**

(54) GAS PUMP SYSTEM

(71) Applicant: KHOLLE Magnolia 2015, LLC, Tomball, TX (US)

(72) Inventors: Michael S. Juenke, Spring, TX (US); Stephen W. Turk, Conroe, TX (US); E. Lee Colley, III, Jersey Village, TX (US)

(73) Assignee: KHOLLE Magnolia 2015, LLC, Tomball, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/126,243

(22) Filed: Mar. 24, 2023

Related U.S. Application Data

(60) Division of application No. 17/028,869, filed on Sep. 22, 2020, which is a continuation-in-part of application No. 15/984,907, filed on May 21, 2018, now Pat. No. 10,858,921.

(60) Provisional application No. 62/647,478, filed on Mar. 23, 2018.

(51) Int. Cl.

| | |
|---|---|
| ***E21B 43/12*** | (2006.01) |
| ***E21B 34/10*** | (2006.01) |
| ***E21B 33/12*** | (2006.01) |
| *E21B 33/02* | (2006.01) |

(52) U.S. Cl.
CPC ..... *E21B 43/123* (2013.01); *E21B 34/10* (2013.01); *E21B 33/02* (2013.01); *E21B 2200/04* (2020.05)

(58) Field of Classification Search
CPC ..... E21B 43/123; E21B 34/10; E21B 33/12
See application file for complete search history.

(56) References Cited

U.S. PATENT DOCUMENTS

| | | | | |
|---|---|---|---|---|
| 906,733 A | | 12/1908 | McEvoy | |
| 2,519,242 A | | 8/1950 | Garrett | |
| 2,678,605 A | * | 5/1954 | Tappmeyer | E21B 43/122 166/54.1 |
| 3,224,459 A | | 12/1965 | Lilly | |

(Continued)

FOREIGN PATENT DOCUMENTS

AU 763592 B2 5/2002

OTHER PUBLICATIONS

American Completion Tools, *Standing Valves and Seating Nipples*.

(Continued)

*Primary Examiner* — Cathleen R Hutchins
(74) *Attorney, Agent, or Firm* — Keith B. Willhelm

(57) ABSTRACT

A gas pump system for producing a well has production tubing, a chamber to collect liquid from the well, a check valve to allow well liquids to flow into the chamber and to check flow out of the chamber, a dip tube in communication with the production tubing and the chamber, a check valve to allow liquid to flow up the dip tube into the production tubing and to check liquid flowing down the dip tube, a gas supply line to convey gas into the chamber, a hydraulic valve controlling flow through the gas supply line, a gas vent line to vent gas from the chamber, a hydraulic valve controlling flow through the gas vent line, a control line communicating with one or both of the gas supply valve and the gas vent valve, and a shut-off valve in the well controlling flow through the control line.

9 Claims, 37 Drawing Sheets

(56) References Cited

U.S. PATENT DOCUMENTS

| | | | | |
|---|---|---|---|---|
| 3,970,144 | A | 7/1976 | Boykin, Jr. | |
| 4,119,016 | A * | 10/1978 | Pfeil | F04B 49/025 137/413 |
| 4,781,990 | A | 12/1988 | Amani | |
| 4,791,990 | A * | 12/1988 | Amani | E21B 43/123 166/324 |
| 5,176,164 | A | 1/1993 | Boyle | |
| 5,806,598 | A | 9/1998 | Amani | |
| 6,021,849 | A | 2/2000 | Averhoff | |
| 6,070,608 | A | 6/2000 | Pringle | |
| 6,206,645 | B1 | 3/2001 | Pringle | |
| 6,691,787 | B2 | 2/2004 | Amani | |
| 6,715,550 | B2 | 4/2004 | Vinegar et al. | |
| 6,973,973 | B2 | 12/2005 | Howard et al. | |
| 9,518,674 | B2 | 12/2016 | Reed et al. | |
| 9,519,292 | B2 | 12/2016 | Thorne et al. | |
| 10,851,628 | B1 | 12/2020 | Anderson et al. | |
| 11,391,130 | B2 | 7/2022 | Anderson et al. | |
| 2015/0354315 | A1 * | 12/2015 | Windegaard | E21B 33/1293 166/183 |

OTHER PUBLICATIONS

Peak Well Systems, *Peak Standing Valve* (© Peak Well Systems Pty Ltd.).

Petrowiki, *Gas Lift*.

Petrowiki, *Intermittent Gas Lift Plunger Application*.

R. Von Flatern, *Gas Lift*, Oilfield Review (© 2015 Schlumberger).

Schlumberger, *A- and M-Series Equalizing Standing Valves* (© 2008 Schlumberger).

Schlumberger, *BK-B Barrier Series Injection-Pressure-Operated Gas Lift Valve* (© 2016 Schlumberger).

Schlumberger, *Camco Single-Point Injection Orifice Gas Lift Valves* (© 2012 Schlumberger).

Schlumberger, *Injection-Pressure-Operated Gas Lift Valves* (© 2015 Schlumberger).

Schlumberger, *Nova-1-B Barrier Series Single-Point-Injection Venturi Orifice Gas Lift Valve* (© 2016 Schlumberger).

Schlumberger, *O-21R-B Single-Point-Injection Orifice Gas Lift Valve* (© 2015 Schlumberger).

Schlumberger, *OM-21R-B Barrier Series Single-Point-Injection Venturi Orifice Gas Lift Valve* (© 2016 Schlumberger).

Schlumberger, *R-20-02-B Injection-Pressure-Operated Gas Lift Valve* (© Sclumberberger).

Schlumberger, *Retrievable Gas Lift Valves Versatile Designs for High-Performance Applications* (© 2017 Schlumberger).

Weatherford, *RH-2 Gas-Lift Valve* (© 2013-17 Weatherford).

Weatherford, *Ultra-HP™ Wireline-Retrievable Injection-Pressure-Operated Gas-Lift Valve* (© 2016 Weatherford).

Wireline Engineering, *Product Brochure*.

* cited by examiner

GAS PUMP SYSTEM

FIELD OF THE INVENTION

The present invention relates generally to systems for assisting production from oil and gas wells, and more particularly, to production systems incorporating gas pumps.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer. Thus, the porous layer forms a reservoir, that is, a volume in which hydrocarbons accumulate. A well is drilled through the earth until the hydrocarbon bearing formation is reached. Hydrocarbons then are able to flow from the porous formation into the well.

In the most basic form of rotary drilling methods, a drill bit is attached to a series of pipe sections or "joints" referred to as a drill string. The drill string is suspended from a derrick and rotated by a motor in the derrick. A drilling fluid or "mud" is pumped down the drill string, through the bit, and into the bore of the well. This fluid serves to lubricate the bit. The drilling mud also carries cuttings from the drilling process back to the surface as it travels up the wellbore. As the drilling progresses downward, the drill string is extended by adding more joints of pipe.

The well will be drilled to a certain depth. Large diameter pipes, or casings, are placed in the well and cemented in place to prevent the sides of the borehole from caving in. The casing is cemented in the well by injecting a cement slurry down the casing and out the bottom of the casing. The slurry then will flow up into the well annulus, that is, the gap between the casing and the bore of the well. The cement will harden into a continuous seal throughout the annulus.

After the initial section has been drilled, cased, and cemented, drilling may proceed with a somewhat smaller wellbore. The smaller bore is lined with large, but somewhat smaller pipes or "liners." The liner is suspended from the original or "host" casing by an anchor or "hanger." A well may include a series of smaller liners, and may extend for many thousands of feet, commonly up to and over 25,000 feet.

Hydrocarbons, however, are not always able to flow easily from a formation to a well. Some subsurface formations, such as sandstone, are very porous. Hydrocarbons can flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations and especially from formations that are relatively nonporous.

Perhaps the most important stimulation technique is the combination of horizontal wellbores and hydraulic fracturing. A well will be drilled vertically until it approaches a formation. It then will be diverted, and drilled in a more or less horizontal direction, so that the borehole extends along the formation instead of passing through it. More of the formation is exposed to the borehole, and the average distance hydrocarbons must flow to reach the well is decreased. Fractures then are created in the formation which will allow hydrocarbons to flow more easily from the formation.

Fracturing a formation is accomplished by pumping fluid, most commonly water, into the well at high pressure and flow rates. Proppants, such as grains of sand or ceramic or other particulates, usually are added to the fluid along with gelling agents to create a slurry. The slurry is forced into the formation at rates faster than can be accepted by the existing pores, fractures, faults, vugs, caverns, or other spaces within the formation. Pressure builds rapidly to the point where the formation fails and begins to fracture. Continued pumping of fluid into the formation will tend to cause the initial fractures to widen and extend further away from the wellbore, creating flow paths to the well. The proppant serves to prevent fractures from closing when pumping is stopped.

Once the drilling phase is over, the well will be completed by installing equipment that will enable the formation to be fractured and allow fluids to be produced from the well in a controlled fashion. Production of natural gas is relatively easy to manage. Natural gas is predominantly methane, which is lighter than air and rises naturally through the well. Other gaseous hydrocarbons, though somewhat heavier than air, are easily pushed up and out of the well. Liquid hydrocarbons, that is oil, is much heavier than natural gas. Ideally, however, the hydrostatic pressure of fluids within the pores of a formation, the "formation pressure," also will be sufficiently high to push oil flowing into the bottom of the well all the way to the surface.

In many wells, at least initially, that is the case. Oil will flow from the formation, into the production casing, and up into flow control equipment at the surface. Over time, however, as production continues, the formation pressure will drop. If the well has been fractured, the formation will start to relax, closing many of the fractures and making it harder for fluids to flow into the well. Production of natural gas will continue, but eventually the bottom hole pressure, that is, the hydrostatic pressure urging fluids upward through the casing is no longer sufficiently high to push oil all the way to the surface. At that point, a well operator will have to resort to one or more techniques to assist in lifting oil out of the well.

Such "artificial lift" systems include the iconic "rocking horse" or walking beam system. The rocking horse is connected by a series of rods to a reciprocating pump installed down in the well. As the beam-pumping unit rocks up and down, the pump reciprocates and pumps oil to the surface through production tubing connected to the pump outlet. Other systems use surface motors and connecting rods that are rotated to turn a downhole progressive cavity pump. Such surface-driven artificial lift systems have advantages. Surface motors often are cheaper and always are more accessible for service. Connecting rods, however, can fatigue and fail and can damage tubing. It also may be difficult or impractical to install connecting rods through very deep or long deviated wells. Mechanical pumps also tend to wear, especially when there are relatively high concentrations of solid particles in the production fluids.

Other artificial lift systems utilize an electric motor that is installed in the well and connected to a downhole pump. It may be a reciprocating or progressive cavity pump, but more commonly the downhole pump is an electric submersible pump ("ESP"). Electric power is supplied to the motor by a cable running from the surface. Electric motors, however, can overheat in the elevated temperatures common at the bottom of oil and gas wells. Gas and solids in production fluids can diminish the performance or damage pumps, especially electric submersible pumps. Maintaining downhole motors and pumps also is more difficult and time consuming.

"Gas lift" is another common form of artificial lift. Gas lift systems—in one fashion or another—use natural gas to assist in moving oil to the surface. As compared to other systems for artificial lift, they tend to be more flexible and trouble free. Gas lift systems do not incorporate downhole motors or mechanical pumps, and instead are controlled and operated by valves. Surface equipment, such as field compressors, also can be shared among several wells. Moreover, gas lift systems can accommodate a wide range of production rates. Different gas lift techniques may be employed over the life of a well as production is depleted.

Initially, once the formation pressure is no longer high enough to push oil all the way to the surface, operators can employ "continuous" gas lift. A smaller diameter pipe or "production tubing" is installed in the casing to convey oil to the surface. Natural gas, typically a portion of the natural gas produced by the well, is injected into the oil in the production tubing by a series of gas injection valves. As gas is introduced into the oil, it "lightens" the column of fluid in the tubing. That is, the oil will be infused with gas, reducing its density and reducing the hydrostatic pressure of fluid in the tubing to less than the formation pressure. Oil once again is able to flow to the surface.

After a period of time, the well will be depleted further, and the formation pressure will drop to a level at which it is no longer practical to lift oil by continuous gas injection. An operator then may switch to an "intermittent" gas lift system. Intermittent gas lift systems are similar to continuous lift systems. Instead of injecting gas continuously into the oil, however, large volumes of gas are injected periodically into the production tubing. The goal is to produce a large bubble of gas that will lift the oil above it to the surface.

Liquid, however, has a natural tendency to flow around or through a gas bubble, even when confined in a relatively small tube. That "fall back" of oil through the gas bubble can significantly impair the efficiency of intermittent gas lift, especially for thinner, less viscous oil. As much as 10% of the initial slug of oil may fall back through the gas for every 1,000 feet of lift. In the face of such inefficiencies, operators may turn to "plunger-assisted" lift or gas pump systems.

Plunger-assisted lift is similar to intermittent gas lift. Gas is injected periodically, but the gas flows under a plunger carried within the production tubing instead of into the tubing itself. Gas accumulates under the plunger and, buoyed by the gas, the plunger travels to the surface pushing oil ahead of it. The plunger fits closely within the production tubing and prevents oil from flowing down around it. Once at the surface, gas beneath the plunger is vented, and the plunger sinks back down the production tubing to repeat the cycle.

Gas pump systems typically incorporate a vessel or tank that provides a chamber. Thus, they also are referred to as chamber lift systems. The tank is installed in the bottom of the well where oil can still collect. The production tubing leads into a "dip tube" that extends into the tank. A check valve allows oil to flow into, but not out of the lower end of the tank. A check valve in the dip tube allows oil to flow up and out of the dip tube, but checks back-flow from the production tubing. The tank is allowed to fill with oil from the bottom of the well. Gas then is injected into the top of the tank, pushing oil up the dip tube, out of the tank, and into the production tubing. Gas then is vented from the tank to allow oil to fill the tank again.

Some or all of those gas lift techniques may be used over the life of a well. Cumulatively, they may greatly extend the period of time over which production from the well is economically feasible. They are, however, distinctly different systems with distinctly different installation and maintenance issues. Gas valves that are suitable for continuous lift, for example, may not be suitable for intermittent lift. Plunger lift systems necessarily add a plunger and various other ancillary components required to operate the plunger. Gas pump systems require installation of a tank and additional valves and lines. Thus, operators may experience significant down time and incur significant expense in changing from system to system over the life of the well. Installation of a gas pump system can be a particular burden. In conventional systems, the production tubing used for continuous and intermittent lift must be pulled from the casing before the tank can be installed.

It also will be appreciated that conventional gas pump systems typically are more complicated than continuous or intermittent lift systems and, to a certain degree, plunger lift systems. Unlike the latter systems, gas pump systems incorporate a gas supply line running from the surface to the tank. A control valve is provided in the supply line near the tank. Another valve is provided in a vent line running from the tank to the annulus. The valves may by hydraulically actuated and require hydraulic control lines. Those components and lines must share space within the annulus with the production tubing. The size of the production tubing may have to be reduced, thus diminishing its production capacity.

For example, gas pump systems are disclosed in U.S. Pat. No. 5,806,598 to M. Amani. The Amani '598 gas pump systems have a tank in fluid communication with the production tubing. Injection and venting of gas into and out of the tank is controlled by a hydraulically actuated valve. The valve controls separate gas supply and gas vent flow paths. The dual-valve in turn is controlled by a pair of hydraulic lines running from the surface. Among other deficiencies in the Amani '598 systems, the hydraulic control lines must compete with the production tubing for space within the casing. Moreover, if the control valve fails and requires replacement, the entire gas pump system must be pulled from the well.

U.S. Pat. No. 6,691,787 to M. Amani discloses similar gas pump systems. In the Amani '787 systems, however, the dual gas supply and gas vent control valve is replaceable. The dual control valve is attached to the end of coiled tubing, a relatively small tubular conduit that can be fed into a well from a large reel in extremely long sections. Gas from the surface is pumped through the coiled tubing. Two hydraulic lines also run through the coiled tubing. The hydraulic lines are used to control the dual control valve.

While necessary in certain wells, especially when tools must be deployed in long lateral extensions, running valves and other equipment into and out of a well with coiled tubing is time consuming. The coiled tubing also can interfere with other well operations as long as it remains in the casing. If possible, it usually is quicker and cheaper to deploy and retrieve tools by slickline. "Slickline" tools are deployed by connecting the tool to a cable and then allowing to tool to sink to the bottom of a vertical portion of the well. Slickline tools also may be pumped into horizontal portions of a well. Once the tool is installed, the wireline may be pulled out of the well. "Grabber" tools also can be deployed on a slickline to engage a tool and pull it up to the surface. The equipment required for a slickline operation also is much simpler and less costly to operate than coiled tubing units.

Perhaps most importantly, however, the gas pumps disclosed in Amani '598 and Amani '787 were developed primarily for use in steam assisted gravity drainage (SAGD). U.S. Pat. No. 6,973,973 to W. Howard et al. discloses another gas pump for use in SAGD systems. SAGD is a technique designed to enhance the production of heavy, viscous hydrocarbons such as those typically found in the "tar" deposits of Canada. Such wells are quite shallow. The gas pump is lifting a relatively light column of production fluid. The pressure of gas injected into the pump to displace fluids, that is, the gas lift pressure may be relatively low. At greater depths, those pumps may not be suitable. The fluid column is much heavier, and they must generate much higher gas lift pressure.

Gas pumps which are purportedly suitable for installation at greater depth are disclosed in U.S. Pat. No. 8,021,849 to J. Averhoff. The Averhoff '849 systems have gas-activated control valves that are used to control flow into and out of a dual-chamber pump. The valves are actuated by a downhole controller that operates off the gas supply and vent lines. The controller has a bellows in each of two chambers. The bellows are filled with hydraulic fluid and have a hydraulic passage extending between them. Each controller chamber is in fluid communication with one of the tank chambers.

As gas supply pressure builds in one tank chamber, and vent pressure declines in the other, pressure increases and diminishes in the corresponding controller chambers. Hydraulic fluid flows between the bellows, causing one to expand and the other to collapse. The bellows are connected to a rod which in turn is connected to the control valves. At a certain point, as the bellows expand and collapse, the rod will shift the valve to reverse flow. Supply gas that had been flowing into one tank chamber now is directed into the other.

The Averhoff '849 system avoids the need to run hydraulic control lines. There is little or no disclosure as to how its control valves work in a single-chamber pump, but the downhole controller in the dual-chamber pump is designed to open and shut the valves at a predetermined chamber pressure. Calibrating the controller, however, is difficult and not very precise. In turn, it is difficult to control the timing of pump cycles. Moreover, even if the controller is adequately calibrated at the beginning of operations and cycling of the pump is optimized, production from the well is not constant. It will tend to drop. The pump will tend to cycle more frequently than required. In order to adjust cycling to a more optimal frequency, the rate at which gas is pumped into the supply line has to be adjusted.

The statements in this section are intended to provide background information related to the invention disclosed and claimed herein. Such information may or may not constitute prior art. It will be appreciated from the foregoing, however, that there remains a need for new and improved gas lift systems and gas pumps to enhance production from oil and gas wells. Such disadvantages and others inherent in the prior art are addressed by various aspects and embodiments of the subject invention.

SUMMARY OF THE INVENTION

The subject invention relates generally to systems for assisting production from oil and gas wells, and more particularly, to production systems incorporating gas pumps. It encompasses various embodiments and aspects, some of which are specifically described and illustrated herein. One broad embodiment of the invention provides for a gas pump system for producing a well. The gas pump system comprises production tubing, a chamber, a dip tube, check valves, a gas supply line and control valve, a gas vent line and control valve, and a fluid control line. The production tubing is adapted to convey fluid from the well to the surface. The chamber is adapted to collect liquid from the well. A check valve is adapted to allow liquid to flow into the chamber from the well and to check liquid flow out of the chamber. The dip tube communicates with the production tubing and the chamber. A check valve is adapted to allow liquid to flow up the dip tube into the production tubing and to check liquid from flowing down the dip tube. The gas supply line is adapted to convey gas into the chamber. The gas supply valve controls flow through the gas supply line and is actuatable by fluid pressure. The gas vent line is adapted to vent gas from the chamber. The vent valve controls flow through the gas vent line and is actuatable by fluid pressure. The fluid control line is in communication with both the supply valve and the vent valve.

In other such embodiments the gas supply valve and the gas vent valve each comprise a gas flowpath, a valve seat in the gas flowpath, a valve body adapted to selectively seat on the valve seat to open and shut the flowpath, an actuating pressure chamber, a sealed pressure chamber, a bellows responsive to pressure in the actuating chamber and the sealed chamber; and a valve stem coupled to the bellows and the valve body. The valve body may be selectively seated on the valve seat by increasing and decreasing pressure in the actuating chamber relative to the sealed chamber.

Additional embodiments provide gas pumps systems where the pressure within said sealed chambers of said gas supply valve and said gas vent valve are coordinated such that pressure communicated to said actuation chambers by said control line will selectively shut said gas supply valve before said gas vent valve is opened and shut said gas vent valve before said gas supply valve is opened.

Other such embodiments provide gas pump systems where the supply valve and the vent valve are actuatable by hydraulic pressure and the control line is a hydraulic control line or a gas-over-hydraulic control line. In other embodiments the supply valve and the vent valve are actuatable by pneumatic pressure and the control line is a pneumatic control line.

Yet other embodiments provide gas pump systems where at least one of the chamber check valve, the dip tube check valve, the gas supply valve, and the gas vent valve are replaceable through the production tubing. Further embodiments provide such systems where all of the chamber check valve, the dip tube check valve, the gas supply valve, and the gas vent valve are replaceable through the production tubing.

In still other embodiments, at least one of the chamber check valve, the dip tube check valve, the gas supply valve, and the gas vent valve are mounted in a pocket in the production tubing. In further embodiments, all of the chamber check valve, the dip tube check valve, the gas supply valve, and the gas vent valve are mounted in a pocket in the production tubing.

Additional embodiments provide gas pump systems where the fluid control line runs through the annulus. Other embodiments provide such systems where the system comprises a packer sealing the annulus above the chamber, where the chamber is a tank, or where the chamber is defined by first and second packers sealing an annulus surrounding the production tubing.

In other aspects and embodiments, the subject invention provides for other gas pump systems for producing a well. The gas pump systems comprise production tubing, a chamber, a dip tube check valve, a dip tube, a chamber check valve, a gas supply line and control valve, and a gas vent line and control valve. The production tubing is adapted to convey fluid from the well to the surface. The chamber is adapted to collect liquid from the well. The check valve is adapted to allow liquid to flow into the chamber from the well and to check liquid flow out of the chamber. The dip tube communicates with the production tubing and the chamber. The dip tube check valve is adapted to allow liquid to flow up the dip tube into the production tubing and to check liquid from flowing down the dip tube. The gas supply line is adapted to convey gas into the chamber. The gas supply valve controls flow through the gas supply line and comprises a gas flowpath, a valve seat in the gas flowpath, a valve body adapted to selectively seat on the valve seat to open and shut the flowpath, an actuating pressure chamber, a sealed pressure chamber, a bellows responsive to pressure in said actuating chamber and said sealed chamber, and a valve stem coupled to said bellows and said valve body. The valve body may be selectively seated on said valve seat by increasing and decreasing pressure in said actuation chamber relative to said sealed chamber. The gas vent line is adapted to vent gas from the chamber. The gas vent valve controls flow through the gas vent line and comprises a gas flowpath, a valve seat in the gas flowpath, a valve body adapted to selectively seat on the valve seat to open and shut the flowpath, an actuating pressure chamber, a sealed pressure chamber, a bellows responsive to pressure in said actuating chamber and said sealed chamber, a valve stem coupled to said bellows and said valve body. The body may be selectively seated on said valve seat by increasing and decreasing pressure in said actuation chamber relative to said sealed chamber.

In other embodiments the gas pump system is installed in a well at a depth of a least about 4,500 feet or at least about 8,000 feet. In still other embodiments the gas pump system provides a lift force of at least 2,000 psi or at least 5,000 psi.

Additional embodiments provide such gas lift systems where the supply valve and the vent valve are actuatable by hydraulic pressure or where they are actuatable by pneumatic pressure.

Other embodiments provide such gas pump systems where the pressure chamber in the gas supply valve and the pressure chamber in the gas vent valve are in communication with a common fluid control line and one of the gas supply valve or gas vent valve is adapted to open and the other of the gas supply valve or the gas vent valve is adapted to shut in response to increasing pressure in their respective the pressure chambers.

Yet other embodiments provide gas pump systems where the supply valve and the vent valve are actuatable by hydraulic pressure and the control line is a hydraulic control line or a gas-over-hydraulic control line or where the supply valve and the vent valve are actuatable by pneumatic pressure and the control line is a pneumatic control line.

Additional embodiments provide gas pumps systems where the pressure within said sealed chambers of said gas supply valve and said gas vent valve are coordinated such that pressure communicated to said actuation chambers by said control line will selectively shut said gas supply valve before said gas vent valve is opened and shut said gas vent valve before said gas supply valve is opened.

Yet other embodiments provide gas pump systems where at least one of the chamber check valve, the dip tube check valve, the gas supply valve, and the gas vent valve are replaceable through the production tubing. Further embodiments provide such systems where all of the chamber check valve, the dip tube check valve, the gas supply valve, and the gas vent valve are replaceable through the production tubing.

In still other embodiments, at least one of the chamber check valve, the dip tube check valve, the gas supply valve, and the gas vent valve are mounted in a pocket in the production tubing. In further embodiments, all of the chamber check valve, the dip tube check valve, the gas supply valve, and the gas vent valve are mounted in a pocket in the production tubing.

Additional embodiments provide gas pump systems where the fluid control line runs through the annulus. Other embodiments provide such systems where the system comprises a packer sealing the annulus above the chamber, where the chamber is a tank, or where the chamber is defined by first and second packers sealing an annulus surrounding the production tubing.

In other aspects and embodiments, the subject invention provides for other gas pump systems for producing a well. The gas pump systems comprise production tubing, a tank, a packer, a tank check valve, a dip tube, a dip tube check valve, a gas supply line and control valve, and a gas vent line and control valve. The production tubing is adapted to convey fluid from the well to the surface. The tank is adapted to collect liquid from the well. The packer seals the annulus above the tank. The tank check valve is adapted to allow liquid to flow into the tank from the well and to check liquid flow out of the tank. The dip tube is in communication with the production tubing and the tank. The dip tube check valve is adapted to allow liquid to flow up the dip tube into the production tubing and to check liquid from flowing down the dip tube. The gas supply line is adapted to convey gas into the tank. The gas supply valve controls flow through the gas supply line. The gas vent line is adapted to vent gas from the tank. The gas vent valve controls flow through the gas vent line.

Other embodiments provide such gas pump systems where the system comprises a sump line extending through the packer and a circulating valve adapted to allow liquid to flow down the sump line. In still other embodiments the circulating valve is mounted in a pocket in the production tubing or a sump passage in the packer.

In other aspects and embodiments, the invention provides gas pump systems for producing a well. The gas pump systems comprise production tubing, a dip tube, a chamber, a chamber check valve, a dip tube check valve, a gas supply line and control valve, a gas vent line and control valve, a sump line, and a sump check valve. The production tubing is adapted to convey fluid from the well to the surface. The dip tube is connected to the production tubing and in communication with the chamber. The chamber is adapted to collect liquid from the well and is defined by an upper packer and a lower packer sealing an annulus surrounding the dip tube. The chamber check valve is adapted to allow liquid to flow into the chamber from the well and to check liquid flow out of the chamber. The dip tube check valve is adapted to allow liquid to flow up the dip tube into the production tubing and to check liquid from flowing down the dip tube. The gas supply line adapted to convey gas into the chamber. The gas supply valve controls flow through the gas supply line. The gas vent line is adapted to vent gas from the chamber. The gas vent valve controls flow through the gas vent line. The sump line is adapted to convey liquid above the upper packer into the chamber. The sump check valve is adapted to allow liquid to flow through the sump line into the chamber and to check fluid flow out of the chamber. In other embodiments the sump check valve is mounted in a pocket in the production tubing or a sump passage in the upper packer.

In other aspects and embodiments, the invention provides for systems for producing a well. The systems comprise production tubing, a chamber, a dip tube, a gas supply line, a gas vent line, and one or more control lines. The production tubing is adapted to convey fluid from the well to the surface. The chamber is adapted to collect liquid from the well. It has a receptacle adapted to receive a replaceable check valve adapted to allow fluid to flow into the chamber and to check liquid flow out of the chamber. The dip tube is in communication with the production tubing and adaptable for communication with the chamber. It has an internal receptacle adapted to receive a replaceable check valve which is adapted to allow liquid to flow up the dip tube and to check liquid from flowing down the dip tube. The gas supply line is adapted to convey gas into the chamber and runs outside of the production tubing. The gas vent line is adapted to vent gas from the chamber and runs outside the production tubing. The one or more control lines run outside of the production tubing and communicate with the gas supply valve receptacle and the gas vent valve receptacle. The production tubing has internal receptacles adapted to receive a replaceable gas injection valve, a replaceable gas supply valve, and a replaceable gas vent valve. The receptacles are provided in internal pockets in the production tubing. The replaceable gas injection valve is adapted to inject gas from an annulus surrounding the production tubing into the production tubing. The replaceable gas supply valve is adapted to control flow through the gas supply line. The replaceable gas vent valve is adapted to control flow through the gas vent line In other embodiments a dummy valve is placed in one or both of the gas supply valve receptacle and the gas vent valve receptacle.

Still other embodiments provide such systems where the system comprises a packer sealing the annulus above the chamber, where the chamber is a tank, or where the chamber is defined by first and second packers sealing an annulus surrounding the production tubing.

Yet other embodiments provide such systems comprising one or more additional valves, such as a check valve installed in the chamber check valve receptacle and adapted to allow liquid to flow into the chamber from the well and to check liquid flow out of the chamber, a check valve installed in the dip tube check valve receptacle adapted to allow liquid to flow up the dip tube into the production tubing and to check liquid from flowing down the dip tube, a gas supply valve installed in the gas supply valve receptacle and controlling flow through the gas supply line, and a gas vent valve installed in the gas vent valve receptacle and controlling flow through the gas vent line.

Other embodiments provide such systems where the dip tube is perforable or has a sliding sleeve.

Still other embodiments provide such systems where the production tubing comprises an internal receptacle adapted to receive a sump check valve and where a sump check valve is installed in said sump check valve receptacle and adapted to allow liquid to flow into said chamber from said annulus and to check fluid flow out of said chamber.

Additional embodiments provide such systems where said production tubing comprises an internal receptacle adapted to receive a control line shut-off valve and where a control line shut-off valve is installed in said control line shut-off valve receptacle.

In other aspects and embodiments, the invention provides for systems for producing a well. The systems comprise production tubing, a gas injection valve, a chamber, a dip tube, a gas supply line, a vent line, and one or more control lines. The production tubing is adapted to convey fluid from the well to the surface. It has an internal receptacle adapted to receive a replaceable gas supply valve, the supply valve receptacle being provided in an internal pocket in the production tubing. It also has an internal receptacle adapted to receive a replaceable gas vent valve, the vent valve receptacle being provided in an internal pocket in the production tubing. The gas injection valve is installed on the production tubing and adapted to inject gas from an annulus surrounding the production tubing into the production tubing. The chamber is adapted to collect liquid from the well and has a receptacle adapted to receive a replaceable check valve adapted to allow fluid to flow into the chamber and to check liquid flow out of the chamber. The dip tube is in communication with the production tubing and adaptable for communication with the chamber. It has an internal receptacle adapted to receive a replaceable check valve, the check valve being adapted to allow liquid to flow up the dip tube and to check liquid from flowing down the dip tube. The gas supply line is adapted to convey gas into the chamber and runs outside of the production tubing. The gas vent line is adapted to vent gas from the chamber and runs outside the production tubing. The one or more control lines run outside of the production tubing and communicate with the gas supply valve receptacle and the gas vent valve receptacle.

Other embodiments provide such production systems where the gas injection valve is a replaceable valve. In other embodiments the production tubing comprises an internal receptacle adapted to receive the gas injection valve or where the gas injection valve receptacle is provided in an internal pocket in the production tubing.

In other aspects and embodiments, the invention provides for gas pump systems for producing a well. The gas pump systems comprise production tubing, a chamber, a chamber check valve, a dip tube, a dip tube check valve, a gas supply line and control valve, and a gas vent line and control valve. The production tubing is adapted to convey fluid from the well to the surface. The chamber is adapted to collect liquid from the well. The chamber check valve is adapted to allow liquid to flow into the chamber from the well and to check liquid flow out of the chamber. The dip tube communicates with the production tubing and the chamber. The dip tube check valve is adapted to allow liquid to flow up the dip tube into the production tubing and to check liquid from flowing down the dip tube. The gas supply line is adapted to convey gas into the chamber. The gas supply valve controls flow through the gas supply line. The gas vent line is adapted to vent gas from the chamber. The gas vent valve controls flow through the gas vent line. The chamber is installed in a well at a depth of a least about 4,500 feet or at a depth of at least about 8,000 feet.

Other embodiments provide such gas pump systems where the gas pump system provides a lift force of at least 2,000 psi or a lift force of at least 5,000 psi. In yet other embodiments at least one of the gas supply valve and the gas vent valve are actuatable by fluid pressure.

In other aspects and embodiments, the invention provides for methods of producing liquids from a well using a gas pump system. The gas pump system comprises a gas pump, a primary gas compressor, and a booster gas compressor, and an accumulation volume between the booster gas compressor and the gas pump. The method comprises operating said primary gas compressor to provide compressed gas at first pressures. A portion of the compressed gas from the primary compressor is fed into the booster compressor. The booster compressor is operated substantially continuously to provide compressed gas at second, higher pressures. The compressed gas from said booster compressor is discharged into the accumulation volume without substantial recycling of gas through said booster compressor. The compressed gas from said accumulation volume is periodically fed into said gas pump.

Other embodiments provide such methods where the booster compressor discharges an amount of gas into the accumulation volume during a fill cycle and a succeeding discharge cycle of said pump approximately equal to the amount of gas fed into said pump from said accumulation volume during an immediately preceding discharge cycle.

Yet other embodiments provide such methods where the capacity of said booster compressor is matched to a predetermined estimated amount of work required to bring said accumulation volume to a lift pressure over a predetermined estimated time required to fill said gas pump with liquid from said well.

In still other aspects and embodiments, the invention provides for gas pumps systems for producing a well. The gas pump systems comprise production tubing adapted to convey fluid from said well to the surface, a chamber adapted to collect liquid from said well, a check valve adapted to allow liquid to flow into said chamber from said well and to check liquid flow out of said chamber, a dip tube in communication with said production tubing and said chamber, a check valve adapted to allow liquid to flow up said dip tube into said production tubing and to check liquid from flowing down said dip tube, a gas supply line adapted to convey gas into said chamber, a hydraulic valve controlling flow through said gas supply line, a gas vent line adapted to vent gas from said chamber, a hydraulic valve controlling flow through said gas vent line, a control line communicating with one or both of said gas supply valve and said gas vent valve, and a shut-off valve controlling flow through said control line at a location in said well.

Other embodiments provide such gas pump systems where the shut-off valve is located above and proximate to one or both of said valves.

Still other embodiments provide such gas pump systems where the control line is a gas-over-hydraulic control line.

Yet other embodiments provide such gas pump systems where the shut-off valve is a linearly actuated spool-type valve.

In yet other aspects and embodiments, the invention provides methods of producing liquids from a well using a gas pump system. The methods comprise monitoring production of gas in a production tube. The length of a fill cycle time of the gas pump system is adjusted in response to the amount of gas production in the production tube. The length of the fill cycle may be increased in response to an increase is the gas production or may be decreased until the gas production stabilizes.

Other embodiments of the novel production methods comprise monitoring production of gas from a well annulus and adjusting the length of a discharge cycle time of the gas pump system in response to the amount of gas production in the annulus. The length of the discharge cycle may be increased in response to a decrease in the gas production or it may be lengthened until the gas production stabilizes.

Still other embodiments of methods for producing liquids using gas pump systems comprise monitoring the gas-oil-water ratio of production fluids to determine the density of the production fluids and adjusting the length of a discharge cycle time of the gas pump system in response to a change in the density. The length of the discharge cycle may be increased in response to an increase in the density of the production fluids or it may be decreased in response to a decrease in the density of the production fluids.

In still other aspects and embodiment, the invention provides for gas pump systems for producing a well. The gas pump system comprises production tubing adapted to convey fluid from the well to the surface, a chamber adapted to collect liquid from the well, and a dip tube in communication with the production tubing and the chamber. There is a check valve adapted to allow liquid to flow into the chamber from the well and to check liquid flow out of the chamber, and a check valve adapted to allow liquid to flow up the dip tube into the production tubing and to check liquid from flowing down the dip tube. The system also comprises a gas supply line adapted to convey gas into the chamber, a valve controlling flow through the gas supply line, a gas vent line adapted to vent gas from the chamber, and a valve controlling flow through the gas vent line. One or both of the gas supply valve or the gas vent valve is a control valve. The control valve comprises a gas flowpath, a valve seat in the gas flowpath, a valve body adapted to selectively seat on the valve seat to open and shut the flowpath, an actuating pressure chamber, a stack of Belleville washers, and a piston. The washer stack is compressed to provide a biasing force on the piston. The piston is coupled to the valve body and is responsive to fluid pressure in the actuating chamber and the biasing force of the washer stack. Thus, the valve body may be selectively seated on the valve seat by sequentially increasing and decreasing fluid pressure in the actuation chamber relative to the biasing force of the washer stack. The system also comprises a fluid control line. The control line communicates with the control valve and is adapted to provide control fluid to its actuating chamber and is fluidly isolated from the gas supply line and the gas vent line. The control line communicates with one or both of the gas supply valve and the gas vent valve.

Other embodiments provide such gas pump systems where a first the control valve is the gas supply valve and a second the control valve is the gas vent valve.

Still other embodiments provide such gas pump systems where the system comprises a single control line communicating with and controlling the gas supply valve and the gas vent valve.

Additional embodiments provide such gas pump systems where the actuating chamber in the gas supply valve and the actuating chamber in the gas vent valve are in communication with a common control line and where one of the gas supply valve or gas vent valve is adapted to open and the other of the gas supply valve or the gas vent valve is adapted to shut in response to increasing pressure in their respective the actuating chambers.

Yet other embodiments provide such gas pump systems where the biasing force of the washer stacks in the gas supply valve and the gas vent valve are coordinated such that pressure communicated to the actuation chambers by the control line will selectively shut the gas supply valve before the gas vent valve is opened and shut the gas vent valve before the gas supply valve is opened.

Further embodiments provide such gas pump systems where the gas supply valve is normally closed and the gas vent valve is normally open or where the gas supply valve is normally open and the gas vent valve is normally closed.

Other embodiments provide such gas pump systems where the valve housing of both the gas supply valve and the gas vent valve has a generally elongated, cylindrical shape and the piston and the valve body of both the gas supply valve and the gas vent valve are aligned and reciprocate along the primary axis of the valve housing.

Still other embodiments provide such gas pump systems where the valve body is coupled to the piston by a valve stem or where the valve stem extends between the piston and the valve body along the path of the piston reciprocating movement.

Additional embodiments provide such gas pump systems where the supply valve and the vent valve are actuatable by hydraulic pressure or where the supply valve and the vent valve are actuatable by hydraulic pressure and the control line is a hydraulic control line or a gas-over-hydraulic control line.

Yet other embodiments provide such gas pump systems where all of the chamber check valve, the dip tube check valve, the gas supply valve, and the gas vent valve are replaceable through the production tubing or where the chamber check valve is mounted in a nipple in the dip tube, the dip tube check valve is mounted in a nipple in the production tubing, and the gas supply valve and the gas vent valve are mounted in a pocket in the production tubing.

Further embodiments provide methods of producing liquids from a well, the method comprising operating a novel gas pump system in the well.

In still other aspects and embodiments the subject invention provides for systems for producing a well. The system comprising production tubing adapted to convey fluid from the well to the surface. The production tubing has internal receptacles, including an internal receptacle adapted to receive a replaceable gas injection valve, the injection valve receptacle being provided in an internal pocket in the production tubing and communicating with an annulus surrounding the production tubing; an internal receptacle adapted to receive a replaceable gas supply valve, the supply valve receptacle being provided in an internal pocket in the production tubing; and an internal receptacle adapted to receive a replaceable gas vent valve, the vent valve receptacle being provided in an internal pocket in the production tubing. The system also has a chamber and a dip tube. The chamber is adapted to collect liquid from the well. The chamber has a receptacle adapted to receive a replaceable check valve that allows fluid to flow into the chamber and checks liquid flow out of the chamber. The dip tube is in communication with the production tubing and adaptable for communication with the chamber. The dip tube has an internal receptacle adapted to receive a replaceable check valve that allows liquid to flow up the dip tube and checks liquid from flowing down the dip tube. The system also has a gas supply line, a gas vent line, and a single fluid control line. The gas supply line is adapted to convey gas into the chamber. It runs outside of the production tubing and communicates with the gas supply valve receptacle. The gas vent line adapted to vent gas from the chamber. It runs outside the production tubing and communicates with the gas vent receptacle. The control line runs outside of the production tubing and communicates with the gas injection valve receptacle, the gas supply valve receptacle, and the gas vent valve receptacle.

In other embodiments, one or more of the receptacles is adapted to receive a valve having a camming surface. The receptacle comprises a port through a wall of the receptacle and a poppet valve. The port is adapted to conduct fluid from the fluid control line into the receptacle. The poppet valve is mounted in the port and comprises a valve seat in the port, a valve body adapted to selectively seat on the valve seat to open and shut the port, a resilient element applying force to the valve body to bias the valve body on the valve seat and normally shut the port, and a valve stem coupled to the valve body. The valve stem has a camming surface extending from the port into the interior of the receptacle and adapted to engage the camming surface on the gas injection valve. The engagement causes the valve stem to move against the resilient element and away from the valve seat to open the port.

In yet other aspects and embodiments, the subject invention provides for systems for producing a well. The system comprises production tubing, a gas injection valve, a chamber, a dip tube, a gas supply line, a gas vent line, and a single fluid control line. The production tubing is adapted to convey fluid from the well to the surface. It has an internal receptacles provided in internal pockets in the production tubing, including a receptacle that is adapted to receive a replaceable gas supply valve and a receptacle adapted to receive a replaceable gas vent valve. The gas injection valve is installed on the production tubing and adapted to inject gas from an annulus surrounding the production tubing into the production tubing. It is actuatable by fluid pressure. The chamber is adapted to collect liquid from the well. It has a receptacle adapted to receive a replaceable check valve that allows fluid to flow into the chamber and checks liquid flowing out of the chamber. The dip tube communicates with the production tubing and the chamber. It has an internal receptacle adapted to receive a replaceable check valve that allows liquid to flow up the dip tube and checks liquid flowing down the dip tube. The gas supply line is adapted to convey gas into the chamber. It runs outside of the production tubing and communicates with the gas supply valve receptacle. The gas vent line is adapted to vent gas from the chamber. It runs outside the production tubing and communicates with the gas vent valve receptacle. The control line runs outside of the production tubing. It communicates with the gas injection valve, the gas supply valve receptacle, and the gas vent valve receptacle and is adapted to conduct the fluid pressure to selectively open and close the gas injection valve.

In other embodiments, one or more of the receptacles are adapted to receive a valve having a camming surface. The receptacle comprises a port through a wall of the receptacle and a poppet valve. The port is adapted to conduct fluid from the fluid control line into the receptacle. The poppet valve is mounted in the port and comprises a valve seat in the port, a valve body adapted to selectively seat on the valve seat to open and shut the port, a resilient element applying force to the valve body to bias the valve body on the valve seat and normally shut the port, and a valve stem coupled to the valve body. The valve stem has a camming surface extending from the port into the interior of the receptacle and adapted to engage the camming surface on the gas injection valve. The engagement causes the valve stem to move against the resilient element and away from the valve seat to open the port.

In still other embodiments and aspects, the subject invention provides for a gas pump system for producing liquids from a well. The gas pump system comprises production tubing. The production tubing is adapted to convey fluid from the well to the surface. It has an internal receptacle adapted to receive a replaceable gas injection valve. The injection valve receptacle is provided in an internal pocket in the production tubing and communicating with an annulus surround the production tubing. The system also comprises a chamber, a chamber check valve, a dip tube, and a dip tube check valve. The chamber is adapted to collect liquid from the well for displacement into the production tubing. The chamber check valve allows liquid to flow into the chamber from the well and checks liquid flowing out of the chamber. The dip tube is in communication with the production tubing and the chamber. The dip tube check valve allows liquid to flow up the dip tube into the production tubing and checks liquid flowing down the dip tube. The system also comprises a gas supply line adapted to convey gas into the chamber, a valve controlling flow through the gas supply line, a gas vent adapted to vent gas from the chamber, and a valve controlling flow though the gas vent line. The supply valve and vent valve are actuatable by fluid pressure. There is a single fluid control line in communication with the gas injection valve receptacle and both the supply valve and the vent valve. The single control line is isolated from the gas supply line and the gas vent line and adapted to conduct the fluid pressure to selectively open and close both the supply valve and the vent valve.

In other embodiments, the receptacle is adapted to receive a valve having a camming surface. The receptacle comprises a port through a wall of the receptacle and a poppet valve. The port is adapted to conduct fluid from the fluid control line into the receptacle. The poppet valve is mounted in the port and comprises a valve seat in the port, a valve body adapted to selectively seat on the valve seat to open and shut the port, a resilient element applying force to the valve body to bias the valve body on the valve seat and normally shut the port, and a valve stem coupled to the valve body. The valve stem has a camming surface extending from the port into the interior of the receptacle and adapted to engage the camming surface on the gas injection valve. The engagement causes the valve stem to move against the resilient element and away from the valve seat to open the port.

Finally, still other aspects and embodiments of the invention will have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the way it may be practiced. The subject invention encompasses other embodiments consistent with the claims set forth herein.

BRIEF DESCRIPTION OF THE DRAWINGS

FIG. 2A (prior art) is a schematic illustration of well 1 having a casing assembly 20 after completion of a plug and perf operation.

FIG. 2B (prior art) is a schematic illustration of well 1 being produced through casing 20.

FIG. 2C is a schematic illustration of well 1 after a first embodiment 30 of the novel gas pump production systems has been installed in casing 20, production system 30 incorporating a first preferred embodiment 40 of the novel gas pumps.

FIG. 2D is a schematic illustration showing production system 30 being used to produce oil from well 1 by continuous gas lift.

FIG. 2E is a schematic illustration showing production system 30 being used to produce oil from well 1 by intermittent gas lift.

FIG. 2F is a schematic illustration showing production system 30 being used to produce oil from well 1 by gas pump 40.

FIG. 3A is a schematic illustration of gas pump 40 showing gas pump 40 during its fill cycle.

FIG. 3B is a schematic illustration of gas pump 40 showing gas pump 40 during its discharge cycle.

Figure 1:
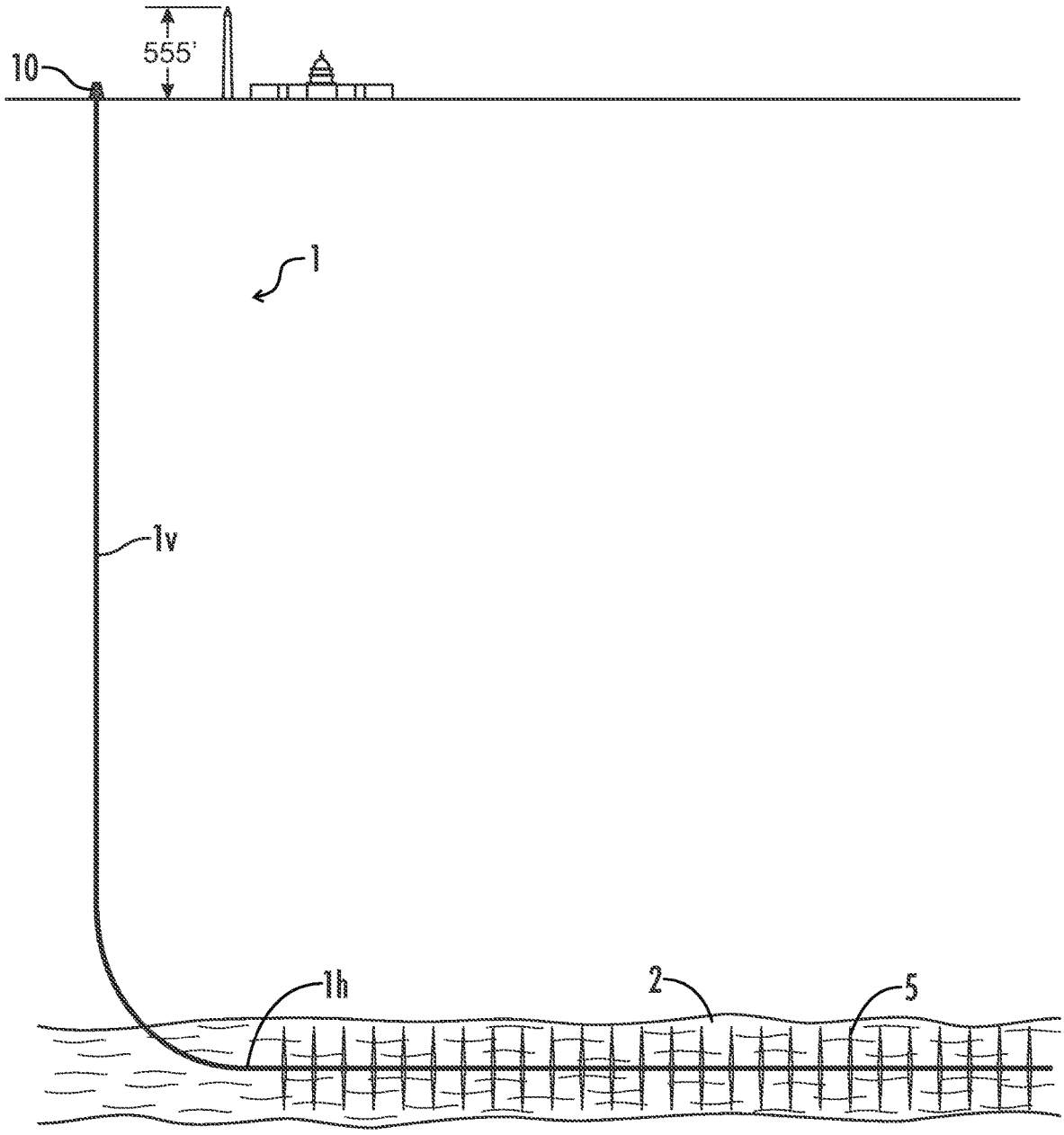
FIG. 1 (prior art) is a schematic depiction in approximate scale of an oil and gas well 1 having a horizontal extension 1*h*.

In the drawings and description that follows, like parts are identified by the same reference numerals. The drawing figures are not necessarily to scale. Certain features of the embodiments may be shown exaggerated in scale or in somewhat schematic form and some details of conventional design and construction may not be shown in the interest of clarity and conciseness.

DESCRIPTION OF ILLUSTRATIVE EMBODIMENTS

The subject invention relates generally to gas lift systems for enhancing the flow of oil and other liquids from wells. Some of those embodiments are described in detail herein. For the sake of conciseness, however, all features of an actual implementation may not be described or illustrated. In developing any actual implementation, as in any engineering or design project, numerous implementation-specific decisions must be made to achieve a developers' specific goals. Decisions usually will be made consistent within system-related and business-related constraints, and specific goals may vary from one implementation to another. Development efforts might be complex and time consuming and may involve many aspects of design, fabrication, and manufacture. Nevertheless, it should be appreciated that such development projects would be a routine effort for those of ordinary skill having the benefit of this disclosure.

The terms "upper" and "lower" and "uphole" and "downhole" as used herein to describe location or orientation are relative to the well. Thus, "upper" and "uphole" refers to a location or orientation toward the upper or surface end of the well. "Lower" or "downhole" is relative to the lower end or bottom of the well. It also will be appreciated that the course of the wellbore may not necessarily be as depicted schematically in FIG. 1. Depending on the location and orientation of the hydrocarbon bearing formation to be accessed, the course of the wellbore may be more or less deviated in any number of directions.

"Axial," "radial," "angularly," and forms thereof reference the central axis of the well and tools. For example, axial movement or position refers to movement or position generally along or parallel to the central axis. "Lateral" movement and the like also generally refer to up and down movement or positions up and down. "Radial" will refer to positions or movement toward or away from the central axis.

Overview of Well Completion Operations

The complexity and challenges of completing and producing a well perhaps may be appreciated by reference to FIG. 1. FIG. 1 shows a well 1 approximately to scale. Well 1 includes a vertical portion 1*v* and a horizontal portion 1*h*. Schematic representations of the Washington Monument, which is 555 feet tall, and the Capital Building are shown next to a derrick 10 to provide perspective. Well 1 has a vertical depth of approximately 6,000 feet and a horizontal reach of approximately 6,000 feet. Such wells are typical of wells in the Permian Basin. Deeper and longer wells, however, are constructed both in the Permian and elsewhere. While neither the vertical portion 1*v* or the horizontal portion 1*h* of well 1 necessarily run true to vertical or horizontal, FIG. 1 provides a general sense of what is involved in oil and gas production. Well 1 is targeting a relatively narrow hydrocarbon-bearing formation 2, and all downhole equipment must be installed and operated far away from the surface.

Figure 2A:
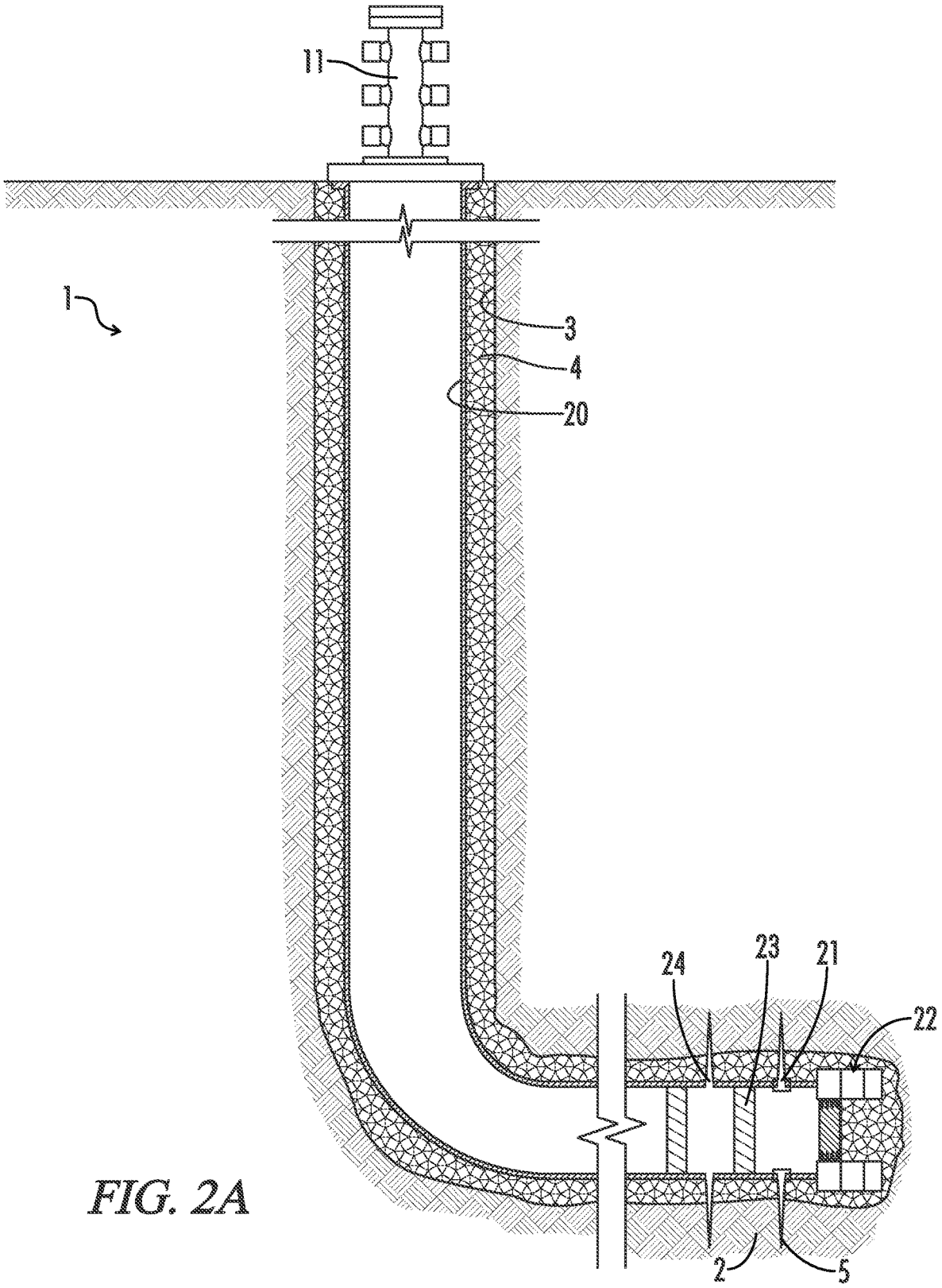
FIGS. 2A to 2F ("FIGS. 2") are sequential schematic representations showing a well 1 being readied for production or "completed" and various stages of production.

FIG. 2A shows well 1 in greater detail. A well bore 3 has been drilled through formation 2 and a production casing 20 has been sealed within well bore 3 with a sheath of cement 4. Casing 20 includes various tools, including a toe valve 21 and a float assembly 22. Float assembly 22 includes various tools that are commonly used to assist in running casing 20 into well 1 and cementing it in bore 3.

Well 1 is shown in FIG. 2A immediately after completion of a "plug and perf" job. Toe valve 21 was opened and fluid pumped into formation 2 at high pressure and flow rates to create fractures 5 in a first zone near the "toe" of well 1. A first plug 23 was installed above toe valve 21, and first perforations 24 were creating in casing 20 above plug 23. Fluid then was pumped into casing 20 to fracture formation 2 in a second zone adjacent perforations 24. Another plug 23 then was installed above the first plug 23, perforations 24 were formed above the second plug 23, and formation 2 was fractured in a third zone. That process was repeated until fractures were created along the length of horizontal extension 1*h* as shown in FIG. 1.

Figure 2B:
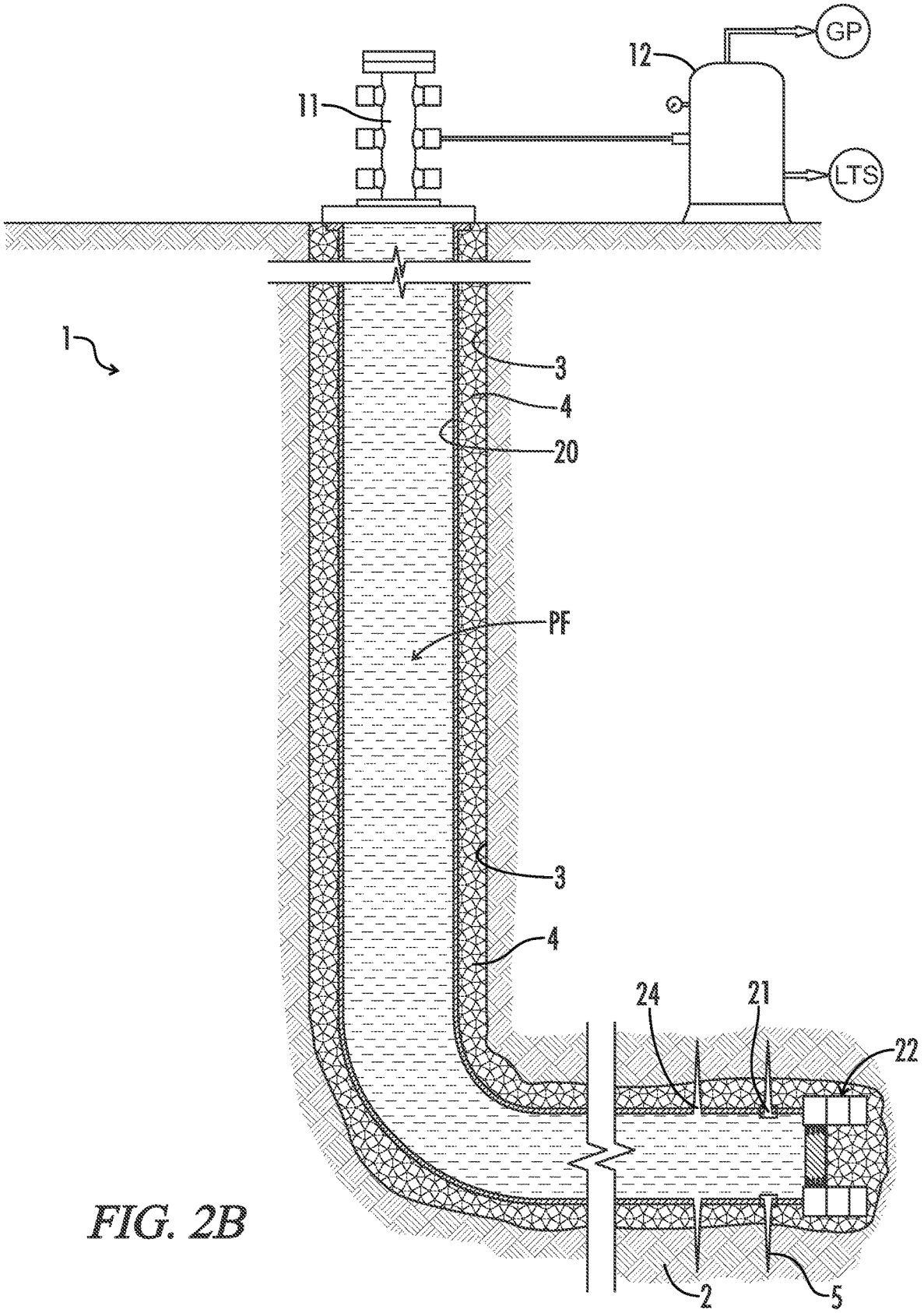

FIG. 2B shows well 1 during the initial stages of production. Frac plugs 23 have been removed from casing 20, typically by drilling them out. Production fluids PF, which in this example are predominantly oil, are flowing up casing 20 in response to hydrostatic pressure in formation 2. Flow of production fluids PF out of casing 20 is controlled by well head 11. Well head 11 diverts the production fluids into an oil-gas separator 12. Separator 12, as its name implies, separates the liquid and gas components of the production stream PF. Gas is diverted into a gas pipeline GP, while liquids are diverted into a liquid transportation system LTS.

It will be appreciated that both the subsurface and surface systems have been greatly simplified. A production casing, for example, may incorporate many different tools to assist in installing and cementing the casing. Moreover, solid particulates typically are entrained with the oil and other liquids produced from the well, especially in the initial production stream. Liquid typically will be diverted from an oil-gas separator into a sand separator. Produced oil may be transferred to a storage tank for transport to a pipeline, or it may feed directly into a pipeline. Gas streams may be run through dryers and filters designed to remove moisture and particulates that can corrode gas pipelines.

FIGS. 2C-2F show well 1 after a first embodiment 30 of the novel gas pump production systems has been installed in casing 20. Lift system 30 comprises, in various stages of artificial lift, a production tube 31, continuous gas injection valves 51, intermittent gas injection valves 52, and a first preferred embodiment 40 of the novel gas pumps. Novel gas pump 40 is installed at the end of production tube 31. When in operation, gas pump 40 comprises, as seen best in FIGS. 3, a chamber 41, a dip tube 42, a gas supply line 43, a gas vent line 44, a gas supply valve 53, a gas vent valve 54, a valve control line 45, a chamber check valve 55, and a dip tube check valve 56. Chamber 41 is defined by an upper packer 46 and a lower packer 47. Preferably, gas pump 40 also incorporates a sump check valve 57 and a control line shut-off valve 58.

Figure 2C:
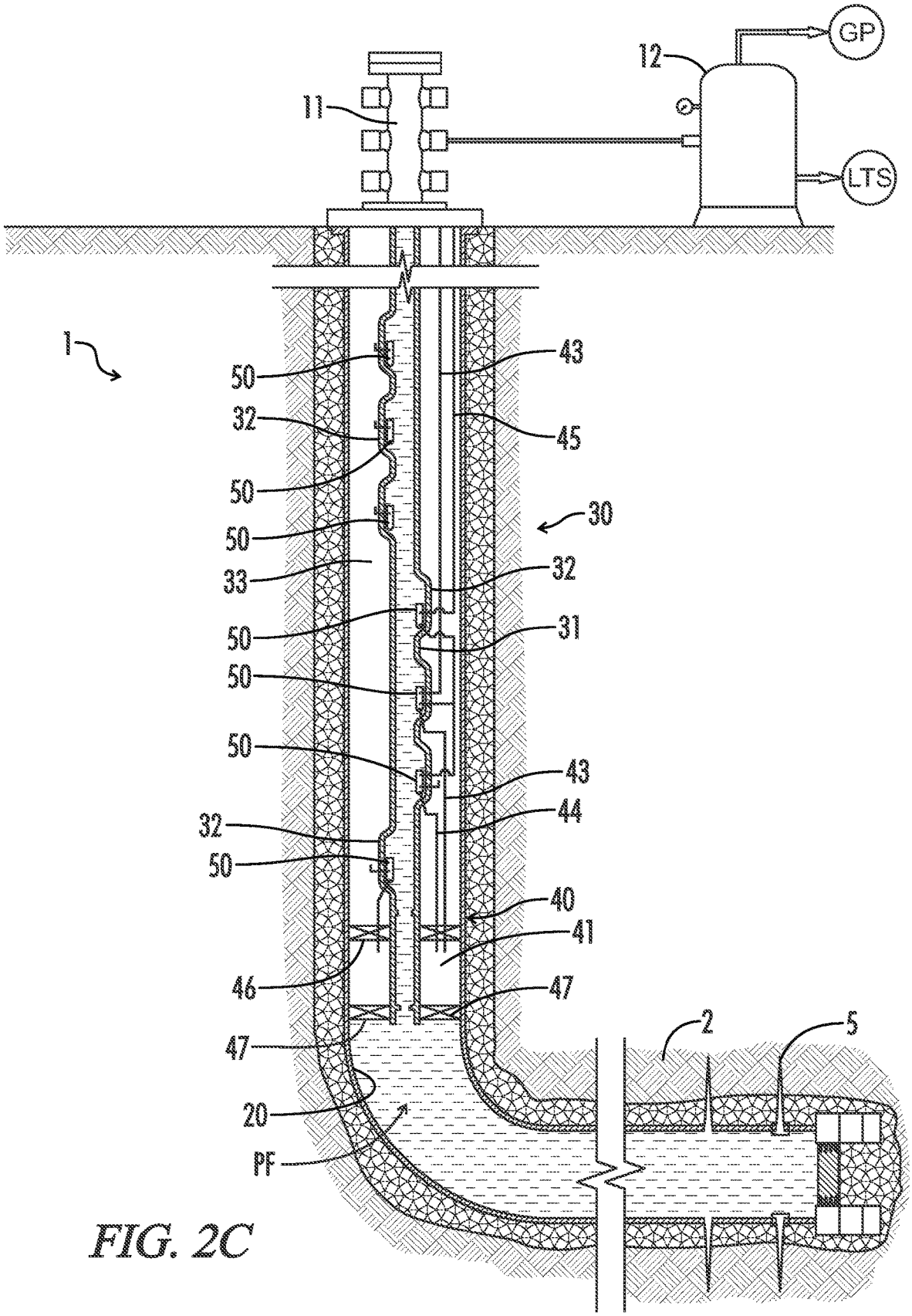

The operation of lift system 30 and gas pump 40 will be described in further detail below. When lift system 30 is initially installed in casing 20, however, the hydrostatic pressure in formation 2 typically will still be high enough to push oil PF all the way to the surface. The operational valves required for the various stages of gas lift may be installed at the same time if desired, but they will not be needed as long as oil PF flows naturally to the surface. Thus, as shown in FIG. 2C, lift system 30 typically will be installed without chamber check valve 55 and dip tube check valve 56. Moreover, dummy valves 50 preferably will be installed in place of continuous gas injection valves 51, gas supply valve 53, gas vent valve 54, sump check valve 57, and shut-off valve 58. Surface equipment required for various stages of gas lift also need not be installed until liquids no longer flow unassisted to the surface.

Production tube 31 extends through upper and lower packers 46/47. Upper packer 46 provides a seal between production tube 31 and casing 20. Lower packer 47 provides another seal between production tube 31 and casing 20, thus diverting production fluids from casing 20 into production tube 31. Production tube 31 may be any conventional tubing, such as coiled tubing. Preferably, however, production tube 31 will be assembled from joints of pipe. The joints may be of larger diameter than coiled tubing and thus provide greater production capacity.

As shown schematically in FIG. 2C, production tube 31 preferably includes joints of pocket mandrels 32. Pocket mandrels 32 provide a volume to the side of the main cross-section or "drift" of production tube 31. A receptacle (not shown in FIG. 2C) may be provided in that volume to allow valves to be installed, removed, and replaced. As discussed below, the receptacles will have various passages that allow communication with the installed valves. Dummy valves 50 are essentially plugs that shut those ports and prevent fluids from flowing between production tube 31 and annulus 33. Dummy valves also can help reduce accumulation of debris in the valve receptacles that otherwise might interfere with installation or operation of functional valves when they are needed.

Production tube 31 and dip tube 42 also preferably comprises nipples. The nipples are illustrated schematically in FIG. 2C as small, internal constrictions in production tube 31 and are adapted to receive chamber check valve 55 and dip tube check valve 56 when those valves are installed. Depending on the depth of the well, it may be desirable to provide additional nipples further up production tube 31 so that additional check valves may be installed to reduce the hydrostatic pressure on check valves 55/56.

Conventional pocket mandrels and nipples suitable for use in the novel systems are available from a number of commercial manufactures. Pocket mandrels that may be suitable include the D and F series pocket mandrels from Dover Artificial Lift, The Woodlands, Texas. Suitable nipples may include the E series seating nipples available from American Completion Tools, Houston, Texas, and the No-Go profile nipples available from Peak Well Systems, Bayswater, Western Australia, Australia.

Preferably, however, as discussed in further detail below, gas supply valve 53 and gas vent valve 54 will be installed in pocket mandrels that incorporate a poppet valve. The poppet valve may be used to control flow of fluid in control line 45 during installation and replacement of those valves. Pocket mandrels with poppet valves are disclosed in applicant's pending patent application entitled "Downhole Gas Control Valve and Gas Lift Systems," Ser. No. 17/028,845, filed concurrently herewith. The disclosure contained in that patent document is incorporated herein in its entirety by this reference. In the event of conflict with the incorporated disclosure, unless arising from obvious error, the disclosure provided in this incorporating application shall control.

Overview of Gas Lift Operations

Figure 2D:
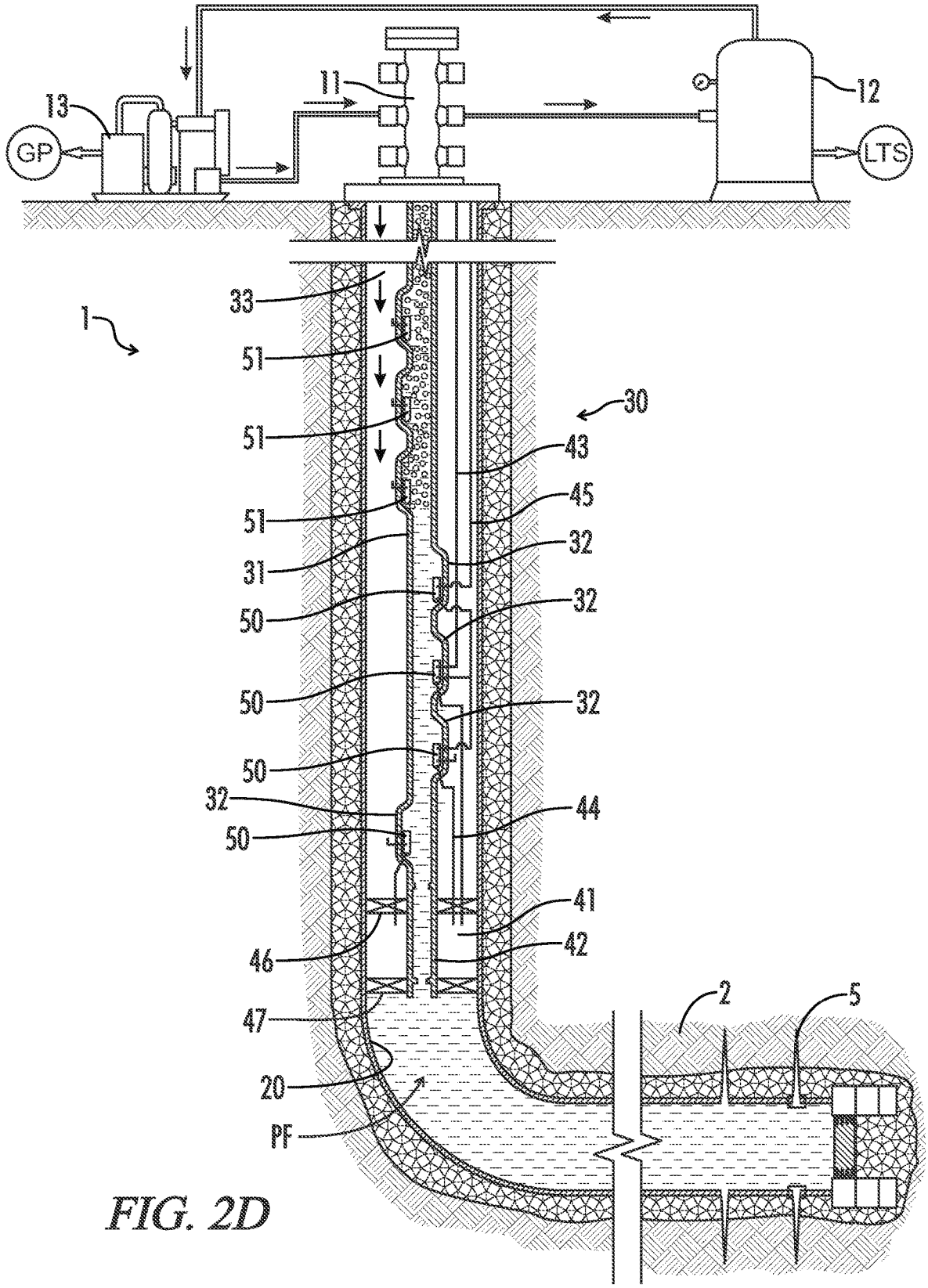

As illustrated in FIG. 1, well 1 may extend for thousands of feet into the earth. The hydrostatic head, that is the weight of fluid in production tube 31, will be quite large. After a period of time, the bottom hole pressure behind liquid at the bottom of well 1 will no longer exceed the hydrostatic head in production tube 31. Oil cannot flow naturally to the surface. Thus, FIG. 2D shows production system 30 being used to produce oil from well 1 by continuous gas lift.

Continuous gas injection valves 51 have been installed in production tube 31. A field compressor 13 also has been installed at the surface. A portion of the gas produced from well 1 is diverted from the oil-gas separator 12 into field compressor 13. The diverted gas is compressed by compressor 13, typically to a pressure from about 1,000 to 1,200 psi, less commonly up to perhaps 1,800 psi and then pumped through well head 11 into the annulus 33 between production tube 31 and casing 20. Gas in annulus 33 then flows through injection valves 51 into oil flowing up production tube 31. The density of the oil will be reduced, thus reducing the weight of the column of oil in production tube 31. Oil now is able to continue flowing to the surface.

Gas injection valves 51 may be of any conventional design. Many valves are available commercially and may be suitable, such as WP series valves from Dover Artificial Lift, BK series injection valves from Schlumberger Limited, Houston, Texas, and R-1 series injection valves Weatherford International, Houston, Texas. Likewise, field compressor 13 is of conventional design and typically will incorporate controllers and other auxiliary equipment enabling it to be operated automatically.

After an additional period of time, well 1 will be further depleted and its bottom hole pressure further diminished. More and more gas must be injected into the production fluid to reduce its weight below the formation pressure. At a certain point, oil will simply fall out of the gas and remain in production tube 31. Thus, FIG. 2E shows production system 30 being used to produce oil from well 1 by intermittent gas lift.

Continuous gas injection valves 51 have been removed and intermittent gas injection valves 52 have been installed in their place. Unlike continuous gas injection valves 51, which are designed to continuously inject relatively small streams of gas, intermittent gas valves 52 are designed to periodically inject large volumes of gas into production tube 31. A bubble of gas is formed which then lifts the oil on top of it toward the surface.

Figure 2E:
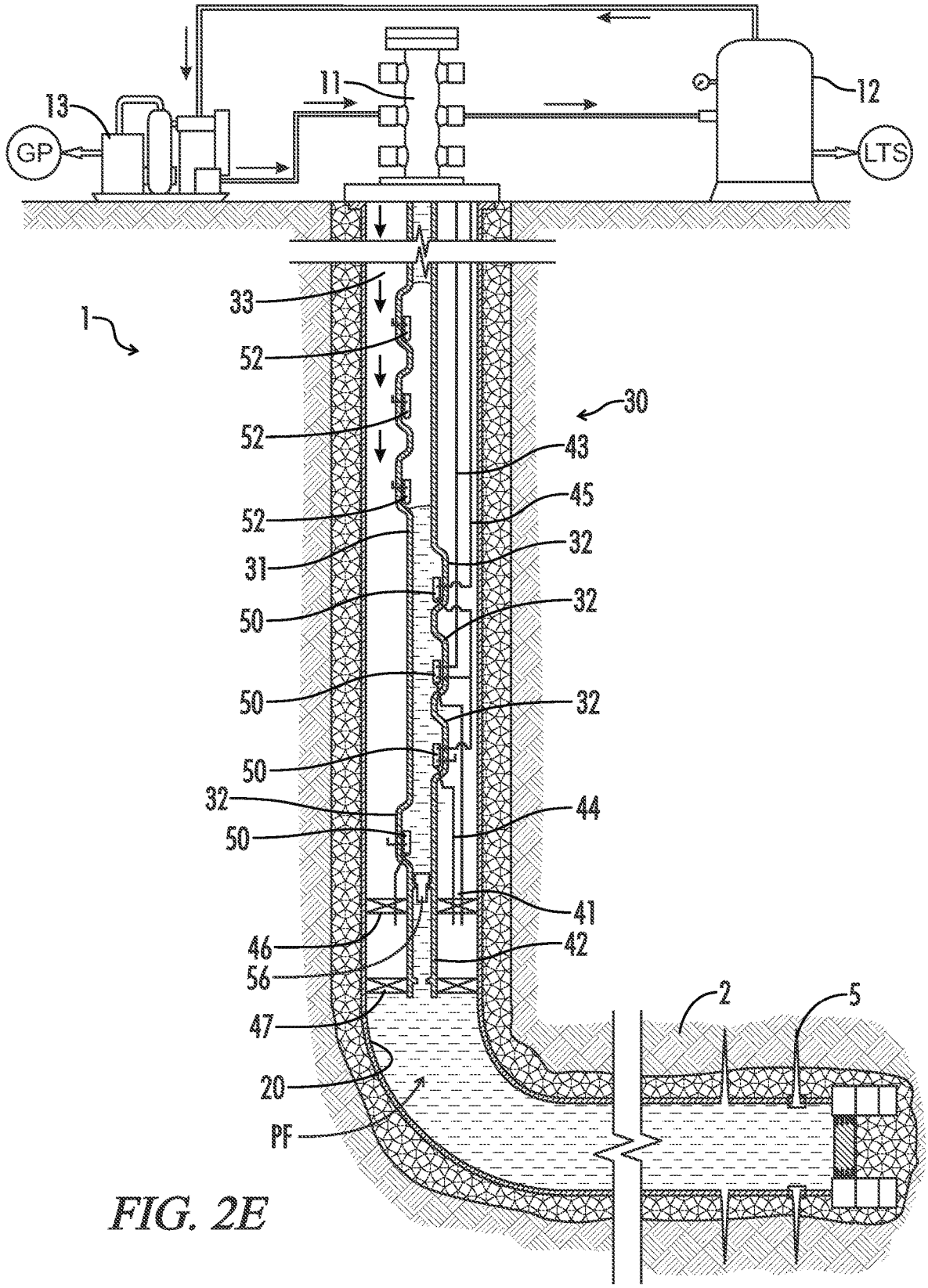

Typically, as shown in FIG. 2E, dip tube check valve 56 will be installed in production tube 31 to prevent oil from being pushed back into well 1 as gas is injected into production tube 31. Additional check valves may be installed further up production tube 31 in order to reduce the hydrostatic pressure on dip tube check valve 56. It also will be appreciated that it may not be necessary to replace all gas injection valves 51. Some gas injection valves may be used in intermittent gas lift operations.

Intermittent gas injection valves 52 and dip tube check valve 56 may be of any conventional design and many commercially available vales may be suitable. Such valves include the Dover WP series, Schlumberger PK-1 and R-6 series, and Weatherford R-1 series valves. Checks valves may include standing valves available from Peak Well Systems, E-3 series standing valves available from American Completion Tools, and A-2 Series standing valves sold by Schlumberger.

Overview of Gas Pump Operations

Figure 2F:
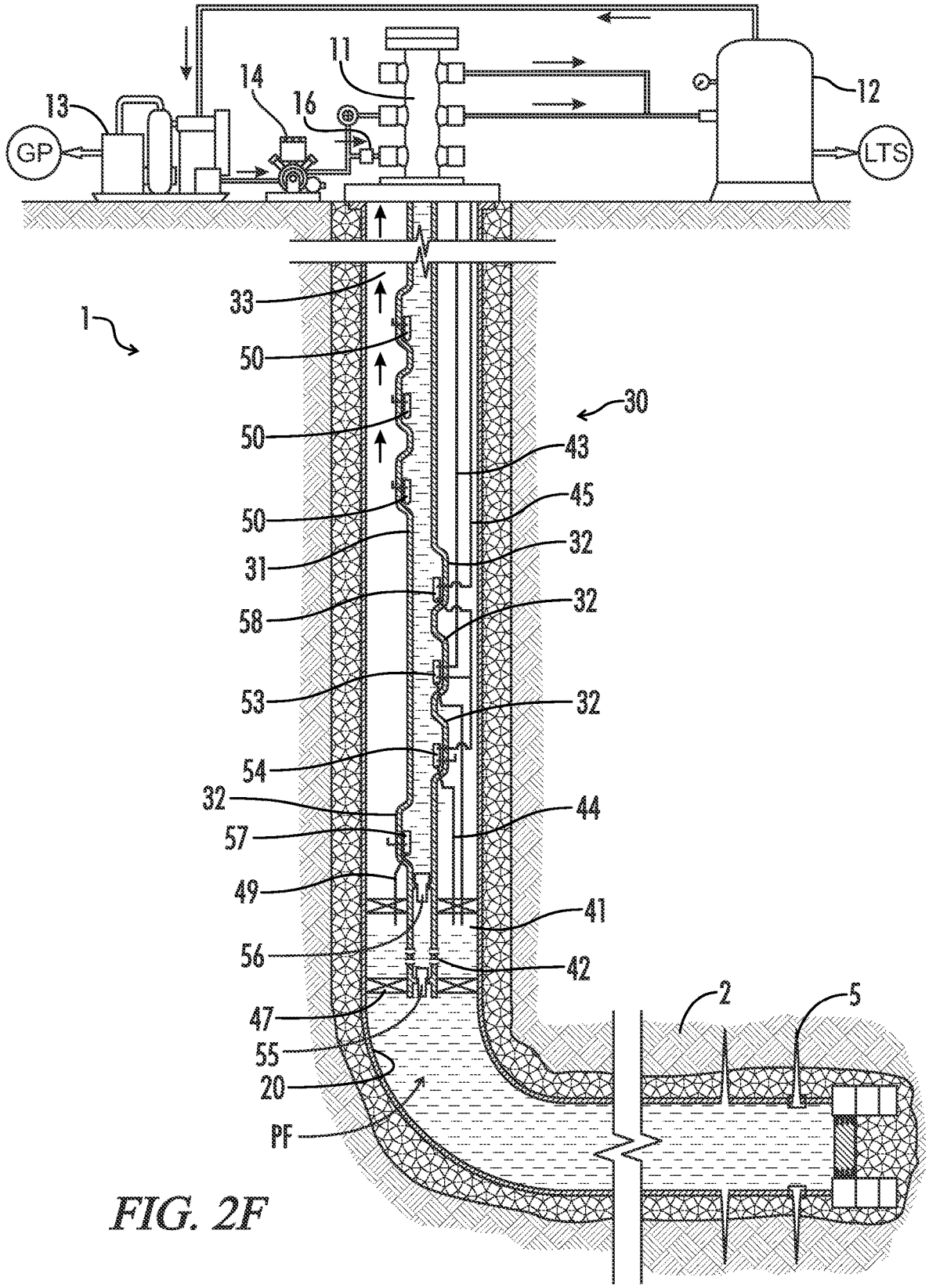

In the last stages of a well's production cycle it may not be practical to continue intermittent gas lift. The well's bottom hole pressure will have dropped even more. Fallback of oil though the gas and the volume of gas required may rise to unacceptable levels. Thus, FIG. 2F shows production system 30 being used to produce oil from well 1 by gas pump 40.

Gas supply valve 53, gas vent valve 54, sump valve 57, and control line shut-off valve 58 have been installed in production tube 31, as has chamber check valve 55 and, if desired, additional check valves above dip tube check valve 56. A perforating gun (not shown) has been run into production tube 31 to create perforations near the end of dip tube 42. Alternately, dip tube 42 may be provided with a sliding sleeve valve that can be actuated to establish communication between dip tube 42 and chamber 41. Though not necessarily essential, it also will be noted that intermittent gas injection valves 52 have been removed and replaced with dummy valves 50.

At the surface, a gas booster compressor 14 and a gas switch 16 has been installed along with their associated controls. Booster compressor 14 is connected to, and further compresses gas discharged from field compressor 13. Preferably, booster compressor 14 will compress the gas to a pressure of at least about 2,000 psi or, when pump 40 in installed at greater depths, at least about 5,000 psi to provide greater lifting force for gas pump 40. Booster compressor 14 discharges the high-pressure gas into well head 11 which in turn is connected to gas supply line 43. Booster compressor 14 also feeds pressurized gas into gas switch 16 and ultimately control line 45 through well head 11.

Cycling of gas pump 40 can be better appreciated by reference to FIG. 3. As shown therein, gas supply line 43 ultimately feeds into chamber 41. Gas vent line 44 leads from chamber 41 and discharges into annulus 33. Gas supply valve 53 controls gas flow through supply line 43, turning it on and off as required. Gas vent valve 54 controls flow through vent line 44. Gas supply valve 53 and gas vent valve 54 are hydraulically operated, and both are controlled by pressure signals transmitted through control line 45.

Gas pump 40 is illustrated as having separate supply and vent lines 43/44 leading into and out of, respectively, chamber 41. Both lines 43/44 pass through upper packer 46. As will be obvious to those skilled in the art from the foregoing disclosure, gas pump 40 may be provided with a single, common supply/vent line segment passing through packer 46. The common segment would join with supply line 43 and vent line 44 above packer 46. Gas would flow in both directions through the common segment, allowing the design, assembly, and installation packer 46 to be simplified. Similarly, a short, common segment may provide flow into and out of the chamber in other preferred embodiments of the novel gas pumps.

Figure 3A:
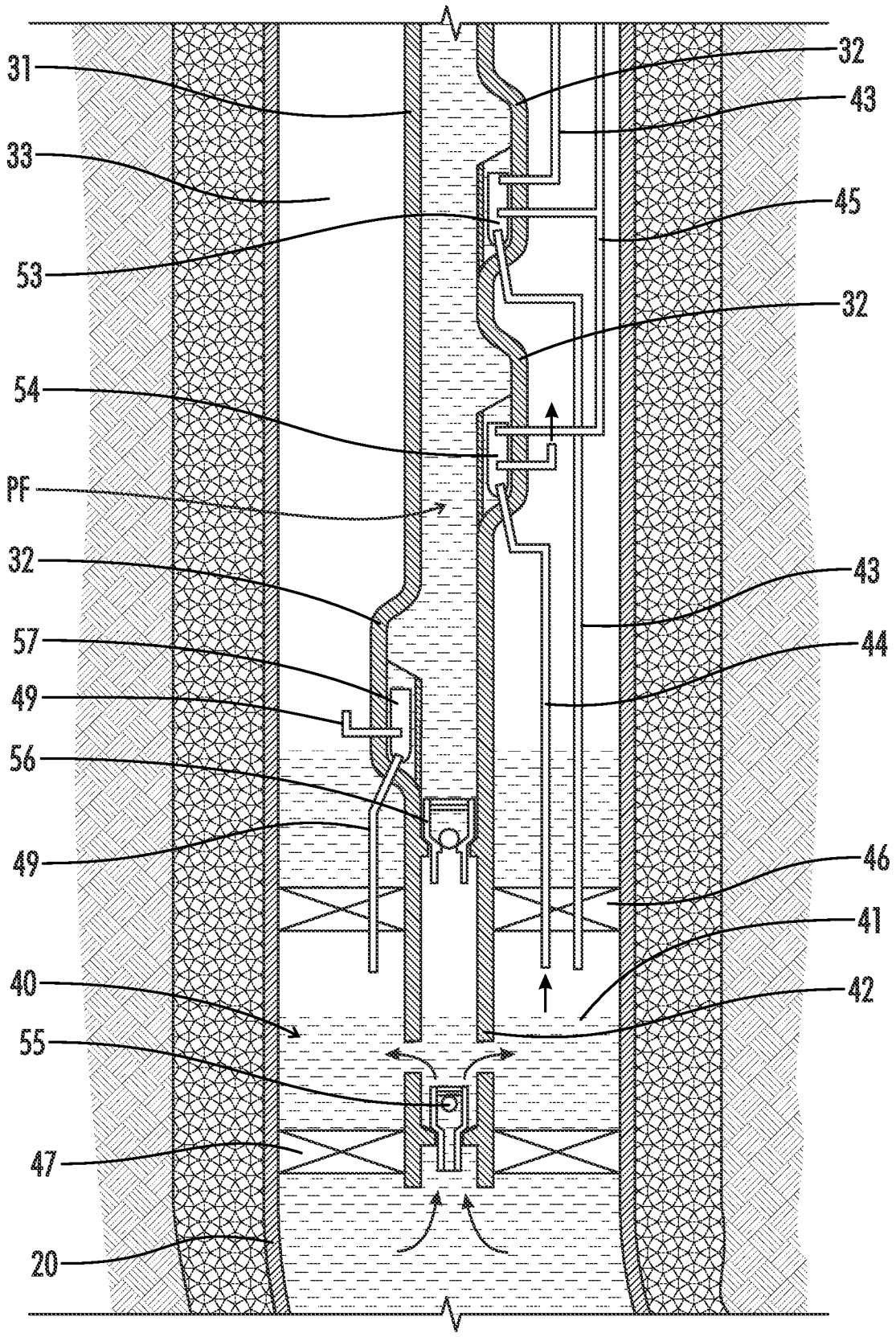
FIGS. 3A and 3B ("FIGS. 3") are sequential schematic illustrations of novel gas pump 40 showing its pump cycle.

FIG. 3A schematically shows gas pump 40 in its "fill" cycle. Gas supply valve 53 is shut. Oil is able to flow upward into chamber 41 via chamber check valve 55 and the perforations in dip tube 42. Oil in production tube 31 is prevented from flowing down into chamber 41 by dip tube check valve 56. Gas vent valve 54 is open, allowing gas in chamber 41 to flow out vent line 44 and into annulus 33 as oil fills chamber 41.

Figure 3B:
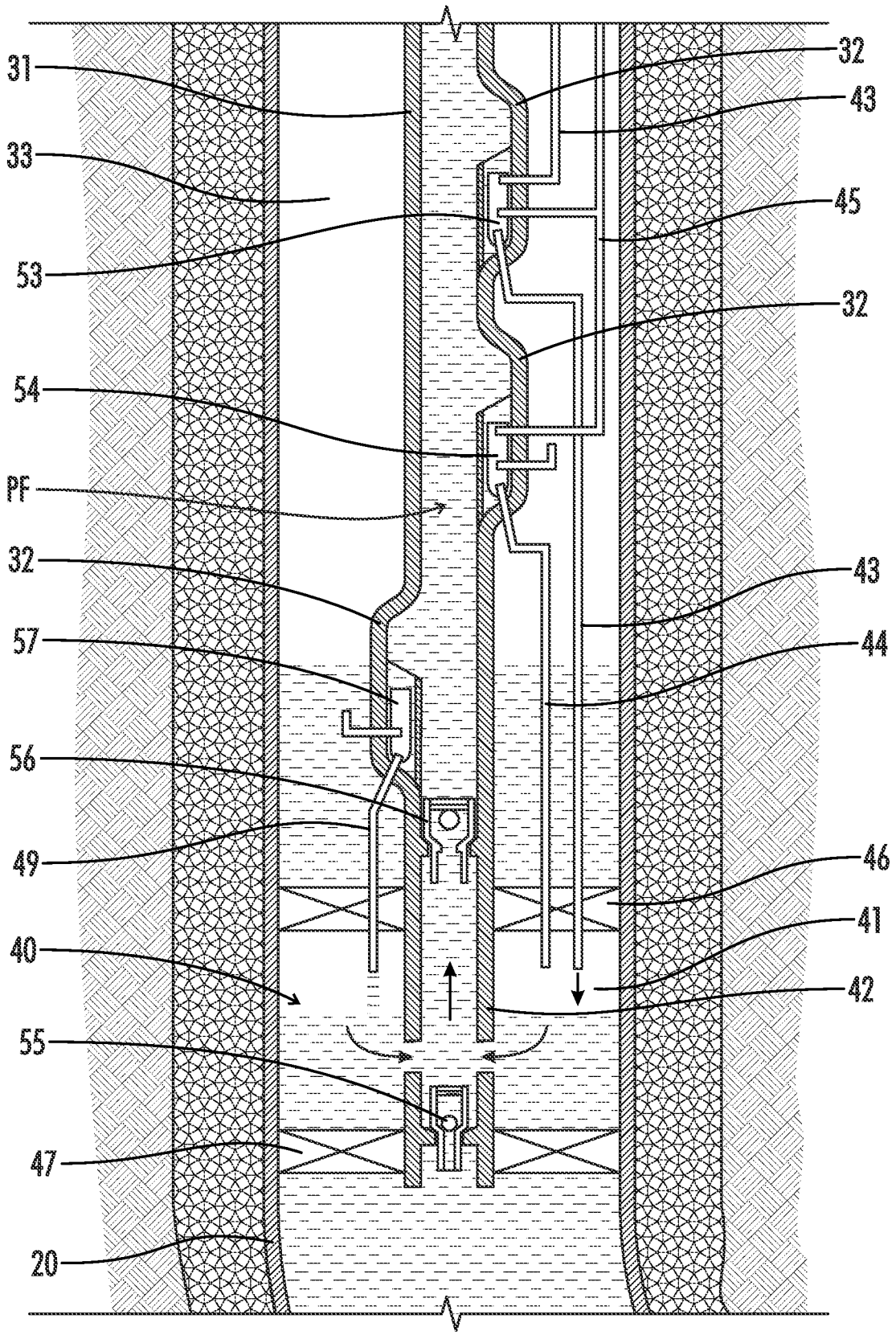

Once chamber 41 is substantially filled with oil, a pressure signal, that is, an increase of fluid pressure in control line 45 will be generated. The pressure signal will travel through control line 45 to shut vent valve 54 and open gas supply valve 53. The discharge cycle begins, as shown in FIG. 3B.

High-pressure gas is injected into chamber 41 via gas supply line 43. Gas vent valve 54 is shut, preventing gas from flowing out of chamber 41 through vent line 44. Sump check valve 57 prevents high pressure gas from flowing into annulus 33. Chamber check valve 55 prevents oil from flowing back into casing 20. Thus, the high-pressure gas will force oil out of chamber 41 and into dip tube 42 via the perforations. Dip tube check valve 56 opens to allow oil to flow from dip tube 42 into production tube 31. Once substantially all oil has been pumped out of chamber 41, another pressure signal will be generated, that is, a bleeding off of pressure in control line 45. That signal will shut gas supply valve 53 and open vent valve 54. Gas pump 40 will start another fill cycle.

Any suitable fluid may be used in control line 45, such as natural gas or gas-over-hydraulic. Preferably, however, control line 45 is filled with hydraulic fluid. Hydraulic control lines provide extremely short response times. Pressure signals generated at the surface are rapidly transmitted to valves 53 and 54 and allow the system to be controlled more closely and precisely. More responsive control systems are particularly important when, as described below, novel gas supply valve 53 is used in intermittent gas lift.

It will be appreciated, however, that as pump 40 is installed at progressively greater depths, fluid pressure in control line 45 will increase correspondingly. Valves 53/54 will be exposed to increasing operating pressures. That is especially true for hydraulic control lines. The operating pressure in hydraulic control lines can exceed the rating of many control valves. While novel valves 53 and 54, as described further below, are capable of operating at high actuation pressures, the same is not true of many downhole gas control valves. Thus, when other valves are used in the novel pumps, such as valves 153, 154, 253, and 353 disclosed in detail below, it may be preferable to use a pneumatic or a gas-over-hydraulic control line.

The pressure head in pneumatic control lines is significantly less, especially for valves installed at greater depths. Thus, the actuation pressure to which the valves are exposed is reduced, and the injection valve may be designed with less biasing force. The same is true to a lesser degree of gas-over-hydraulic lines, where the lower portion of the control line is filled with hydraulic fluid and the upper portion is filled with gas.

Both pneumatic and gas-over-hydraulic control lines, however, have significantly slower response times. Both types of control fluid systems ultimately rely on pressure adjustments in relatively large volumes of gas, thus causing considerable lag between initiation of a pressure signal at the surface and actuation of the valve. Thus, control line 45 is exemplified as a hydraulic control line.

Hydraulic pressure signals can be generated in control line 45 by a hydraulic pump, accumulator, and control system installed along with the other surface equipment. Preferably, however, pressure signals through control line 45 will be generated by gas switch 16. Gas switch 16 is installed in a line running from field compressor 13 and communicates with control line 45. It has a relatively small chamber. Thus, it may be filled quickly with compressed gas from field compressor 13 to increase the fluid pressure in control line 45. Gas also may be bled out of gas switch 16 quickly to decrease the fluid pressure in control line 45.

Gas vented from chamber 41 into annulus 33 is "wet." That is, it contains entrained droplets of oil. Over the course of many pump cycles, oil will collect above upper packer 46, possibly accumulating to a level in annulus 33 that it interferes with venting of gas from chamber 41 into annulus 33. Thus, pump 40 and other embodiments of the novel gas pumps may incorporate a sump line 49 that allows oil collecting above an upper packer to circulate back through the packer. For example, as shown in FIGS. 3, gas pump 40 preferably includes a sump check valve 57, for allowing collected oil to flow back into chamber 41. Sump check valve 57 allows oil above upper packer 46 to return to chamber 41, but shuts off flow of gas and other fluids from chamber 41.

Gas supply valve 53 and gas vent valve 54 preferably are installed relatively close to chamber 41 so as to improve the response and cycle times of gas pump 40. The precise location, however, is not especially critical and may be varied considerably to facilitate other operations. For example, it generally is desirable to provide a certain spacing between valves and the like that will be installed and retrieved by wireline. Spacing helps ensure that the wireline tool will find its target. Similarly, the exact location of check valves 55/56 is not overly critical. For that matter, it will be understood that there is no precise demarcation where production tube 31 ends and dip tube 42 begins. Dip tube 42 may be properly viewed as a lower portion of production tube 31. Thus, if would be accurate to view a check valve installed within dip tube 42 as being installed in production tube 31.

Figure 4:
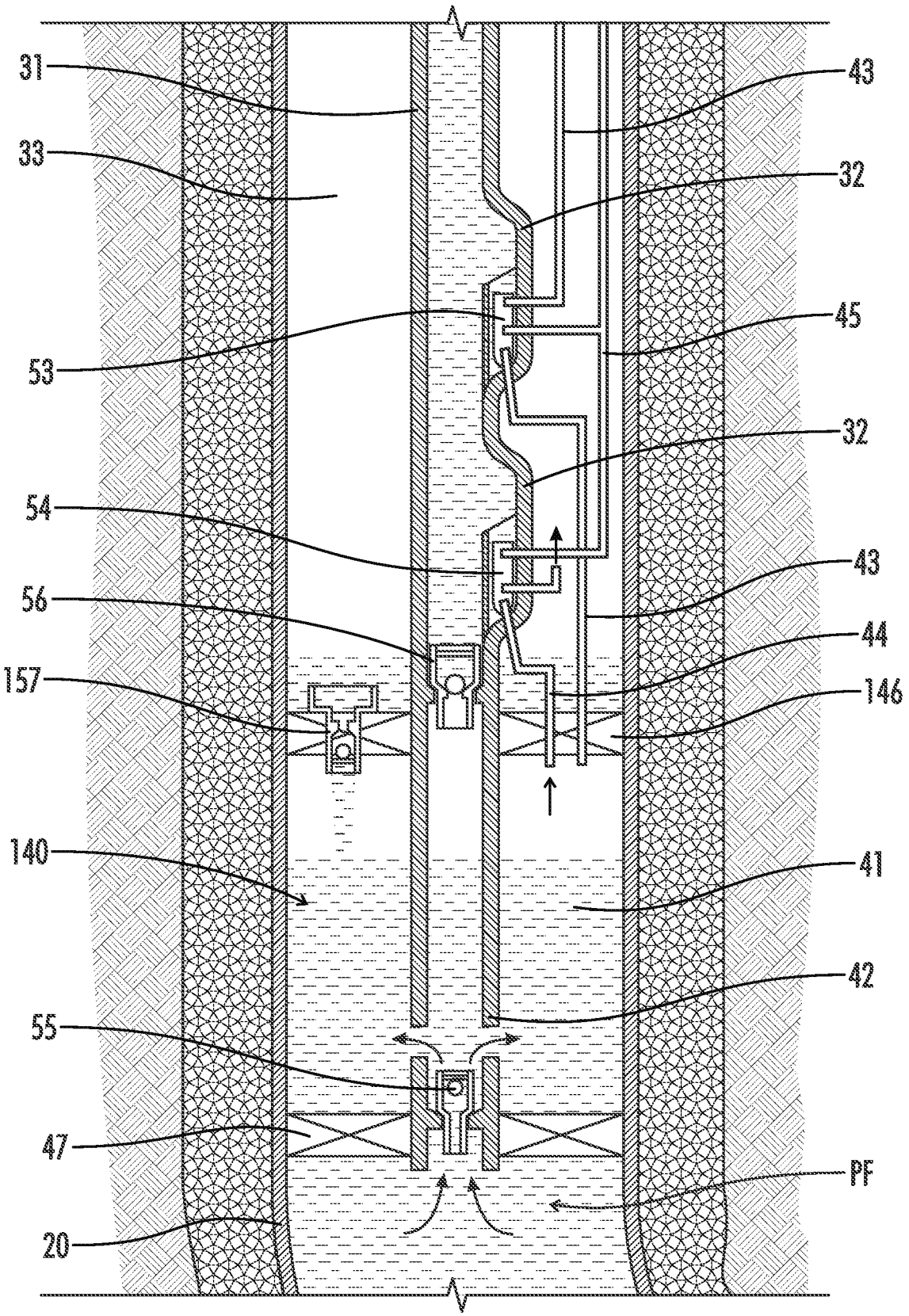
FIG. 4 is a schematic illustration of a second preferred embodiment 140 of the novel gas pumps.

A second preferred embodiment 140 of the novel gas pumps is shown schematically in FIG. 4. Gas pump 140 is substantially identical to gas pump 40 except that it incorporates a sump check valve 157 instead of sump check valve 57. Sump check valve 157, like valve 57, allows oil above an upper packer 146 to return to chamber 41, but checks flow out of chamber 41. Sump check valve 157 is mounted in a nipple provided in an upper packer 146. When the system is installed, a dummy valve preferably will be installed in packer 146, and sump check valve 157 will not installed until gas pump 140 is put into operation.

Figure 5:
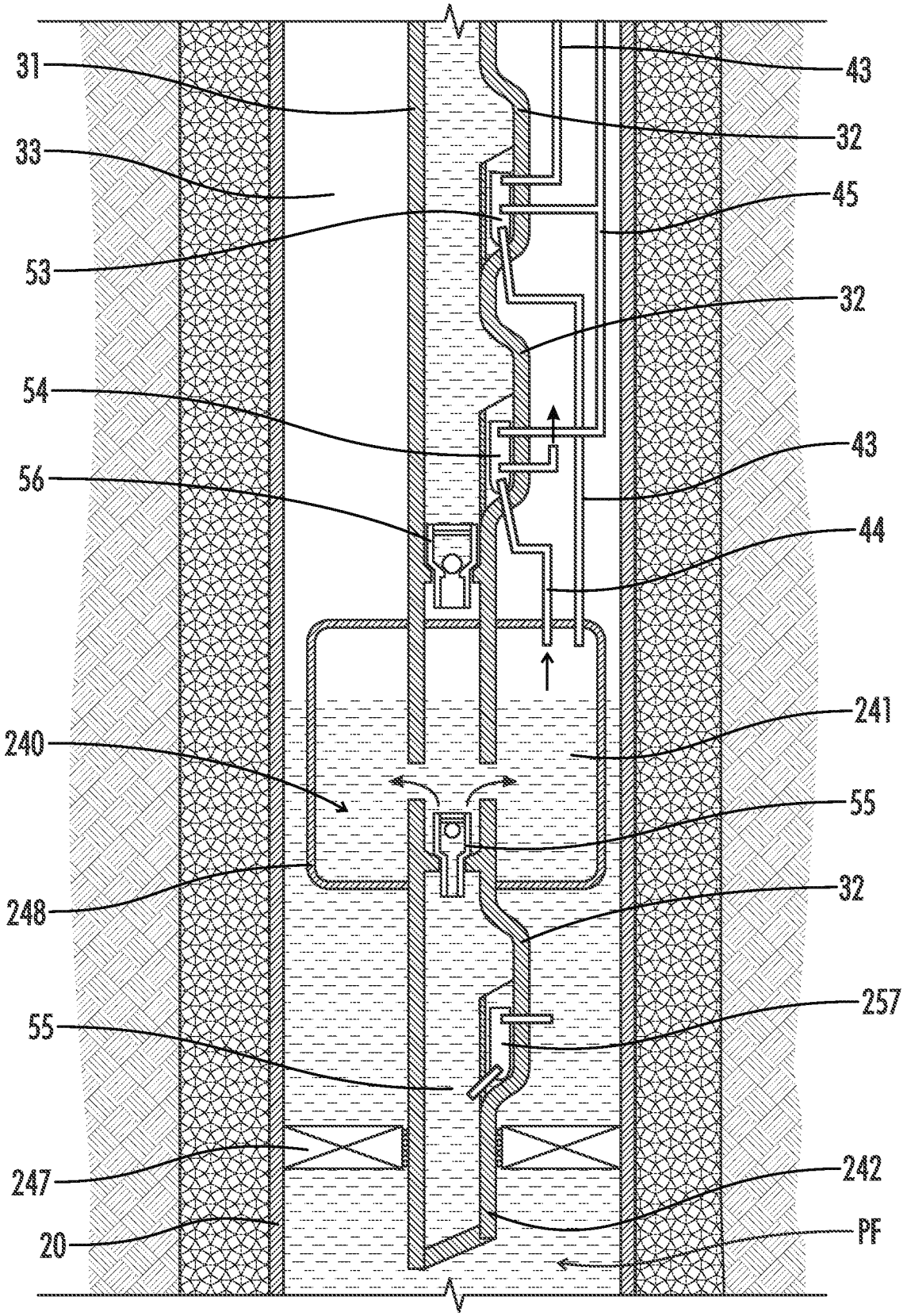
FIG. 5 is a schematic illustration of a third preferred embodiment 240 of the novel gas pumps.

A third preferred embodiment 240 of the novel gas pumps is shown schematically in FIG. 5. Gas pump 240 is similar to gas pumps 40 and 140 except that it incorporates a tank 248. More specifically, chamber 241 is provided by tank 248. Tank 248 is installed at the end of production tube 31. A dip tube 242 extends through tank 248 and through a packer 247. The portion of dip tube 242 between tank 248 and packer 247 has a pocket mandrel 34 in which is mounted a circulating valve 257. Circulating valve 257 allows fluid communication between annulus 33 and dip tube 242. Alternately, dip tube 242 may be provided with a sliding sleeve valve that can be actuated to establish communication between annulus 33 and dip tube 242, or dip tube 242 may be perforated at a location between tank 248 and packer 247.

When the system is installed, a dummy valve preferably will be installed in pocket mandrel 34, and circulating valve 257 will not be installed until gas pump 240 is put into operation. It will be noted that upper packer 46 of gas pump 40 is not required in gas pump 240. When a dummy valve is installed in pocket mandrel 34, packer 247, like packer 46, isolates formation 2 from high gas lift pressures introduced into annulus 33. Installation of packer 247, however, typically will be accomplished more easily.

Figure 6:
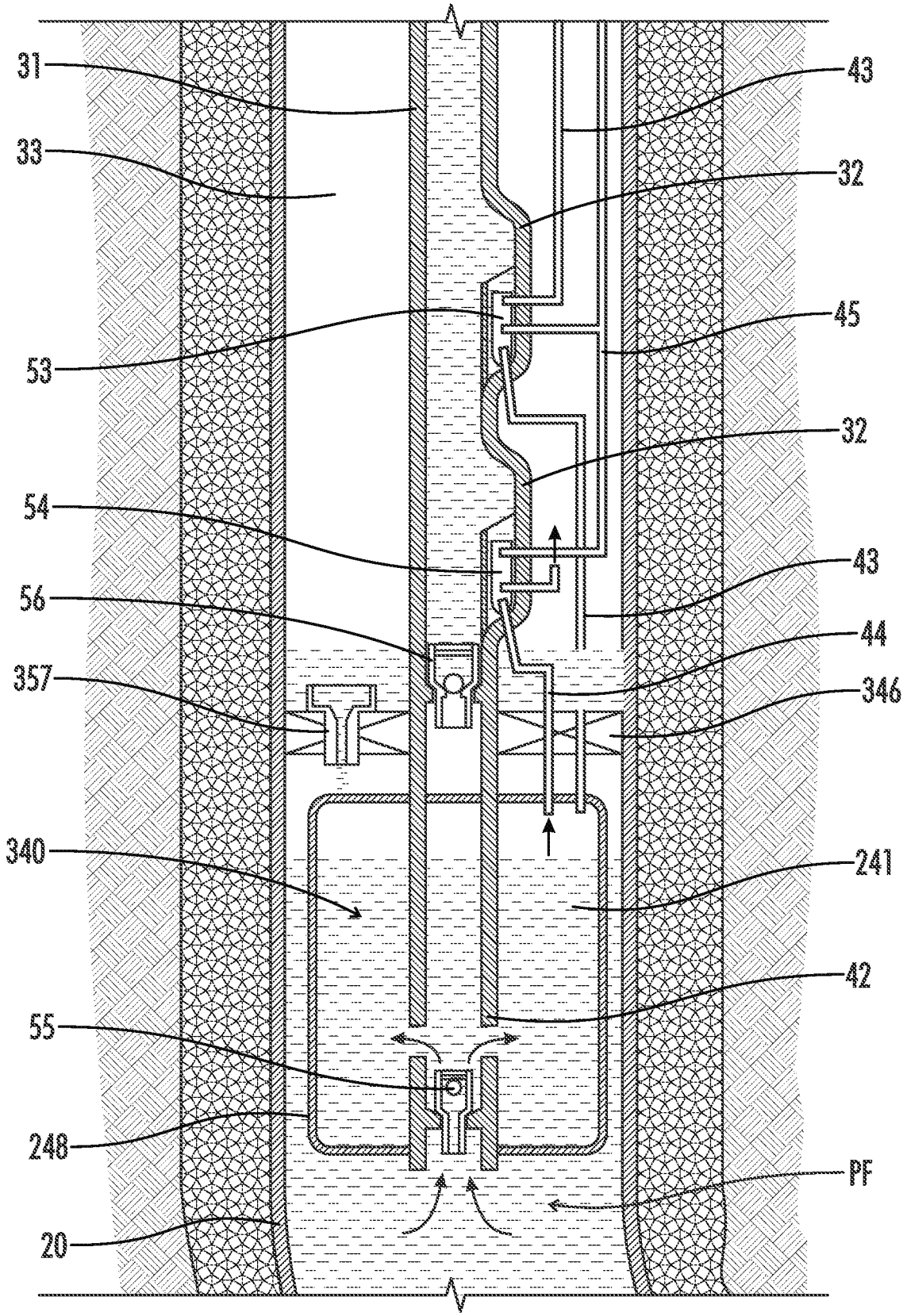
FIG. 6 is a schematic illustration of a fourth preferred embodiment 340 of the novel gas pumps.
Figure 7:
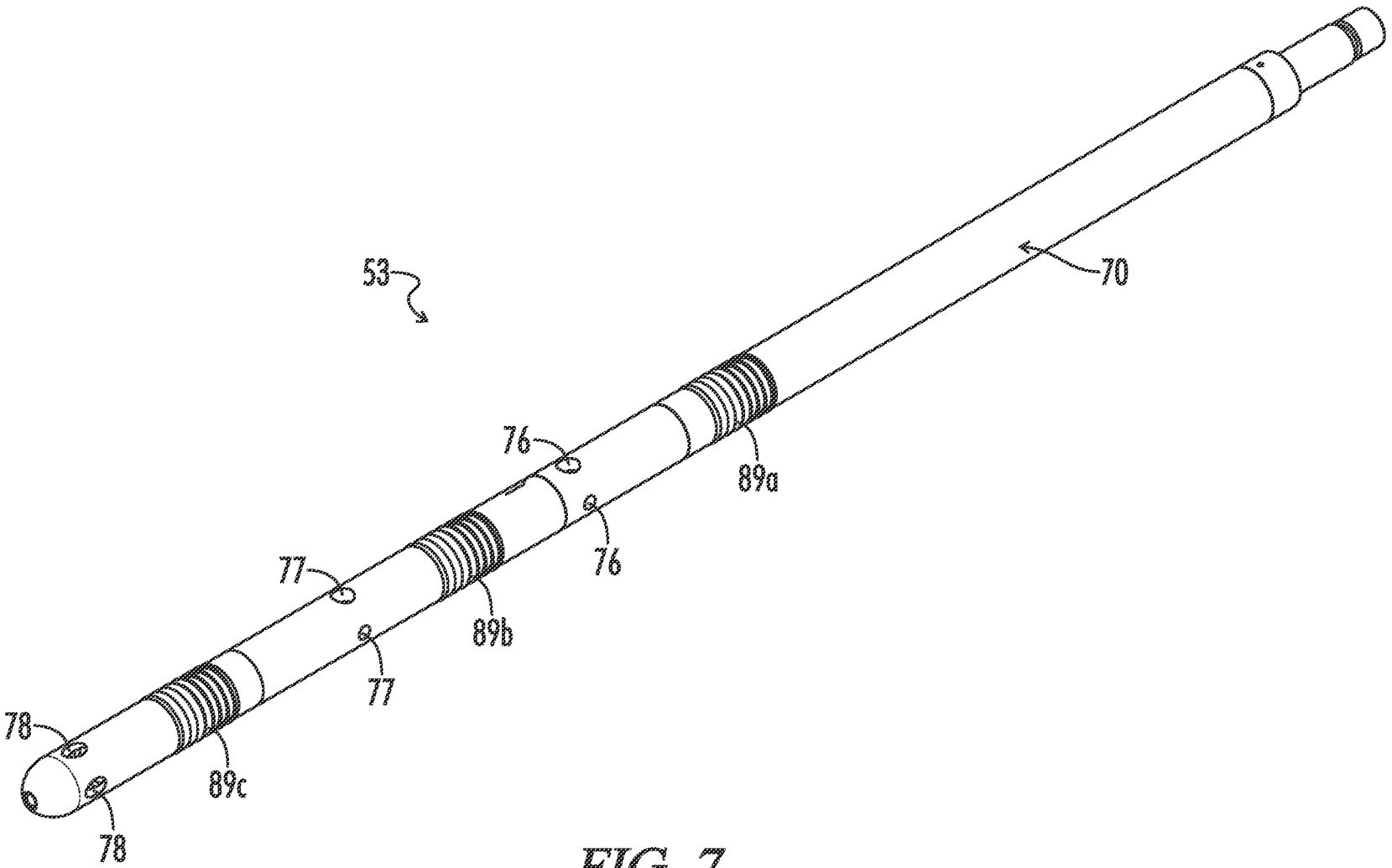
FIG. 7 is an isometric view of a first preferred embodiment 53 of the novel hydraulic valves of the subjection invention which is incorporated into gas pump 40, which valve 53 is used as a gas supply valve.
Figure 8:
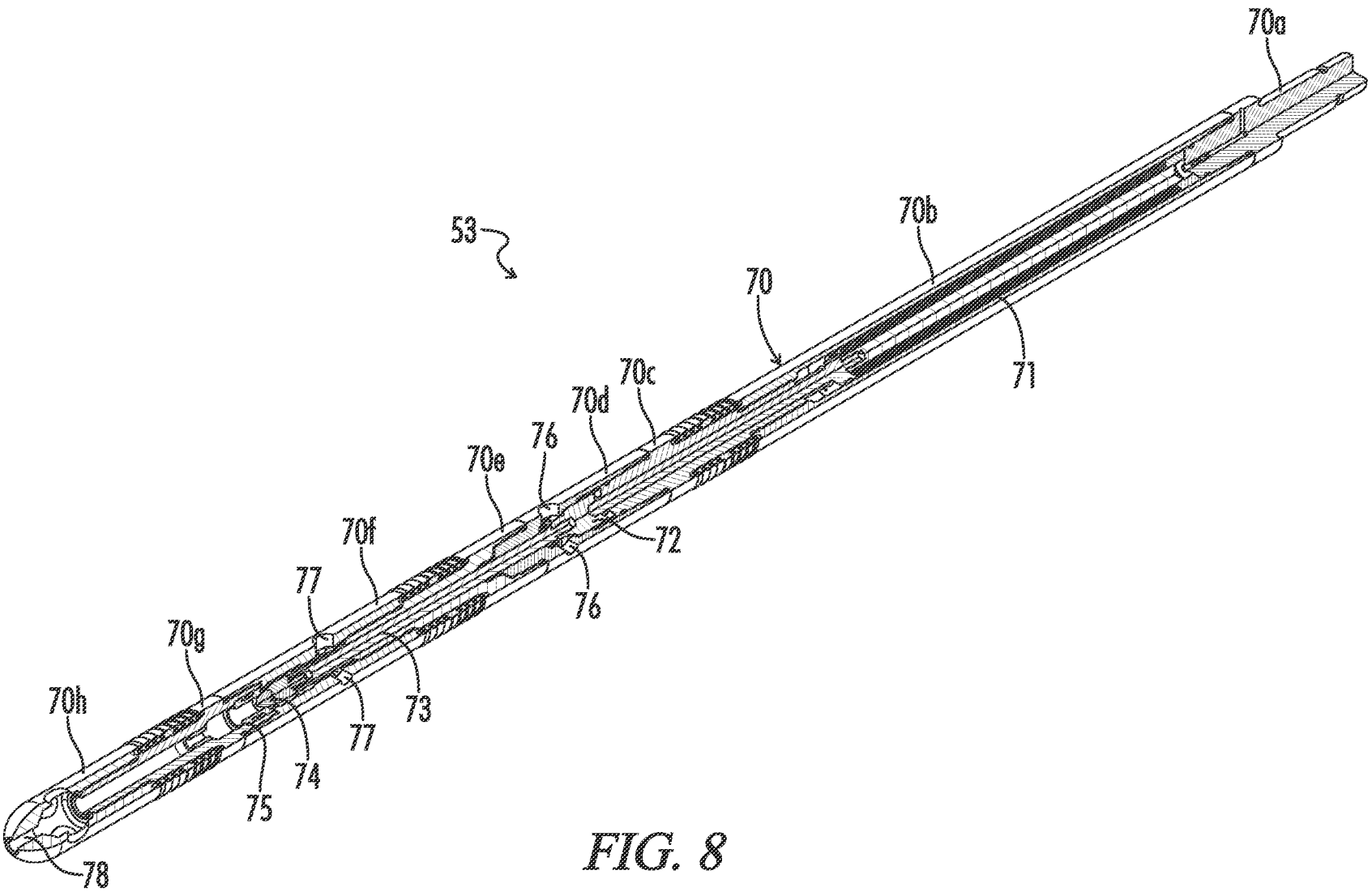
FIG. 8 is an isometric, quarter-sectional view of gas supply valve 53 shown in FIG. 7, showing valve 53 in its normal, closed state.
Figure 9:
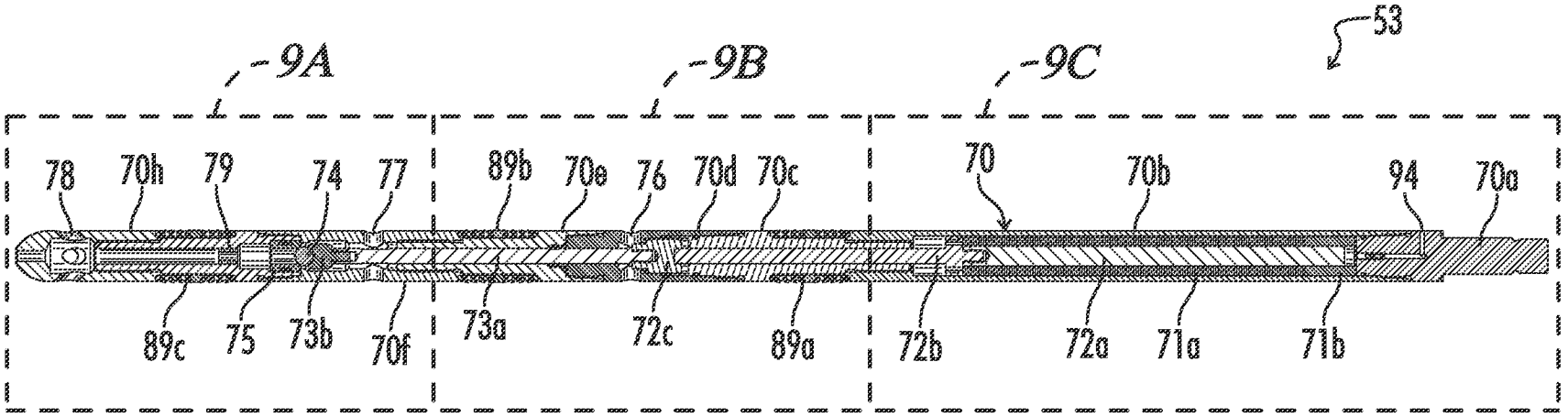
FIG. 9 is a longitudinal cross-sectional view of gas supply valve 53 in its normal, closed state.
Figure 10:
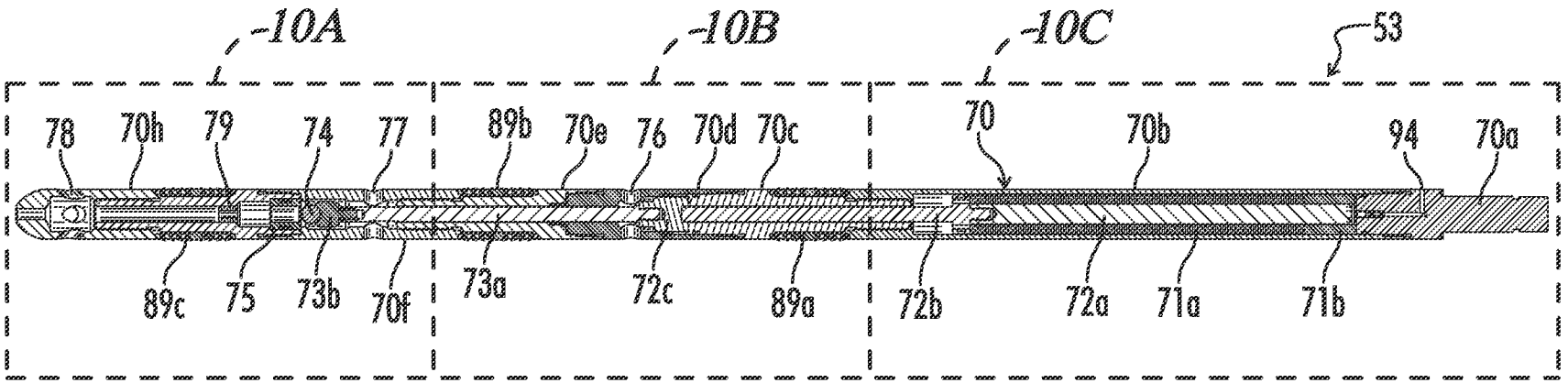
FIG. 10 is a longitudinal cross-sectional view of gas supply valve 53 in its actuated, open state.
Figure 9A:
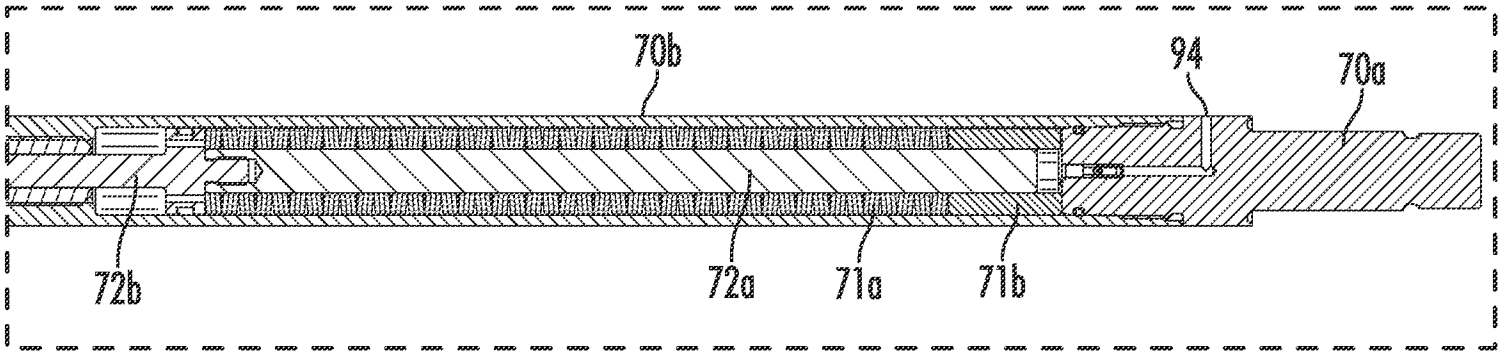
FIG. 9A is an enlarged cross-sectional view taken from FIG. 9 showing the upper portion of gas supply valve 53 in its normal, closed state.
Figure 10A:
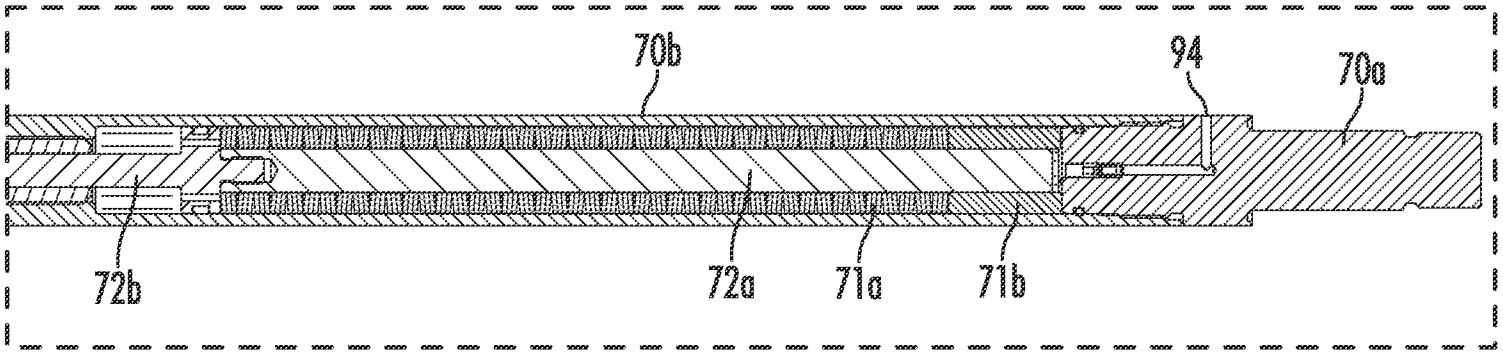
FIG. 10A is an enlarged cross-sectional view taken from FIG. 10 showing the upper portion of gas supply valve 53 in its actuated, open state.
Figure 9B:
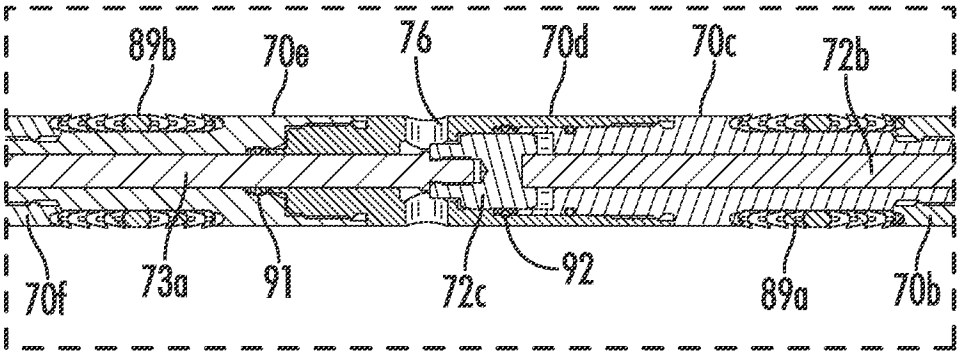
FIG. 9B is an enlarged cross-sectional view taken from FIG. 9 showing the middle portion of gas supply valve 53 in its normal, closed state.
Figure 10B:
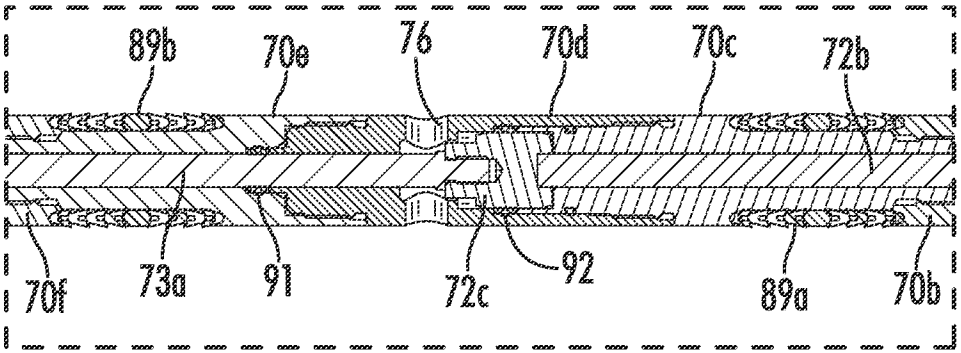
FIG. 10B is an enlarged cross-sectional view taken from FIG. 10 showing the middle portion of gas supply valve 53 in its actuated, open state.
Figure 9C:
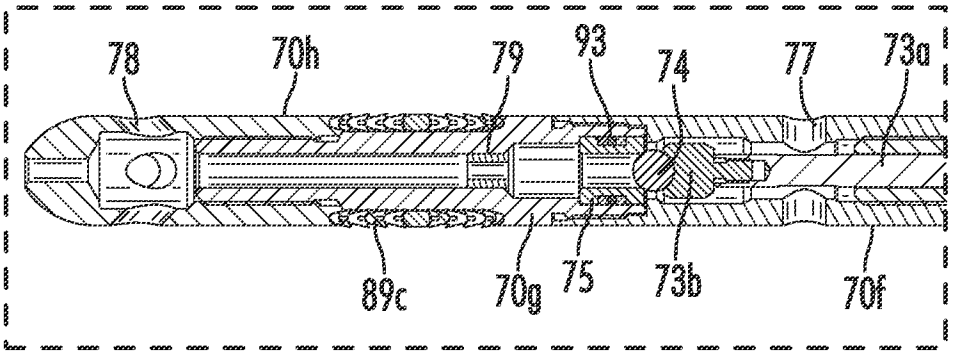
FIG. 9C is an enlarged cross-sectional view taken from FIG. 9 showing the lower portion of gas supply valve 53 in its normal, closed state.
Figure 10C:
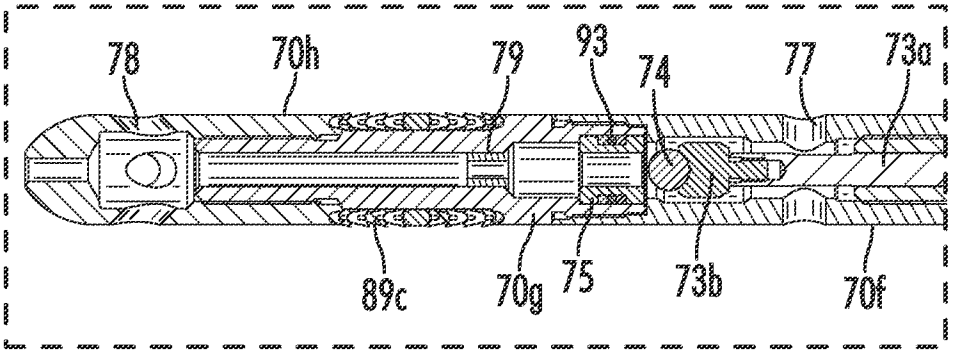
FIG. 10C is an enlarged cross-sectional view taken from FIG. 10 showing the lower portion of gas supply valve 53 in its actuated, open state.

A fourth preferred embodiment 340 of the novel gas pumps is shown schematically in FIG. 6. Gas pump 340 is similar to gas pump 240 except that it incorporates an above-tank packer 346 instead of below-tank packer 247. Packer 346 is installed above tank 248 and is provided with a circulation valve 357. Circulation valve 357 is mounted in a nipple in packer 346 and allows fluid communication through packer 346. When the system is installed, a dummy valve preferably will be installed in the nipple to allow packer 346 to isolate formation 2 from high gas lift pressure. Circulating valve 357 typically will not be installed until gas pump 340 is put into operation. It will be appreciated, of course, that circulation valve 357 may be installed in a pocket mandrel provided in production tube 31 similar to sump check valve 57 of gas pump 40.

It will be appreciated that the schematic representations of gas pump system 30 and gas pumps 40/140/240/340 have been simplified in many respects. Hydraulic systems will be required if a hydraulic control line is used. Accumulators may be incorporated into the hydraulic control system or in the high-pressure gas supply system. Control valves and panels will be installed to control the surface equipment. Likewise, the packers, valves, tubing, and other components of the illustrated systems typically will have various features that, for example, enable them to be installed or retrieved, but are not shown in the figures.

The novel systems may be assembled from conventional equipment. Field compressor 13, booster compressor 14, and gas switch 16, for example, are typical of equipment commonly employed in pneumatic systems for oil and gas wells. They typically will incorporate meters, sensors, controllers, and other auxiliary components that enable them to be operated automatically. Preferred gas supply and gas vent control valves are discussed in greater detail below. In general, however, the exemplified valves may be of conventional design.

Preferably, the novel gas pumps systems will be designed and operated so that a booster compressor may be operated substantially continuously and without recycling pressurized gas through the booster compressor. That is, the booster compressor capacity, the accumulating volume, the chamber size, gas lift pressure, annulus pressure, and chamber fill time will be coordinated to allow the booster compressor to run without substantial interruption and to discharge substantially all of its output in the accumulating volume of the system and, if utilized, the control line until lift gas is supplied to the gas pump.

For example, initial cycle times may be determined for gas pump 40. An estimate of the initial fill time of chamber 41 may be made based on the volume of chamber 41 and the flow rate into chamber 41. The flow rate may be estimated based on flowing bottomhole pressure, reservoir pressure, or various other well pressures according to conventional formulas. The length of the fill cycle preferably will be set initially according to such estimates.

The initial discharge cycle time preferably will be set to allow substantially all fluid from a filled chamber 41 to be displaced by gas pressure within the system without pumping gas through dip tube 42 and into production tube 31. That cycle time may be set according to a number of factors, including the hydrostatic head in production tube 31 above dip tube check valve 56, the ratio of the cross-sectional area of production tube 31 to chamber 41, the flow capacity of gas into and out of chamber 41 through the gas supply and vent systems, the lift pressure in the gas supply system at the beginning of the cycle, and the expansion volume within the system, including the volume of chamber 41. The depth of check valve 56 is known, and the density of fluid in production tube 31 may be estimated based on the gas-oil-water ratio of production at the surface. The diameters of production tube 31 and chamber 41 are known, as is the expansion volume with the system. The lift pressure may be set to provide longer or shorter discharge cycles, with higher lift pressures allowing for shorter discharge cycle times.

The pressure at the end of a discharge cycle will be at least equal to the pressure required to support the column of fluid in production tube 31 just above dip tube check valve 56. Preferably, it will be significantly higher in order to displace liquid more rapidly from chamber 41. Shorter discharge cycle times will allow the production capacity of gas pump 40 to be maximized. At the same time, the acquisition and operating costs of the pump may impose practical limitations on the level at which the lift pressure may be set. In general lift pressures will be set to displace fluid from chamber 41 as quickly as economically possible. Thus, an optimal lift pressure may change as the cost of providing the desired pressure increases.

An estimate may be made of the lift pressure required in the accumulating portion of the system at the beginning of a discharge cycle to displace substantially all liquid from a fully filled chamber 41 for a given discharge cycle length. The accumulating volume, that is, the volume of gas supply line 43 from gas supply valve 53 to booster compressor 14, including any surface accumulators, is known. The total volume of the system including chamber 41 is known. Temperature may be treated as substantially constant given the relatively small amount of expansion in the system during the discharge cycle and the heat present downhole. Corrections may be made to allow for the continued discharge of gas into gas supply line 43 during the discharge cycle and for diversion of gas into gas-over-hydraulic control line 45.

Once the lift pressure at the beginning of the discharge cycle and the pressure at the end of the discharge cycle have been determined, the amount (moles) of gas required to increase the pressure within the accumulating volume to the lift pressure may be estimated. That is, after gas pump 40 completes a discharge cycle, gas supply valve 53 will be shut and additional gas will be injected into the accumulating volume by booster compressor 14 until the pressure reaches the lift pressure. The amount of work required to inject that quantity of gas then may be estimated.

Once the amount of work required to bring the system up to lift pressure, the initial fill time of chamber 41, and the time required to displace fluid from chamber 41 at the lift pressure are known, the efficiency of booster compressor 14 preferably will be optimized. That is, conventional compressors such as booster compressor 14 are designed to run continuously. Intermittent operation tends to increase the likelihood of leakage around seals, wear in the seals, and overall power consumption. If a compressor is pumping more gas than is required, a portion of it will be recycled through the compressor in favor of shutting the compressor off. Thus, the power of booster compressor 14 preferably will be selected so that it can perform the required amount of work—and ideally no more—while chamber 41 is filling and discharging. By sizing booster compressor 14 such that it performs approximately the amount of work required, recycling of gas is minimized, and the overall efficiency of the system is maximized.

In summary, initial operation of gas pump system may be and preferably is optimized by setting the duration of the fill cycle to provide just enough time, and no more, for production fluids to fill chamber 41. Booster pump 14 will pump just enough gas into the accumulating volume during the fill and subsequent discharge cycles to provide the lift pressure required to push all liquid out of chamber 41 in the shortest practical period of time. Booster pump 14 will be run at a constant speed without recycling gas through the pump.

It will be recognized, of course, that relatively few conditions at the bottom of an oil and gas well are measured directly, and even fewer are measured directly in real time. Most conditions are inferred. Production quality and flow rates also change over time. Production rates, for example, can fluctuate, but tend to diminish over time. Chamber fill times will lengthen correspondingly. Thus, it is not possible to exactly optimize the power of a compressor, and what is optimal will change. It may be preferable to err of the side of under-sizing the compressor somewhat at initial installation and let the production rate fall to match the compressor.

Once the initial cycle times, lift pressures, and pump speeds are determined, however, the system preferably will be monitored to fine tune it to current conditions and adjust it as conditions change. The lift pressure and time required to displace liquid from chamber 41 may be estimated fairly accurately and will be relatively constant over the short term. Adjustments in the length of the fill cycle will be more common.

If the fill cycle time is too short for initial or changed conditions, chamber 41 will not be filled completely with liquid. Once all liquid in a partially filled chamber 41 has been displaced, a slug of injected gas will be pushed up production tube 31. Thus, gas produced through production tube 31 may be monitored and used to adjust the duration of the fill cycle. If the fill cycle is properly set, increasing its duration should have little or no effect on the amount of gas produced through production tube 31. Decreasing fill cycle time, however, should produce a noticeable increase in gas production.

For example, the initial fill cycle may be set somewhat higher than expected based on estimated flow rates into chamber 41. If the duration of the fill cycle is decreased and there is no increase in the amount of gas produced through tubing 31, that indicates that chamber 41 likely was being filled completely with liquid already. The duration of the fill cycle then can be further decreased until an increase in gas production is noticed. The fill cycle time then can be increased slightly to return gas production in tubing 31 to the observed baseline.

Displacement times also will vary as the gas-oil-water ratio of the fluid in production tube 31 changes. Thus, the production stream at the surface may be monitored to adjust the length of the discharge cycle. If the column lightens, reducing the hydrostatic head in production tube 31, the discharge cycle time may be shortened. If it becomes denser, the discharge cycle time may be lengthened.

Gas production through annulus 33 also may be monitored to assess whether the discharge cycle should be adjusted. If pump 40 is fully displacing fluid from chamber 41, gas production through annulus 33 should be relatively constant over the short term. A decrease in gas production through annulus 33 will indicate that discharge cycle times are too short and need to be lengthened. An increase in gas production will indicate that the discharge cycle time is too long, and that injected gas is flowing through chamber 41 after liquid has been displaced. Thus, for example, the discharge cycle time may be set for a relatively long duration, and then may be shortened until gas production through the annulus stabilizes.

To the extent adjustments are made to fill or discharge cycle times, the operation of booster pump 14 also will be adjusted. Either the speed of booster pump 14 or the amount of gas recycled through booster pump 14 will be adjusted so that it still pumps the desired amount of gas into the accumulation volume. Preferably, the speed of booster pump 14 will be adjusted as that will ensure that it is operating at optimal efficiency. Booster pump 14 will be slowed down if the total fill-displacement time is increased, or sped up it if has been decreased, so that the required amount of gas is still being pumped into the accumulation volume during the discharge and fill cycles without recycling gas through the pump.

Discharge cycle times generally will be significantly shorter than fill cycle times, especially as production from the well diminishes and fill cycle times must be increased. Thus, adjustments to discharge cycle times will require relatively smaller adjustments to booster pump 14 than will adjustments to the duration of the fill cycle. Moreover, at some point, production of liquids from the well may fall to levels where booster compressor 14 may be replaced with a lower power compressor more suitable for longer fill times.

It will be appreciated that the novel systems and gas pumps may offer significant advantages over the prior art. For example, they are amenable to a compact, efficient design that takes full advantage of the space provided in conventional production casings. That space can be quite limited. Wells tapping shale formations in the United States typically have small production casings, most commonly either 4.5 or 5.5" casing having internal "drifts" of, respectively, approximately 3.8 and 4.7". Production tubing preferably is as large as possible in order to maximize the rate of flow and to reduce friction-induced pressure gain. Gas pumps necessarily require installation of a gas supply line in the casing along with the production tubing. Many prior art systems also use two hydraulic lines to control the gas supply and gas vent valves. Those control lines are installed in the production casing as well.

In contrast, the novel gas pumps preferably rely on a single, common fluid control line. While separate control lines are common in the art and may be used if desired, using a single control line to actuate both the gas supply and the gas vent valves increases the space that may be devoted to the production tube. There also is one less line that potentially may be damaged during installation. A single control line also eliminates the need to sync pressure signals in separate control lines.

As discussed in further detail below, preferred embodiments also incorporate separate control valves that preferably are mounted one above the other. Prior art control valves typically have incorporated a supply flow path and a vent flow path in the same housing. Such dual-valve designs tend to have a relatively large cross section and can occupy a large part of the casing drift. That relatively large cross section also limits their ability to be retrievably installed through the production tubing. By using separate "stacked" valves, space within the production casing is further conserved.

Embodiments of the novel gas pumps, such as gas pumps 240 and 340, may have a tank that provides a chamber for the pump. Preferably, however, the novel gas pumps provide a pump chamber by installing a top and bottom packer in the annulus between the dip tube and casing. The packers maximize use of the space within the production casing. Larger chambers allow for more pumping capacity with fewer cycles, thus extending the service life of cycling components in the system. Moreover, as compared to a tank of the same volume, using a pair of packers provides a shorter, wider chamber. That minimizes the hydrostatic head resisting flow of oil into the chamber and, given the same lift pressure, minimizes the time required to pump fluid out of the chamber. Cycle times will be reduced correspondingly, thereby increasing pumping capacity. The length of a large tank also may make it more difficult to install, especially in horizontal wells. Conventional packers may be used to provide a chamber, however, and may be run into a well easily.

Most importantly, preferred embodiments of the novel gas pump systems can provide a "life of the well" solution. They may be installed early in the life of a well, when hydrostatic pressure in the formation is still relatively high, and may be operated until a gas pump is the only viable gas lift option. Novel system 30, for example, may be used to provide continuous gas lift by installing gas lift valves 51. Intermittent gas lift may be commenced later in the life of the well by installing dip tube check valve 56. Gas lift valves 51 may be suitable for intermittent injection, or they may be replaced with intermittent gas lift valves 52. In the latter stages of the well's production, gas pump 40 can be readied for operation by installing gas supply valve 53, gas vent valve 54, chamber check valve 55, and sump check valve 57, along with booster compressor 14 and, if needed, a hydraulic pump. Importantly, all those transitions may be accomplished without a rig workover operation.

Conventional gas lift systems may allow for a transition from continuous lift to intermittent gas lift. If an operator wishes to continue production with a gas pump, however, the well must be worked over. That is, the production tubing and other continuous and intermittent lift equipment must be pulled from the well in order to install a gas pump. Workover operations are relatively costly and time consuming. A service rig must be brought to the site to pull the tubing and reinstall it. Moreover, valves in prior art systems may not be retrievable, or may have to be retrieved by pulling gas supply lines.

In contrast, preferred embodiments allow access to all essential or preferred valves for the system and gas pumps through the production tubing. System 30, for example, incorporates pocket mandrels 32. Continuous gas injection valves 51 and intermittent gas injection valves 52, as discussed further below, may be installed by tools run into production tube 31 on a slickline. Gas supply valve 53, gas vent valve 54, sump check valve 57, and control line shut-off valve 58 may be installed in pocket mandrels 32 in a similar fashion. Moreover, by installing uphole valves 51/52/53/54/57/58 in pocket mandrels 32, chamber check valve 55 and dip tube check valve 56 also may be installed and retrieved through production tube 31 using slickline tools. Dip tube 42 also may be perforated or a sliding sleeve therein may be opened by running tools through production tube 31.

The installation of valves in pocket mandrels is discussed further below. At this point, however, it will be appreciated that once the system is installed, it is not necessary to pull production tubing or any other lines in order to transition from continuous gas lift to intermittent gas lift and then to gas pump lift. Moreover, repair and replacement of worn valves does not require pulling any tubing or lines. All of that may be accomplished by slickline operations, thus providing a single "life of the well" gas lift production system.

It will be appreciated, of course, that an operator may not necessarily chose to utilize all those lift systems. System 30 generally will be used to provide continuous gas lift. Intermittent gas lift, as noted, can be relatively inefficient due to fallback of liquid through the gas bubble. An operator may decide to skip intermittent lift and switch to gas pump lift once continuous lift is no longer practical. It is believed that the efficiencies provided by embodiments of the novel gas pumps may make that the preferred option is a greater number of wells. Moreover, should an operator wish to improve efficiency of an intermittent lift stage by utilizing a plunger lift, system 30 will be able to accommodate the installation of bumpers, plungers, and other required equipment without pulling the production tubing. If plunger lift is utilized, dummy plugs preferably are installed in the pocket mandrels. Dummy plugs can help minimize loss of gas as the plunger passes through a pocket mandrel and help minimize the risk that a plunger will become stuck in the mandrel.

First Preferred Control Valve—Gas Supply Valve

The novel gas pumps and systems, in general, may incorporate conventional gas pump control valves. Preferably, however, they will incorporate preferred embodiments of the novel gas control valves, such as gas supply valve 53 and gas vent valve 54.

First preferred embodiment 53 of the novel downhole gas control valves is shown in greater detail in FIGS. 3-10. Valve 53 is a gas supply valve. As may be seen therein, it generally comprises a housing 70, a stack of Belleville washers 71, a piston assembly 72, a stem assembly 73, a valve body 74, and a valve seat 75. Washer stack 71, piston assembly 72, stem assembly 73, and valve body 74, as described further below, are operationally coupled such that injection valve 53 is normally closed by a biasing force generated by washer stack 71 and may be opened by applying control fluid pressure to piston assembly 72.

Valve housing 70 provides the base on and in which the other valve components are assembled. It has a generally open, elongated cylindrical shape. As exemplified, housing 70 is approximately 1" in diameter and has a length of about 18". Other embodiments typically will be no more than 2" in diameter and 60" in length, but may have larger dimensions. In general, it is preferable that the size be minimized while still allowing for the required flow rates and other operational requirements of the valve. That shape and those dimensions allow valve 53 to be run through and installed in production tube 31 easily while minimizing any constriction it may present once installed. The outer circumference of housing 70 is profiled, as is its inner circumference to allow the other valve components to be mounted on and in housing 70. As described further below, housing 70 also provides various chambers and flow paths into which control fluid may be introduced and through which gas may flow.

Preferably, as shown, housing 70 is assembled from eight subs **70*a* to 70*h*, for example, by threaded connections. Multiple subs 70*a* to 70*h* simplify the manufacture of housing 70 and facilitate installation of the other valve components. Housing 70** may be assembled from more or fewer subs, however, if desired.

Piston assembly 72 extends axially through housing subs **70*b* to 70*d* and generally comprises a washer post 72*a*, a piston rod 72*b*, and a piston head 72*c*. Piston head 72*c* is mounted for reciprocating axial movement in a piston cylinder defined by housing subs 70*c* and 70*d*. Piston seals 92 are mounted between piston head 72*c* and the inner wall of the piston cylinder, for example, in a gland formed by the lower end of housing sub 70*c* and a facing shoulder in housing sub 70*d*. Piston seals 92** may be selected from conventional pressure seals and packings, such as a packing having two sets of outward facing, elastomeric cup seals separated by a hard backup ring.

Piston rod **72*b* is coupled at its lower end to the upper (low pressure) side of piston head 72*a*. It extends upward through a passage in housing sub 70*c* and into a cylindrically shaped chamber defined by housing sub 70*b*. A disc-like, enlarged outer diameter portion is provided near the upper end of piston rod 72*b*. The upper end of piston rod 72*b* is is connected, for example, by threaded connections, to washer post 72*a* which extends upward through most of the chamber in housing sub 70*b***.

Washer stack 71 bears on the upper end of piston assembly 72 and extends axially upward from piston assembly 72 through housing sub **70*b*. It comprises a plurality of Belleville washers 71*a*. Washers 71*a* preferably are loaded around washer post 72*a* in the chamber defined by housing sub 70*b*. Clearance is provided so that washers 71*a* can shift within housing 70*b* as they are compressed and as they relax. Preferably, as shown, washer stack 71*a* also comprises a washer blank 71*b*. When it is assembled to housing sub 70*b*, uppermost housing sub 70*a* will bear on washer blank 71*b* to partially compress washers 71*a*. The lowermost washer 71*a* bears on an annular upper surface of the disc on piston rod 72***b*, thus generating a load on piston assembly 72 that will bias it toward a normal, downward position in which valve 53 is closed.

Stem assembly 73 is coupled to the lower end of piston assembly 72 and extends axially downward through housing subs 70*d*, 70*e*, and 70*f*. It generally comprises a stem rod 73*a* and a valve body capture 73*b*. Stem rod 73*a* is connected at its upper end to the lower side (pressure face) of piston head 72*c*. It extends axially downward from piston head 72*c* through housing sub 70*d*, housing sub 70*e*, and into a chamber defined by housing sub 70*f*. Stem seals 91 are mounted between stem rod 73*a* and the inner wall of housing 70, for example in a gland formed by the lower end of housing sub 70*d* and a facing shoulder in housing sub 70*e*. Stem seals 91 may be selected from conventional pressure seals and packings, such as the packings used for piston seals 92. Valve body capture 73*b* is coupled to the lower end of stem rod 73*a*.

Valve body 74 preferably, as shown, is a ball adapted to seat upon and seal against valve seat 75. The lower face of capture 73*b*, therefore, is provided with a generally hemispherical recess into which valve body 74 is mounted. Valve seat 75 is a relatively short, generally open cylindrically shaped body or sleeve. It is mounted in an enlarged inner diameter portion at the upper portion of housing sub 70*g*. Seat seals 93, such as conventional elastomeric seals and packings, preferably are provided between valve seat 75 and housing sub 70*g*. The upper end of valve seat 75 is beveled to provide an upward-facing seal surface upon which ball 74 will bear.

Both ball 74 and valve seat 75, therefore, may be easily replaced when worn. If desired, however, valve stem assembly 73 may be provided with an integral valve body, and an integral valve seat may be provided, for example, in housing sub 70*g*. Likewise, the valve body and seat may have different, conventional geometries, notwithstanding that valve body 74 may be referred to herein as a "ball."

Valve housing 70 and valve seat 75 provide a gas flow path through valve 53. More specifically, housing sub 70*f* is provided with ports 77 extending radially through its wall and defines a gas supply chamber. When ball 74 is unseated from valve seat 75, gas can enter valve 53 through inlet ports 77, and then flow axially through the supply chamber, through valve seat 75, through an axial passage in housing sub 70*g*, and out gas outlet ports 78 provided in housing sub 70*h*. Preferably, as shown, a choke 79 is provided in the gas flow path, for example, below valve seat 75 in the passage in housing sub 70*g*. Choke 79 preferably is removably mounted in the passage, for example, by threaded connections so that chokes of different sizes may be used with otherwise identical valves 53. The volume of gas flowing through valve 53, therefore, may be easily optimized.

Stem seals 91 and piston seals 92 define a control fluid actuating chamber within housing sub 70*d*. They isolate pressure within the actuating chamber from the gas flowpath and other portions of valve 53. Control fluid may be introduced into the actuating chamber to generate pressure against piston head 72*c*. The biasing force of washer stack 71 in valve 53 will be adjusted according to the fluid pressure in control line 45. More specifically, it will be set somewhat higher than the pressure created by the fluid column in control line 45, but somewhat lower than the pressure signal that will be generated at the surface.

Thus, gas supply valve 53 may be operated by sending pressure signals to increase or lower fluid pressure in the actuating chamber. When fluid pressure in the actuation chamber is lower than the biasing force of washer stack 71, washer stack 71 biases piston assembly 72 in its normal, closed position. Stem assembly 73 is extended and ball 74 is held against valve seat 75. Flow through valve seat 75 and valve 53 is shut off.

Valve 53 may be opened, however, by sending a pressure signal through control line 45. Control fluid flows into valve 53 via radially extending control fluid ports 76 provided in housing sub 70*f*. Fluid pressure in the actuation chamber exceeds the biasing force of washer stack 71. Piston assembly 72 is urged upward against washer stack 71. As piston assembly 72 travels upward, it compresses washer stack 71 and pulls stem assembly 73 upward and ball 74 off valve seat 75. The upper end of the piston cylinder in housing sub 70*c* provides a stop, limiting travel of piston assembly 72. Gas can flow from annulus 33 into valve 53 through inlet ports 77, through valve seat 75, and out valve 53 through outlet ports 78. Valve 53 may be closed again by bleeding pressure out of control line 45. Washer stack 71 will expand and push piston assembly 72 downward and ball 74 back onto valve seat 75.

It also will be appreciated that washers 71*a* compress, and that piston assembly 72, stem assembly 73, and ball 74 reciprocate along the primary axis of housing 70. They are all in alignment. Thus, valve 53 may be provided with a compact, cylindrical shape suitable for use in downhole systems. It may be installed easily and minimally constricts flow through production tube 31. Wear in valve 53 is reduced and its service life will be extended by restricting movement along a single axis.

Preferably, as shown, uppermost housing sub 70*a* is provided with an equalization port 94 to relieve pressure that may build up during operation of valve 53. Pressure in the actuation chamber may be quite high. Any leakage of actuation fluid through piston seals will introduce fluid into the passages and chambers within housing subs 70*b* and 70*c*. If not evacuated, pressure can build within subs 70*b* and 70*c* and increase the force needed to actuate piston assembly 72. Thus, the disc-like end of piston rod 72*b* is provided with axial ports allowing leaked actuation fluid to flow into the chamber in housing sub 70*b*. From there leaked fluid can flow out of valve 53 through equalization port 94. A check valve (not shown) preferably is provided to allow actuation fluid to flow out equalization port 94, but to block the flow of gas or other fluids into valve 53 from annulus 33.

Second Preferred Control Valve—Gas Vent Control Valve

Figure 11A:
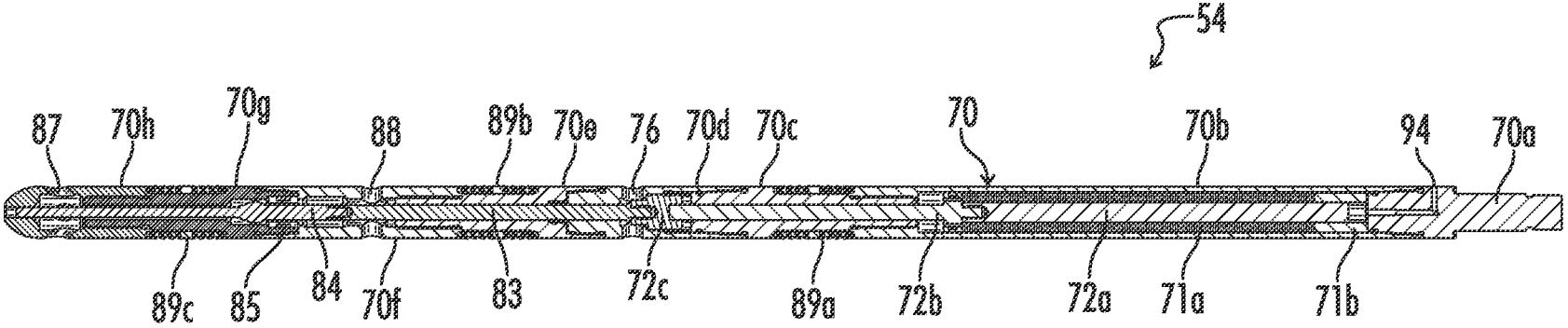
FIG. 11A is a longitudinal cross-sectional view of a second preferred embodiment of the novel hydraulic valves of the subject invention which is incorporated into gas pump 40, which valve 54 is used as a gas vent valve.
Figure 11B:
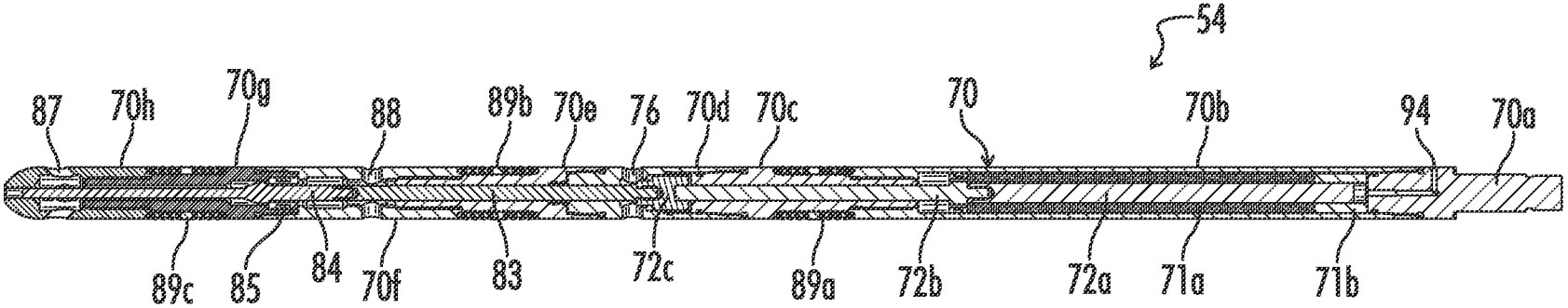
FIG. 11B is a longitudinal cross-sectional view of gas vent valve 54 in its actuated, closed state.

Second preferred embodiment 54 of the novel gas valves, as noted, may be used as a gas vent valve in, for example, in gas pump 40. It is shown in detail in FIG. 11. As shown therein, gas vent valve 54 is similar in many respects to gas supply valve 53 except that it is a normally-open valve.

Valve 54 generally comprises housing 70, washer stack 71, piston assembly 72, a valve stem 83, a valve body 84, and a seat 85. It also is provided with three external, annular seals 89. Thus, like valve 53 it may be easily and retrievably mounted in pocket mandrels 32 as described further below. Like gas supply valve 53, gas vent valve 54 may be actuated by sending pressure signals through control line 45 to compress washer stack 71. Valve 54 is shut, however, not opened as washer stack 71 is compressed. That arrangement allows gas supply valve 53 and gas vent valve 54 to be operated synchronously through a single control line 45.

More particularly, a downward-facing valve seat 85 is mounted in the upper portion of housing sub 70*g*. Valve body 84 is an elongated, cylindrical component having a radially enlarged portion in its upper midsection. The upper portion of valve body 84 extends from valve stem 83 through valve seat 85 such that the radially-enlarged portion is situated below valve seat 85. Valve body 84 may extend, as shown, into an axial passage at the end of housing sub 70*h*. That arrangement may help stabilize valve body 84 as it reciprocates within housing 70. Valve body 84 preferably is removably attached to valve stem 83 by, for example, threaded connections so that it may be replaced easily if worn.

Gas vent valve 54 is controlled by control line 45 as is gas supply valve 53 and is actuated in the same manner as gas supply valve 53 except that it is normally open. Washer stack 71 generates a biasing force that is transmitted through piston assembly 72 and stem to hold valve body 84 off valve seat 85. Thus, when fluid pressure is increased in control line 45 to open gas supply valve 153, fluid pressure also will be increased in the actuating chamber of gas vent valve 54. Washer stack 71 in gas vent valve 54 will be compressed. As it is compressed, it will pull valve body 84 upward. The radially-enlarged portion of valve body 84 will seat on valve seat 85. Gas vent valve 54 will be shut and gas pump 40 will be in its "fill" cycle.

When pressure is bled out of control line 45 to shut gas supply valve 53, pressure also will bleed out of the actuating chamber in gas vent valve 54. Washer stack 71 in gas vent valve 54 will relax and expand, pushing valve body 84 downward, pushing the radially-enlarged diameter portion of valve body 84 off seat 85. Valve 54 is returned to its normally-open state. Gas can flow into valve 54 through inlet ports 87 in housing sub 70*h*, through valve seat 85 in housing sub 70*g*, and out of valve 54 through outlet ports 88 in housing sub 70*f*. Pump 40 now will be in its "vent" cycle.

It will be appreciated, therefore, that gas supply valve 53 and gas vent valve 54 may be synchronously operated by sending a common signal down a common control line 45. Inefficiencies caused by premature or delayed opening or closing of one valve relative to the other are avoided. Preferably, valves 53/54 will be selected and the biasing force of their respective washer stacks 72 coordinated so that vent valve 54 closes before supply valve 54 opens to begin a discharge cycle and supply valve 54 closes before vent valve 53 opens to begin a vent cycle. Pressure inside chamber 41 will tend to ensure that sequence. Pressure within chamber 41 creates a pressure differential across valves 53/54 that makes it harder, other factors being equal, to open supply valve 54 to begin a discharge cycle and to open vent valve 53 to begin a vent cycle. Depending on such pressure differentials, and the hydraulic profiles within valves 53/54, however, the biasing force of washer stacks 71 of valves 53/54 may be increased or decreased to ensure that sequence.

Moreover, unlike other types of downhole gas control valves used in gas pumps or other gas lift systems, gas supply valve 53 and gas vent valve 54 also are well suited to actuation through hydraulic control lines. As noted, hydraulic control lines provide rapid, precise control over valves 53/54. There is very little delay between generation of a pressure signal at the surface and the response of valves 53/54. Many valves, however, are not suited for use with hydraulic control lines. They are not rated for the much higher fluid pressures created in hydraulic control lines. If nominally rated, they may have significantly reduced service lives. In contrast, washer stacks 71 in valves 53/54 can provide the much higher biasing forces required to offset the fluid pressure in hydraulic control lines, even when valves 53/54 are installed at great depth in a well.

It also has been found that valves 53/54 are surprisingly robust. Valves used to control the operation of gas pumps necessarily cycle many times during the life of a well. Notwithstanding the incorporation of dynamic seals 92 and 91 around, respectively, piston 72*c* and connecting rod 73*a*, valves 53/54 have operated reliably and without failure over tens of thousands of cycles, even under pressures as high as 6,000 psi. Thus, it is expected that they will have a long service life even when the gas pump is installed at depth.

The novel gas pumps, therefore, can allow for installation of gas pumps systems at much greater depth than has been typical. Prior art systems generally have relied on fluid activated valves and typically have been installed only up to about 2,000 feet. Embodiments of the novel gas pumps, however, may be suitable for installation at depths of greater than about 4,500 feet or even greater than 8,000 feet. Some embodiments may be installed as deep as about 10,000 feet.

The gas supply valve and gas vent valve may be connected directly to their corresponding supply, vent, and control lines. Similarly, they may be mounted on production tubing in any conventional manner. Preferably, however, gas supply and gas vent valves are adapted to be retrievably mounted on the production tubing, and preferably such that they may be installed, retrieved, and replaced through the production tubing. Preferred embodiments of the novel systems, therefore, incorporate pocket mandrels into the production tubing. The pocket mandrels have receptacles into which the valves may be installed.

Thus, as described generally above, gas supply valve 53, gas vent valve 54, sump check valve 57, and control line shut-off valve 58 preferably are mounted in pocket mandrels 32 that are assembled into production tube 31. Pocket mandrels 32 and installation of a gas supply valve 153 and gas vent valve 154 are described in detail below. Gas supply valve 53 and gas vent valve 54, and the other novel gas control valves, may be installed in a similar manner. Pocket mandrels 32 will allow gas to flow through, and control fluid to be introduced into valves 53 and 54. At the same time, pocket mandrels 32 allow gas supply valve 53, gas vent valve 54, and the other novel valves to be installed and replaced easily through production tube 31.

It also will be appreciated that gas supply valve 53 may be used readily in conventional continuous gas lift systems. Conventional gas injection systems typically incorporate valves which, like valves 51 illustrated schematically in FIG. 2D, are controlled by gas that is pumped into annulus 33. Valves 51 are normally closed. When the pressure of pumped gas, the "casing pressure," exceeds a certain level, valves 51 will open, allowing gas to flow into production tube 31. When the casing pressure drops below that level, valves 51 will close again.

Valve 53 and other embodiments of the novel gas supply valves also are normally-closed valves. While they are described herein as actuated by fluid pressure delivered to through control line 45, they may be installed in gas injection systems and actuated by casing pressure. Thus, gas supply valve 53, for example, may be used as a gas injection valve 51 in system 30. The biasing force of washer stack 71 will coordinated with the anticipated casing pressures required for continuous lift.

If used as a replacement for conventional, injection-pressure activated valves, the design of novel valve 53 preferably will be simplified. For such applications, the actuation chamber and gas supply chamber do not have to be isolated from each other. They may be combined. Separate control fluid ports and gas supply ports are not needed, and an external seal may be eliminated. The housing also may be assembled from fewer subs. The valve then will be actuated by the gas that ultimately is injected into the production tubing.

Gas injection systems that rely on injection-pressure activated valves, however, have significant shortcomings. Those issues are discussed in detail in applicant's pending patent application entitled "Downhole Gas Control Valve and Gas Lift Systems," Ser. No. 17/028,845, filed concurrently herewith. Thus, gas injection valves 51 preferably will be controlled by pressure signals transmitted through control fluid in a single common control line as disclosed therein. The control fluid may be pneumatic or gas-over-hydraulic. Especially when valve 53 will be used as gas injection valve 53, however, hydraulic fluid preferably will be used.

Moreover, control line 45 preferably will be connected to gas injection valves 51. Continuous gas injection valves 51, intermittent gas injection valves 52, gas supply valve 53, and gas vent valve 54, therefore, may all be controlled during different stages of the life of the well by pressure signals transmitted through a single, common control line 45. Especially given that gas supply valve 53 is suitable for use as a continuous and intermittent gas injection valve, maintenance of the system is further simplified.

Third Preferred Control Valve—Gas Supply Control Valve

Figure 12:
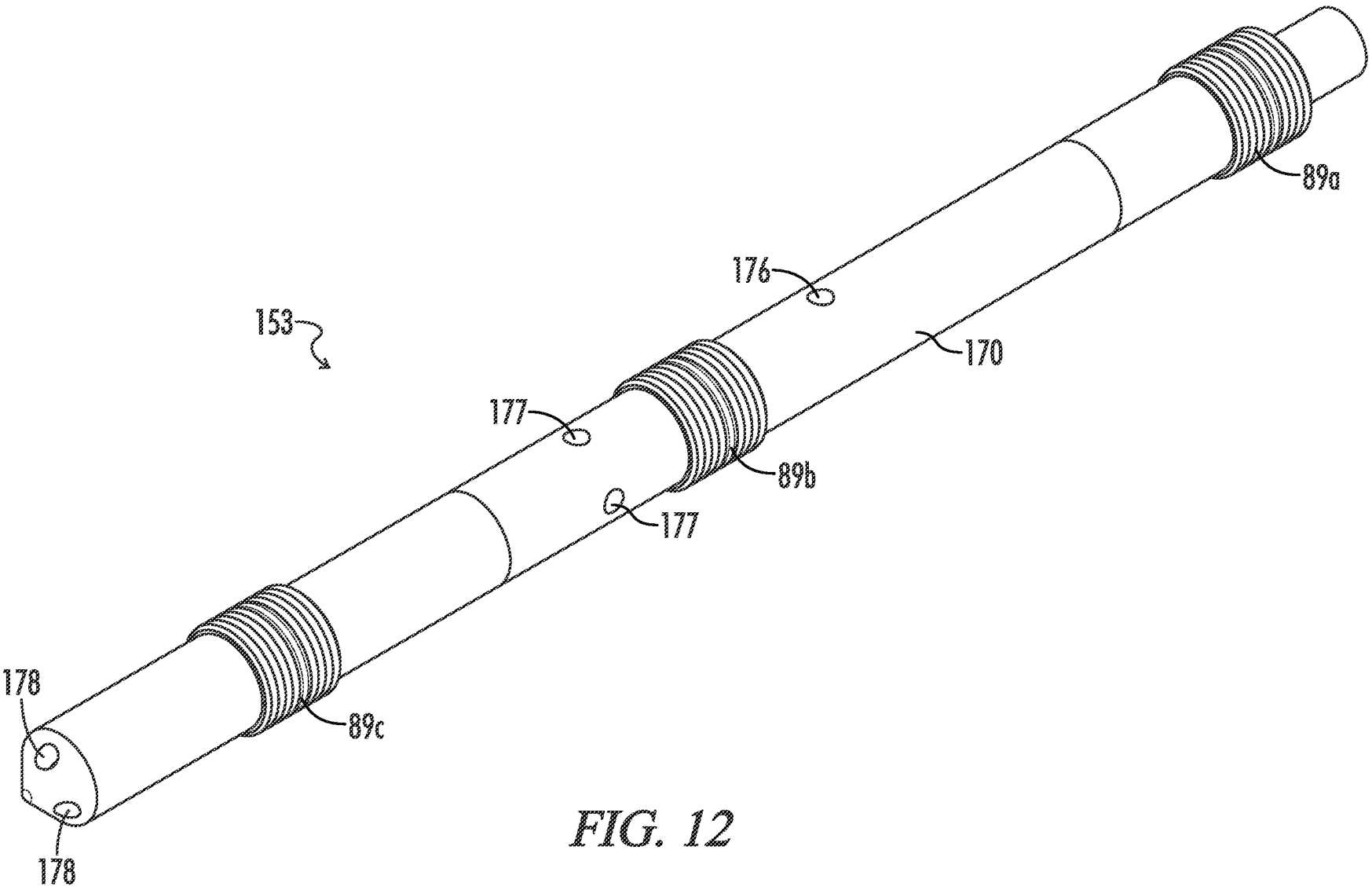
FIG. 12 is an isometric view of a third preferred embodiment 153 of the novel hydraulic valves of the subjection invention which is incorporated into gas pump 40, which valve 153 is used as a gas supply valve.
Figure 13:
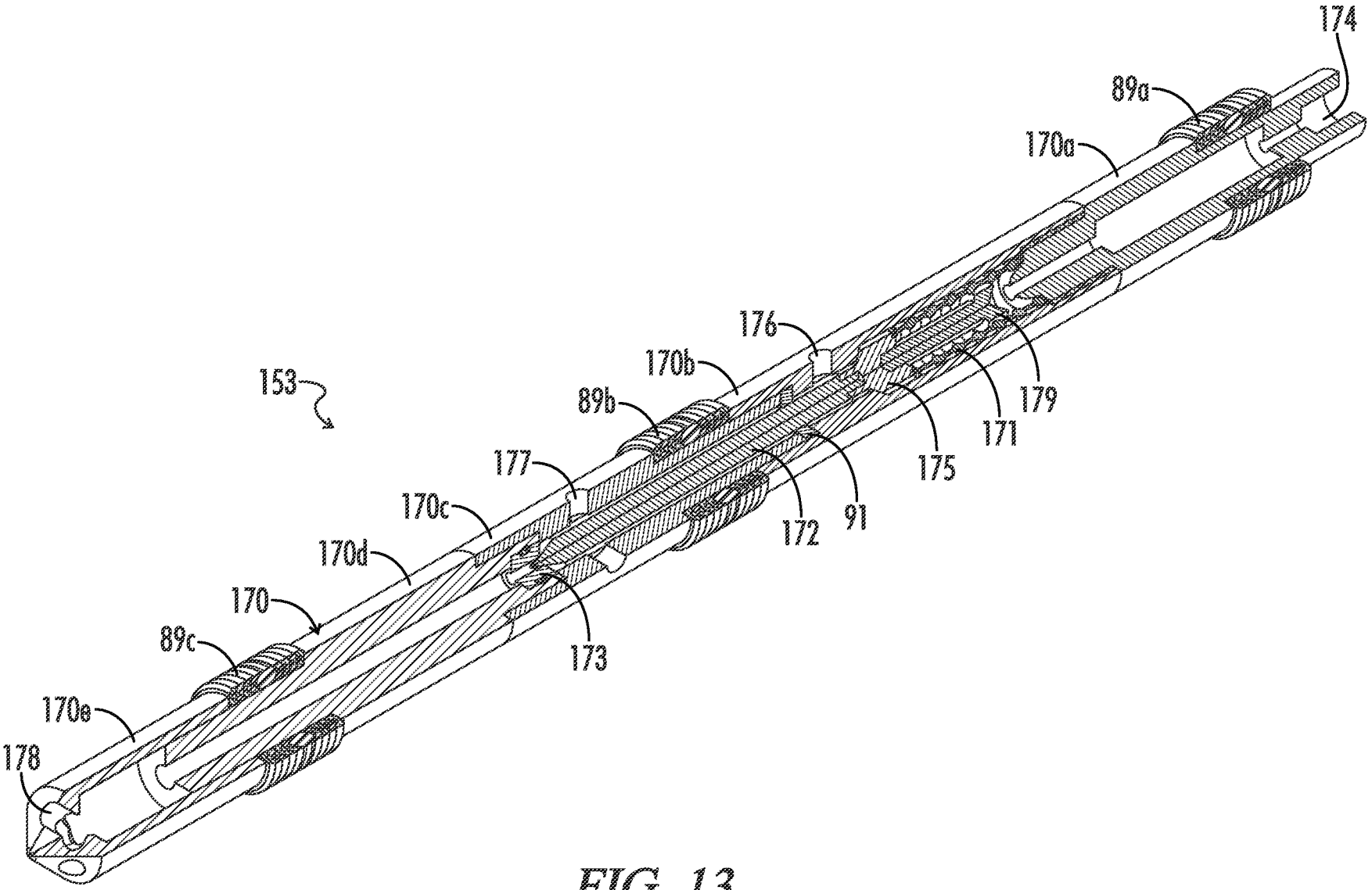
FIG. 13 is an isometric, quarter-sectional view of gas supply valve 153 shown in FIG. 12 showing gas supply valve 153 in its closed position.

A third preferred embodiment 153 of the novel gas valves is shown in detail in FIGS. 12-14. Valve 153 may be used a gas supply valve in, for example, gas pump 40. As shown therein, supply valve 153 generally comprises a housing 170, a bellows 171, a valve stem 172, and a valve seat 173. Valve housing 170 has a generally cylindrical shape and is assembled from five subs 170*a* to 170*e*, for example, by threaded connections. Upper housing sub 170*a* defines various chambers. The chambers may be filled with compressed gas, such as nitrogen gas, and sealed, for example, by a valved cap (not shown) threaded into a nitrogen port 174.

Bellows 171 is mounted to the lower end of first or upper housing sub 170*a*. It extends downward through a control fluid actuating chamber defined primarily by second housing sub 170*b*. The lower end of bellows 171 is closed by a bellows cap 175. The open upper end of bellows 171 is mounted around a passage in upper housing sub 170*a*. Thus, bellows 171 communicates with and is pressurized by gas within the sealed chamber in housing sub 170*a*. Preferably, bellows 171 will be partially filled with a silicon oil or the like to dampen the effects of sudden changes of pressure on bellows 171.

Valve stem 172 extends into the lower portion of the control fluid actuating chamber defined by housing sub 170*b* and is attached at its upper end to bellows 171 by bellows cap 175. The lower portion of valve stem 172 extends through the upper portion of a gas supply chamber defined primarily by housing subs 170*c*, 170*d*, and 170*e*. Seals 91, such as an annular elastomer packing, are provided around valve stem 172 to isolate the actuating chamber from the gas supply chamber. The tip of valve stem 172 provides a downward-facing valve body which seats on upward-facing valve seat 173. Valve seat 173 preferably, as shown, is provided on an insert which is carried, for example, within housing sub 170*d* so that it may be replaced when worn.

Figure 14A:
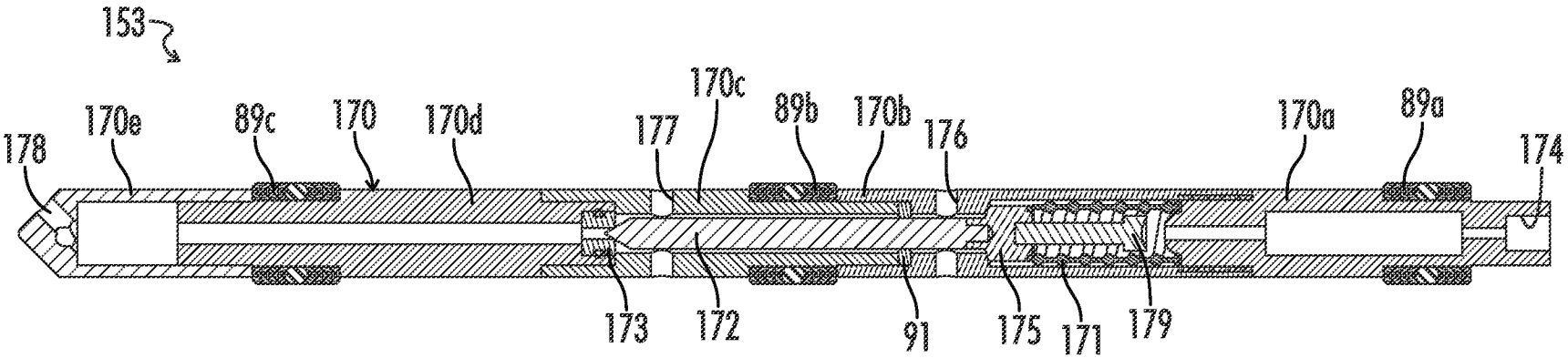
FIG. 14A is a lateral cross-sectional view of gas supply valve 153 in its closed position.

The dome pressure of valve 153, that is, the pressure within the sealed chamber defined by housing sub 170*a* will be adjusted according to the fluid pressure in control line 45. More specifically, it will be set somewhat higher than the pressure created by the fluid column in control line 45, but somewhat lower than the pressure signal that will be generated at the surface. Thus, gas supply valve 153 may be actuated by increasing and decreasing the control fluid pressure in the actuating chamber around bellows 171. When the fluid pressure is relatively low, bellows 171 is inflated. Valve stem 172 is extended such that its tip seats on valve seat 173 as shown in FIGS. 13 and 14A. Flow through valve seat 173 and the gas supply chamber within housing subs 170*c/d/e* is shut off.

Figure 14B:
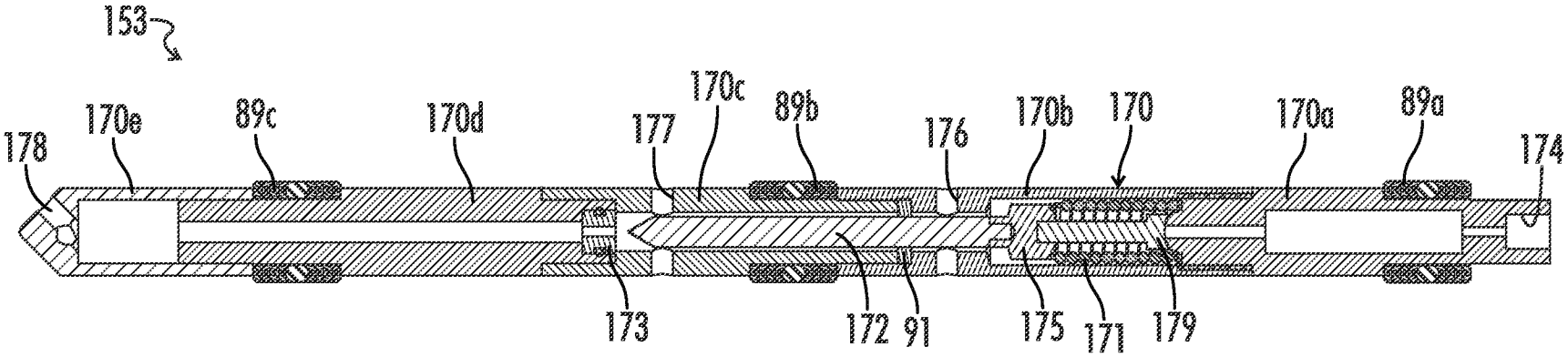
FIG. 14B is a lateral cross-sectional view of gas supply valve 153 in its open position.

Valve 153 may be opened, however, by sending a pressure signal through control line 45. Control fluid will be introduced into valve 153 via control fluid ports 176 provided in housing sub 170*b*. As pressure increases within the actuating chamber, bellows 171 will begin to collapse. As bellows 171 collapses, it pulls valve stem 172 upward and off valve seat 173 as shown in FIG. 14B. Valve stem 172 also may be spring-loaded to assist in pulling valve stem 172 off valve seat 173. A stop rod 179 connected to valve stem 172 via bellows cap 175 limits the collapse of bellows 171 to help avoid damage to bellows 171 if excessive pressure is introduced into valve 153. In any event, gas can flow into valve 153 through inlet ports 177, through valve seat 173, and out valve 153 through outlet ports 178. Valve 153 may be shut again by bleeding pressure out of control line 45. Since they are filled with compressed nitrogen, bellows 171 will expand again and push stem 172 back onto valve seat 173.

Fourth Preferred Control Valve—Gas Vent Control Valve

Figure 15:
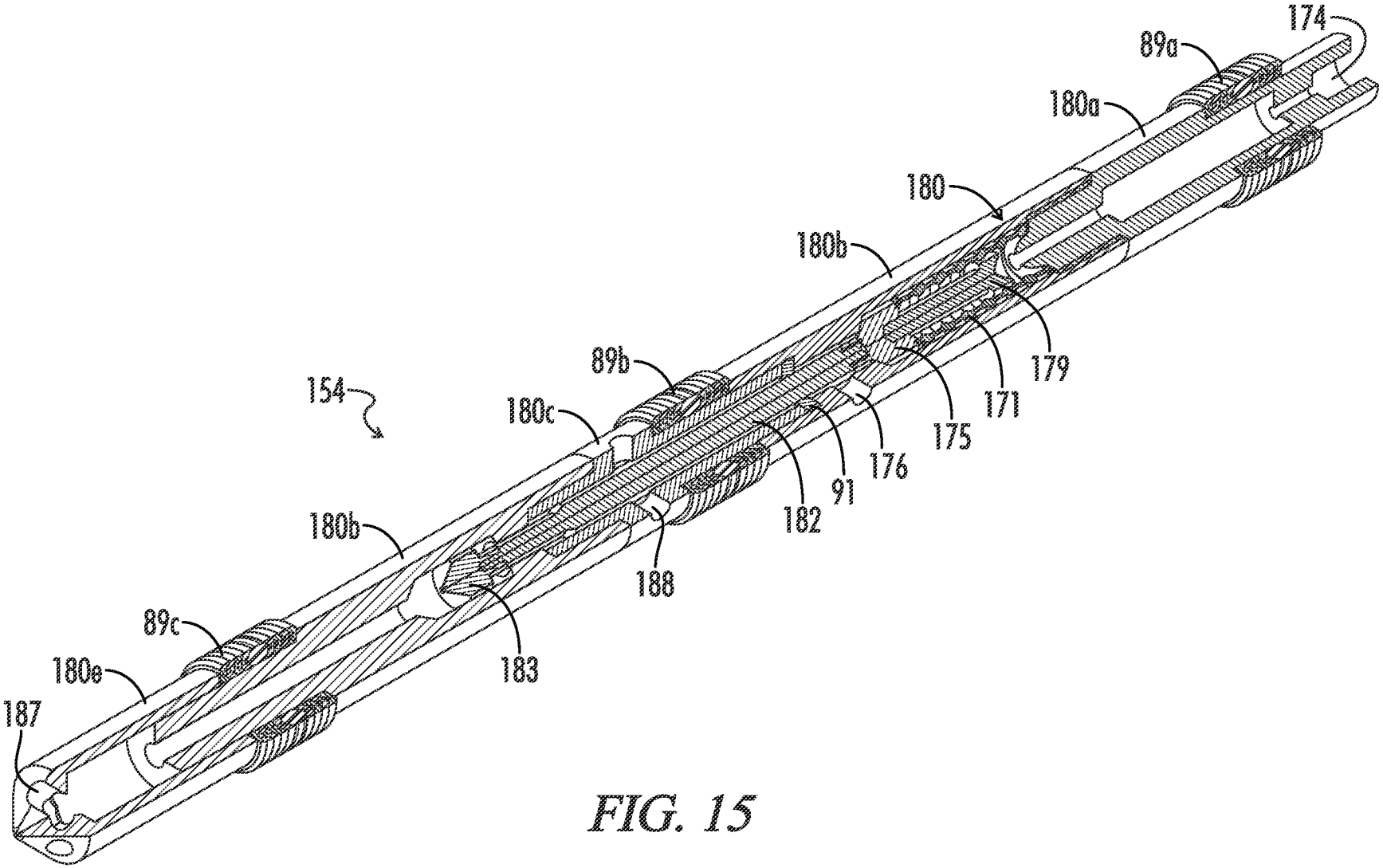
FIG. 15 is an isometric, quarter-sectional view of a fourth preferred embodiment 154 of the novel hydraulic valves of the subjection invention which is incorporated into gas pump 40, which valve 154 is used as a gas vent valve.
Figure 16A:
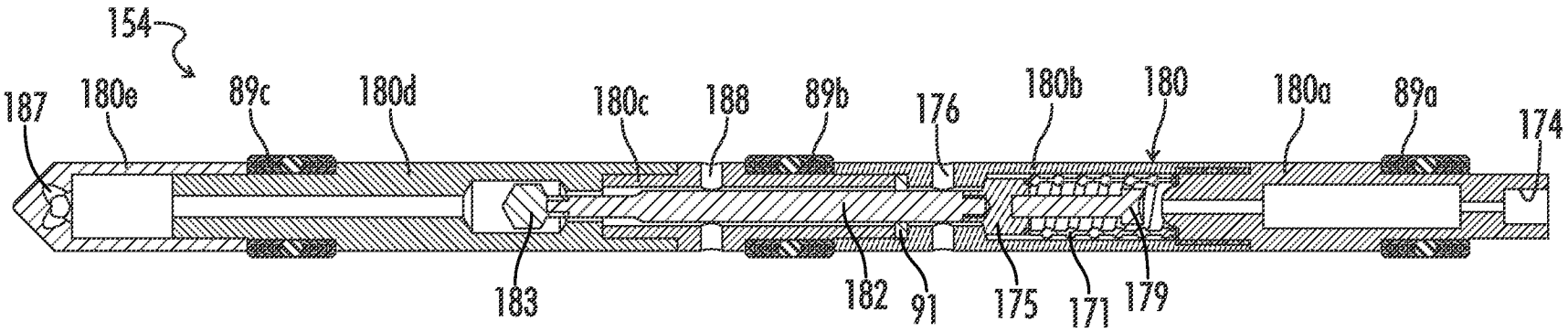
FIG. 16A is a lateral cross-sectional view of gas vent valve 154 in its open position.
Figure 16B:
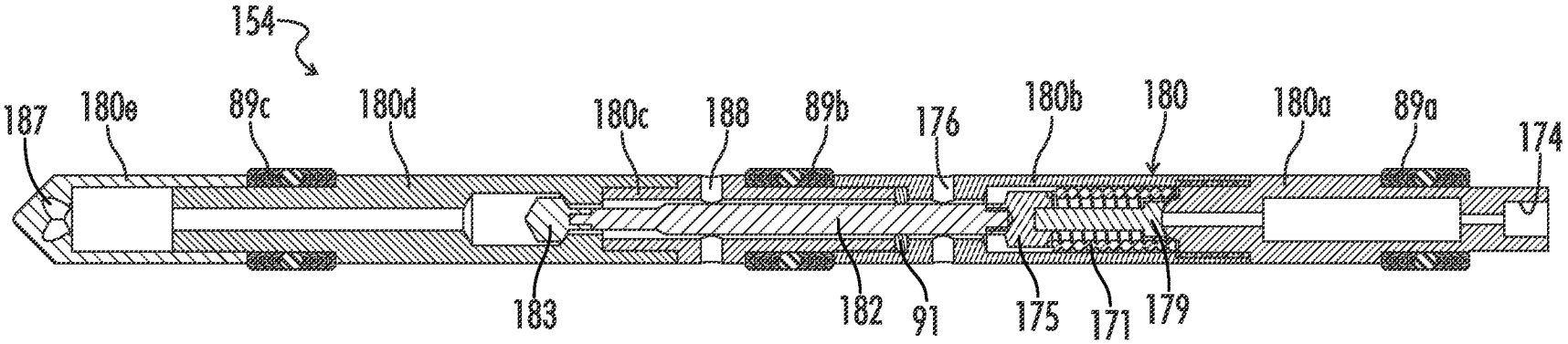
FIG. 16B is a lateral cross-sectional view of gas vent valve 154 in its closed position.

A fourth preferred embodiment 154 of the novel gas valves is shown in FIGS. 15-16. Valve 154 may be used a gas vent valve in, for example, gas pump 40. As may be seen in the figures, it is similar in many respects to supply valve 153. Gas vent valve 154 generally comprises a housing 180, bellows 171, a valve stem 182, and a valve body 183. Like supply valve 153, gas vent valve 154 may be actuated by sending pressure signals through control line 45 to expand or collapse bellows 171. It will be noted, however, that vent valve 154 is opened by expanding, not collapsing bellows 171. It is shut by collapsing bellows 171, not expanding it. That arrangement allows gas supply valve 153 and gas vent valve 154 to be operated synchronously through a single control line 45.

More particularly, a downward-facing valve seat is provided in the gas supply chamber of gas vent valve 154 by housing sub 180*d*. Valve stem 182 extends through a restriction in housing sub 180*d* and terminates in an upward-facing valve body 183. Preferably, as exemplified, valve body 183 is threaded or otherwise releasably coupled to valve stem 182 so that it may be replaced when worn.

Gas vent valve 154 is controlled by control line 45 as is gas supply valve 153. Thus, when fluid pressure is increased in control line 45 to open gas supply valve 153, fluid pressure also will be increased in the actuating chamber of gas vent valve 154. Bellows 171 of vent valve 154 will collapse. As it does, it will pull valve stem 182 up and seat valve body 183 on the valve seat in housing sub 170*d*. Gas vent valve 154 will be shut and gas pump 40 will be in its "fill" cycle. When pressure is bled out of control line 45 to shut gas supply valve 153, pressure also will bleed out of the actuating chamber in gas vent valve 154. Its bellows 171 will expand, pushing valve body 183 off the valve seat. Gas can flow into valve 154 through inlet ports 187, through the valve seat in housing sub 180*d*, and out of valve 154 through outlet ports 188 in housing sub 170*e*. Pump 40 now will be in its "vent" cycle.

It will be appreciated, therefore, that gas supply valve 153 and gas vent valve 154 may be synchronously operated by sending a common signal down a common control line 45. Inefficiencies caused by premature or delayed opening or closing of one valve relative to the other are avoided. Preferably, valves 153/154 will be selected and their dome pressures coordinated so that vent valve 154 closes before supply valve 154 opens to begin a discharge cycle and supply valve 154 closes before vent valve 153 opens to begin a vent cycle. Pressure inside chamber 41 will tend to ensure that sequence. Pressure within chamber 41 creates a pressure differential across valves 153/154 that makes it harder, other factors being equal, to open supply valve 154 to begin a discharge cycle and to open vent valve 153 to begin a vent cycle. Depending on such pressure differentials, and the control fluid profiles within valves 153/154, however, the pressure charge within bellows 171 of valves 153/154 may be increased or decreased to ensure that sequence.

It has been found that it is more challenging to utilize bellows-type downhole gas control valves, such as gas supply valve 153 and gas vent valve 154, in gas pumps that will be installed at greater depths. Bellows-type valves have the advantage of having one less set of pressure seals, seals that can potentially leak, than piston-type valves such a valves 53/54. They also generally will be shorter, and thus more easily manipulated in the production tubing. The primary difficulty, however, lies in designing and fabricating bellows-type valves that can accommodate the higher pressures associated with hydraulic control lines. When exposed to high pressure, even when fabricated from the most advanced materials, the bellows are relatively fragile.

Thus, especially as the depth at which they will be installed increases, it may be preferable to control valves 153/154 or other bellows-type valves through a pneumatic or a gas-over-hydraulic control line. The pressure head in gas-over-hydraulic, and especially pneumatic control lines is significantly less, especially for valves installed at greater depths. The valves will be less responsive, but can be expected to have longer service lives.

Overview of Installation of Gas Control Valves

Figure 20:
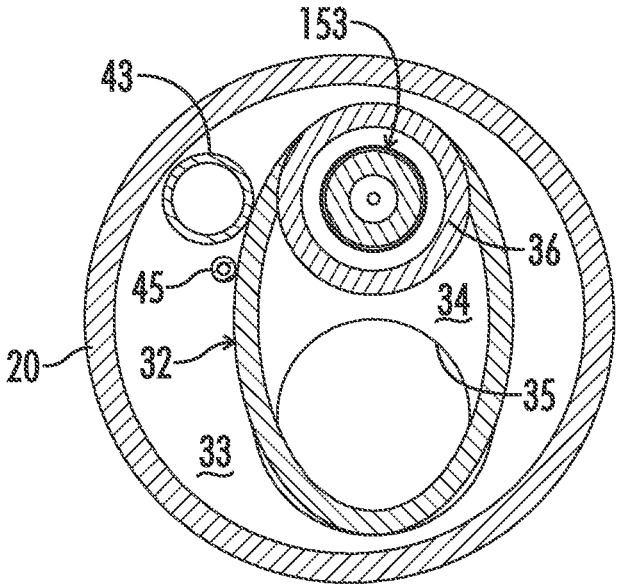
FIG. 20 is an axial cross-sectional view of gas supply valve 153 and pocket mandrel 32 taken generally along line 20-20 of FIG. 19.
Figure 21:
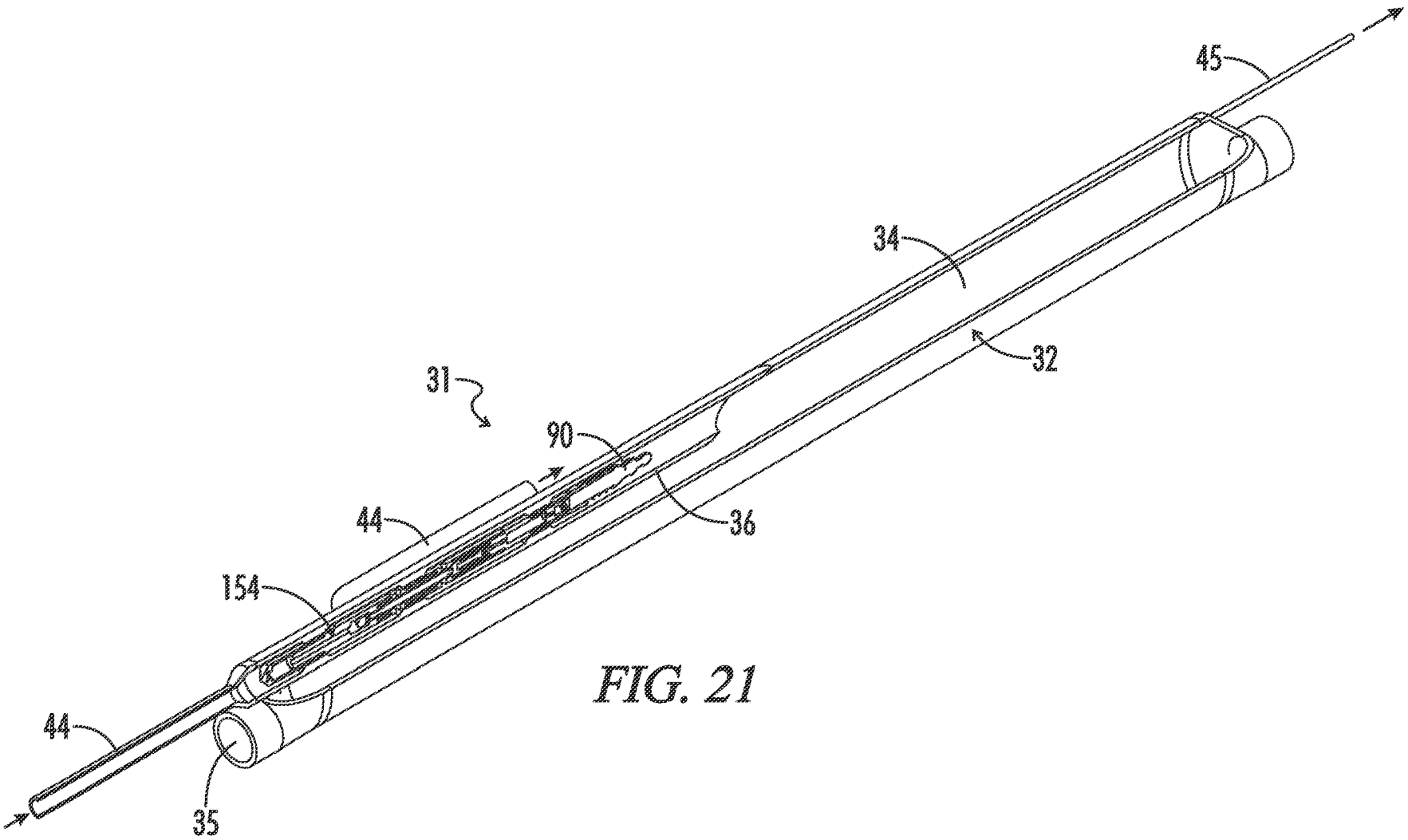
FIG. 21 is an isometric, quarter-sectional view of gas vent valve 154 installed in a pocket mandrel 32.
Figure 22:
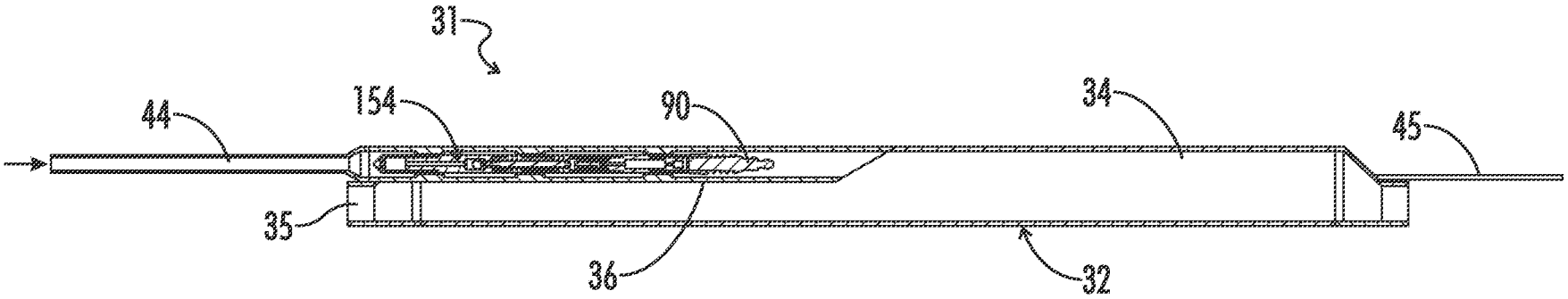
FIG. 22 is a lateral cross-sectional view of gas vent valve 154 and pocket mandrel shown in FIG. 20.
Figure 23:
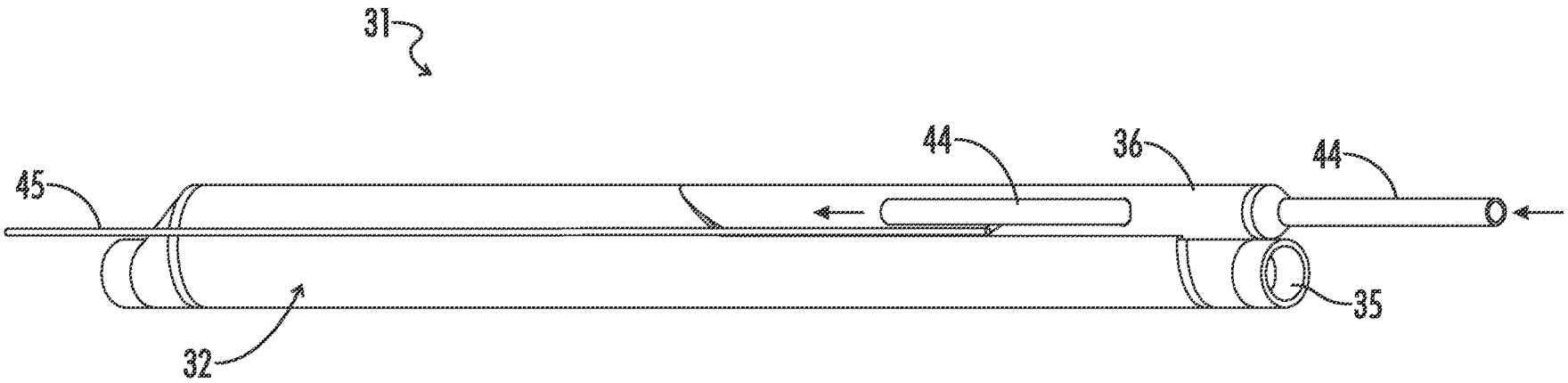
FIG. 23 is an isometric view of gas vent valve 154 and pocket mandrel 32 shown in FIGS. 21-22.

As noted, the gas supply valves, gas vent valves, and other valves of the novel lift systems and gas pumps preferably are mounted in pocket mandrels such as pocket mandrels 32 that allow them to be installed, retrieved, and replaced through the production tubing. Pocket mandrels 32 are shown in greater detail in FIGS. 17-23. FIGS. 17-20 show gas supply valve 153 mounted in a first pocket mandrel 32, and FIGS. 21-23 show gas vent valve 165 mounted in a second pocket mandrel 32. Valves 53 and 54 may be mounted in a similar fashion, as may be other preferred control valves.

As shown therein, pocket mandrels 32 are generally tubular, but have generally oval cross-sections. That cross-section creates a volume or pocket 34 outside the drift 35 of production tube 31 that can accommodate valves 153/154, seen best in the axial cross-section view of FIG. 20. By offsetting that volume or pocket outside the drift 35, passage through production tube 31 is unrestricted. More particularly, relatively short tubular receptacles 36 are provided in pockets 34. Valves 153/154 have an elongated, generally cylindrical shape. Their lower end, their "nose," is generally tapered to a point, allowing valves 153/154 to be more easily inserted into receptacles 36. Their upper end is adapted for coupling to a latch assembly 90. As discussed in greater detail below, latch assembly 90 will enable a slickline tool to attach to valves 153/154 so that they can be deployed and retrieved.

Figure 17:
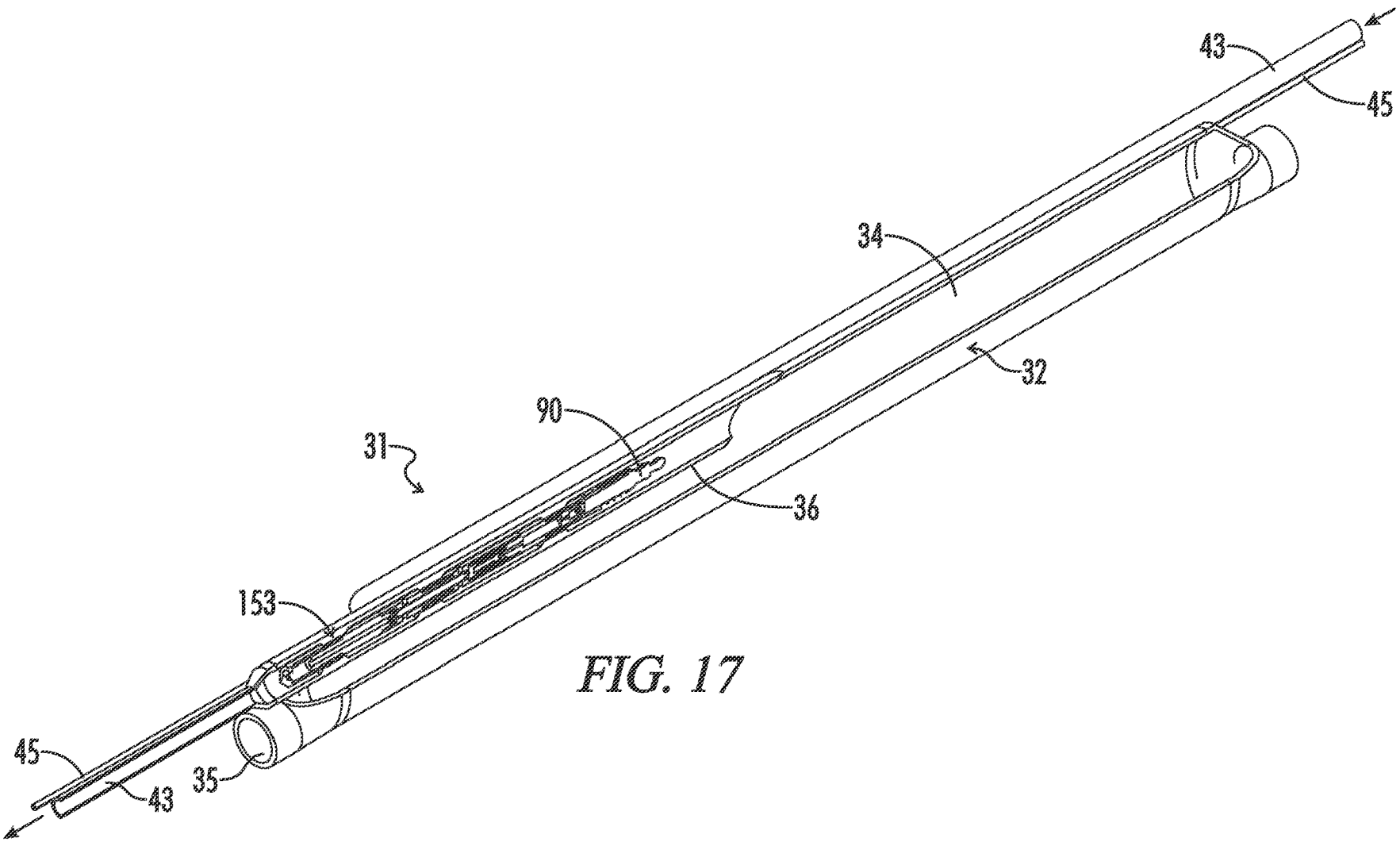
FIG. 17 is an isometric, quarter-sectional view of gas supply valve 153 installed in a pocket mandrel 32.
Figure 18:
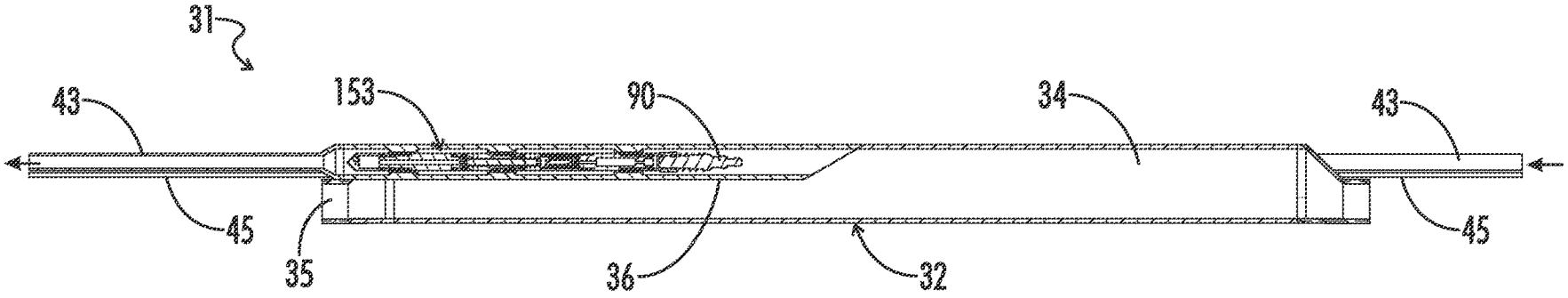
FIG. 18 is a lateral cross-sectional view of gas supply valve 153 and pocket mandrel 32 shown in FIG. 17.
Figure 19:
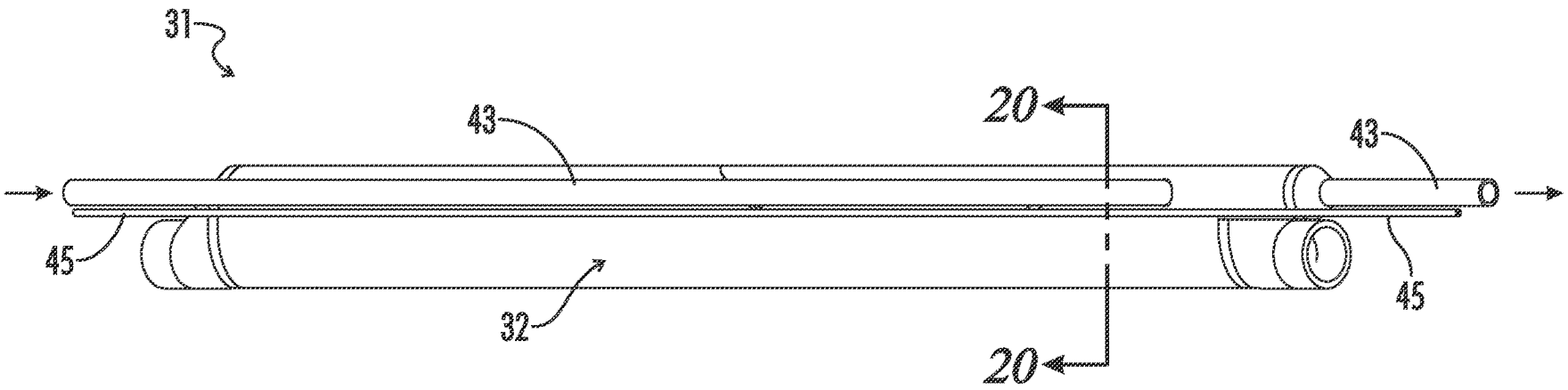
FIG. 19 is an isometric view of gas supply valve 153 and pocket mandrel 32 shown in FIGS. 17-18.

Referring to FIGS. 17-19, it will be appreciated that receptacle 36 has passages through its external walls in the vicinity of control fluid port 176 and gas inlet port 177 in gas supply valve 153. Receptacle 36 also has an open lower end. Inbound gas supply line 43 is connected to receptacle 36 at the passage proximate gas inlet port 177 and outbound gas supply line 43 is connected to the open end of receptacle 36 proximate gas outlet port 178. Control line 45 is connected to receptacle 36 at the passage proximate to control fluid port 176. Valve 153, as seen best in FIG. 12, has three annular seals 89 which are mounted on and extend around the outer diameter of housing 170. Annular seals 89 are elastomer seals that incorporate a hard backup ring in their midsection. Many such conventional seals are known and may be used.

In any event, annular seals 89 divide the annular space between the exterior surface of valve housing 170 and the inner surface of receptacle 36 into three sealed annular passages. The passages allow fluid communication between lines 43/45 and gas supply valve 153. More specifically, upper seal 89*a* and middle seal 89*b* create a sealed space through which control fluid from control line 45 may flow into valve 153 via ports 176, thus opening and closing valve 153. Middle seal 89*bc* and bottom seal 89*c* create a sealed space through which gas from inbound supply line 43 may flow into valve 153 via ports 177. Lower seal 89*c* creates a sealed space through which gas exiting ports 178 of valve 153 may flow into outbound supply line 43 leading to chamber 41.

Similarly, and referring to FIGS. 21-23, inbound vent line 44 is connected to the open lower end of receptacle 36 proximate gas inlet port 187 of gas vent valve 154. Outbound gas vent line 44 is connected to receptacle 36 at a passage proximate to gas outlet port 188, and control line 45 is connected to receptacle 36 at a passage proximate to control fluid port 176 of gas vent valve 154. Annular seals 89 on gas vent valve 154 provide similar sealed spaces for the flow of control fluid and vented gas into and through gas vent valve 154.

As noted above, when system 30 is first installed in casing 20, dummy valves 50 typically will be installed in receptacles 36 of mandrels 32. Dummy valves 50 may be solid metal blanks having more or less the same external configuration and dimensions as valves 53/153 and 54/154. Dummy valves 50 will be provided with external annular seals. Thus, when installed in receptacles 36, they will help prevent fluid and debris from entering gas supply line 43, gas vent line 44, and control line 45.

Gas supply valves 53/153 and gas vent valves 54/154 may be installed and retrieved with conventional tools deployed on a cable or "slickline" into production tube 31. A common wireline tool assembly may comprise a kickover tool, a jarring tool, and one or more roller tools for centering the tool assembly in production tube 31. Gas supply valve 53, for example, will be latched to an articulated arm on the kickover tool and folded into the kickover tool. The wireline tool assembly then will be deployed into production tube 31, typically under its own weight. Mandrel 32 will be provided with surfaces, slots, and the like which allow the kickover tool to be precisely located and oriented within mandrel 32. Once oriented, the kickover tool may be actuated to extend the articulated arm. The jarring tool then will be actuated to first bump valve 53 into receptacle 36 and then to release it from the kickover arm.

Retrieval of valve 53 may be accomplished generally by reversing those steps. It also will be appreciated that continuous gas injection valves 51, intermittent gas injection valves 52, and sump check valve 57 have similar external configurations and seals that allow them to be installed in suitably configured receptacles in their corresponding pocket mandrels 32. Likewise, shut-off valve 58 is similarly configured for installation and retrieval into and out of receptacles as discussed further below. Check valves 55/56 preferably will be adapted for installation into constrictions in dip tube 41. Typically, at least the lower portions of check valves 55/56 will have a generally cylindrical outer surface on which are provided one or more annular seals, allowing them to be inserted into their respective constrictions. Thus, all of those valves may be installed and retrieved by slickline tools similar to those used to install valves 153/154.

As discussed above, preferred embodiments can provide an extremely compact assembly for installation in a well. For example, FIG. 20 shows a cross-section, taken across the main axis, of pocket mandrel 32 inside casing 20. Pocket mandrel 32, as previously noted, has a generally oval cross-section. Receptacle 36 is nestled in one end of the oval, outside the drift D of production tube 31. Gas supply line 43 and valve control line 45 run along the minor width of pocket mandrel 32, and thus only minimally increase the outer drift of production tube 31. It will be appreciated that this design accommodates the valves and lines required for operation of the gas pump, yet still allows for installation of relatively large production tubing.

Fifth Preferred Gas Control Valve—Gas Supply Control Valve

Figure 24:
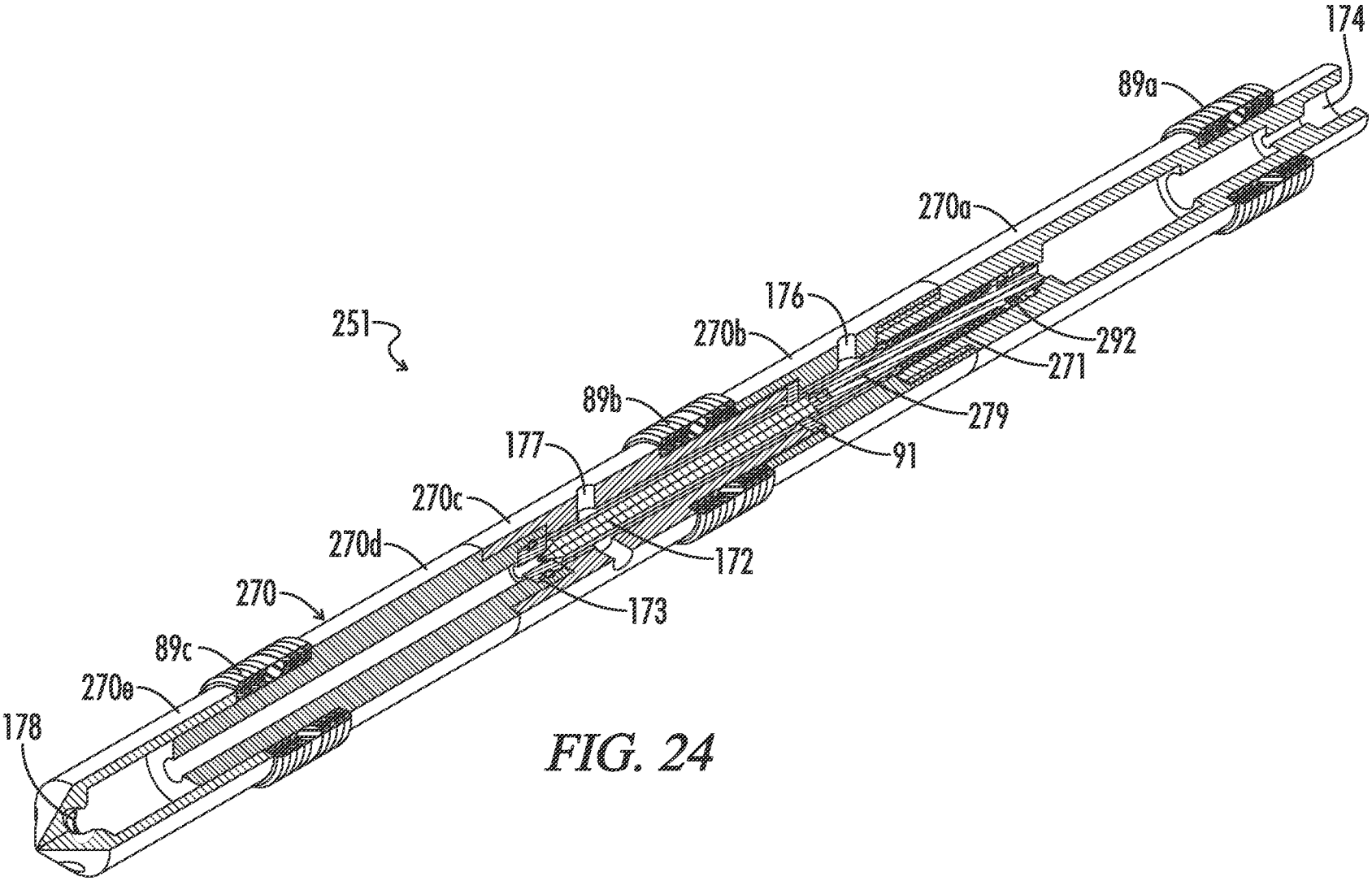
FIG. 24 is an isometric, quarter-sectional view of a fifth preferred embodiment 253 of the novel hydraulic valves of the subjection invention which may be incorporated into gas pump 40, which valve 253 is used as a gas supply valve and is shown in its closed position.

A fifth preferred embodiment 253 of the novel gas valves is shown in FIGS. 24-25. Valve 253 may be used a gas supply valve in, for example, gas pump 40. As shown therein, gas supply valve 253 generally comprises a housing 270, a bellows 271, a valve stem 172, a stem extension 279, and a valve seat 173. Supply valve 253 is similar to gas supply valve 153 except that bellows 271 is inverted as compared to bellows 171. Valve housing 270, like valve housing 170, is assembled from five subs 270*a* to 270*e*, but subs 270*a* and 270*b* have been modified to accommodate bellows 271.

Bellows 271 is mounted to the lower end of housing sub 270*a*. Housing sub 270*a* defines various sealed passages and chambers including a lower chamber. Bellows 271 extends upward into the lower sealed chamber of housing sub 270*a*. The upper end of bellows 271 is closed by an upper portion of stem extension 279. The open lower end of bellows 271 is mounted within the lower end of the lower chamber of housing sub 270*a*. The interior of bellows 271, therefore, is able to communicate with a control fluid actuating chamber defined primarily by housing sub 270*b*.

The lower sealed chamber of housing sub 270*a* may be filled with compressed gas introduced, for example, through a valved cap (not shown) threaded into port 174 defined by housing sub 270*a*. Preferably, however, the lower chamber will be filled with a silicon oil or other liquid to dampen the effects of sudden changes of pressure on bellows 271. Compressed gas may be provided in the upper chambers and passages within upper housing sub 270*a*.

The lower tip of valve stem 172 provides a downward-facing valve body that seats on upward-facing valve seat 173. The upper end of valve stem 172 extends into the actuating chamber defined by housing sub 270*b* and is attached to the lower end of stem extension 279. Valve stem extension 279 extends through the interior of bellows 271. Valve stem 172 is thus operably connected to bellows 271. It also will be noted that valve stem extension 279 extends past the point where it is affixed to bellows 271 and into a passage defined in upper housing sub 270*a*. The passage thus serves to guide the reciprocating motion of valve stem 172 and extension 279.

Figure 25A:
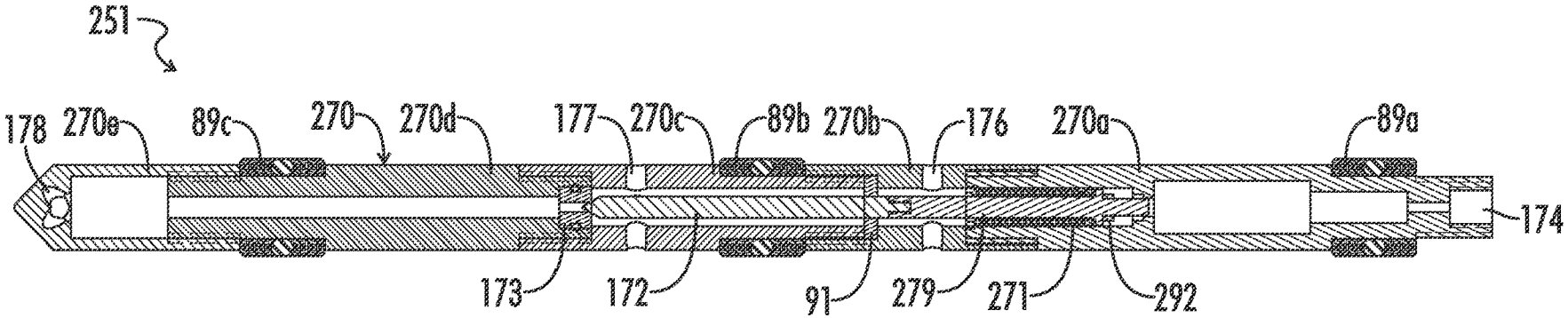
FIG. 25A is a lateral cross-sectional view of gas supply valve 253 in its closed position.

Like gas supply valve 153, gas supply valve 253 may be actuated by increasing and decreasing the control fluid pressure in the actuating chamber. When the fluid pressure is relatively low, bellows 271 is deflated by the pressure present in the lower chamber of housing sub 270*a*. Valve stem 172 is extended such that its tip seats on valve seat 173 as shown in FIGS. 24 and 25A. Flow through valve seat 173 and the gas supply chamber within housing subs 270*c/d/e* is shut off.

Figure 25B:
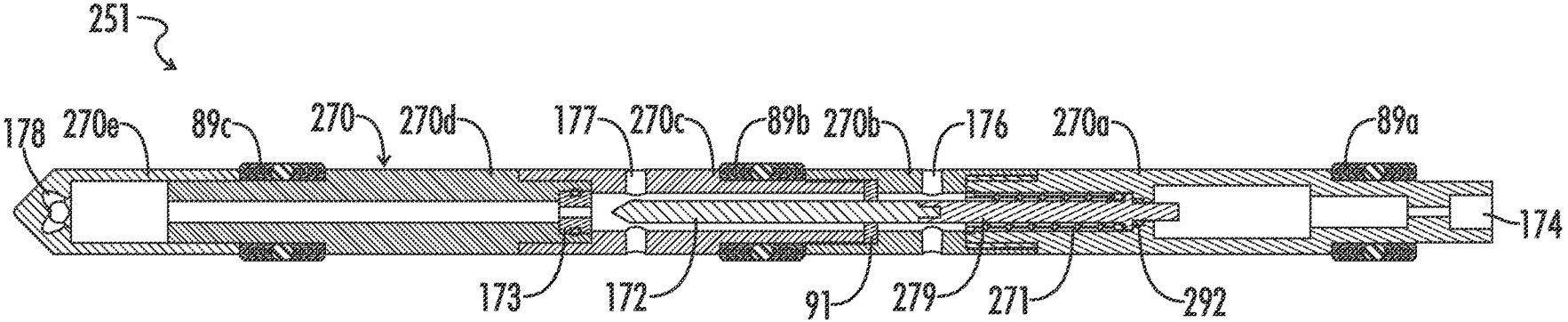
FIG. 25B is a lateral cross-sectional view of gas supply valve 253 in its open position.

Valve 253 may be opened, however, by sending a pressure signal through control line 45. Control fluid will be introduced into valve 253 via control fluid ports 176 provided in housing sub 270*b*. As pressure increases within the actuating chamber, bellows 271 will begin to expand. As bellows 271 expands, it pulls valve stem 172 upward and off valve seat 173 as shown in FIG. 25B. Valve stem 172 also may be spring-loaded to assist in pulling valve stem 172 off valve seat 173.

In any event, gas can flow into valve 253 through inlet ports 177, through valve seat 173, and out valve 253 through outlet ports 178. Valve 253 may be shut again by bleeding pressure out of control line 45. Since the lower chamber in housing sub 270*a* is pressurized by compressed nitrogen, bellows 271 will collapse again and push stem 172 back onto valve seat 173.

Pressure in control line 45 and in the actuating chamber of valve 253 is communicated to the interior of bellows 271. If that pressure is too high, it can essentially blow out bellows 271. Thus, the lower chamber within upper sub 270*a* preferably is filled with a liquid, such as silicon oil, and stem extension 279 preferably is provided with a bellows seal, such as bellows seal 192. Bellows seal 192 is carried around the upper end of stem extension 279. Once bellows 271 expands sufficiently such that valve stem 172 is pulled away from valve seat 173, bellows seal 192 will be carried up and will seal within the passage leading from the lower chamber of housing sub 270*a*. Flow from the lower chamber is shut off, but the lower chamber remains filled with an essentially incompressible fluid. Thus, further expansion of bellows 271 is substantially foreclosed.

Like gas supply valve 153, gas vent valve 154 may incorporate an inverted bellows design as exemplified by gas supply valve 253. Similar modifications may be made to allow an inverted bellows to actuate a gas vent valve in substantially the same fashion. For example, bellows 171 may be mounted within gas vent valve 154 by its lower end, for example, to housing sub 180*b*. In such designs, the inside of bellows 171 would be filled with hydraulic fluid and bellows 171 would extend through a pressurized chamber filled, for example, with pressurized nitrogen. The upper portion of valve stem 182 would extend through the interior of bellows 171 and attach to a cap at the upper end of bellows 171. Valve stem 182 thus could provide support for bellows 171 against excessively high pressures in the control fluid chamber.

Overview of Sixth Preferred Gas Control Valve—Gas Supply Control Valve

Figure 26:
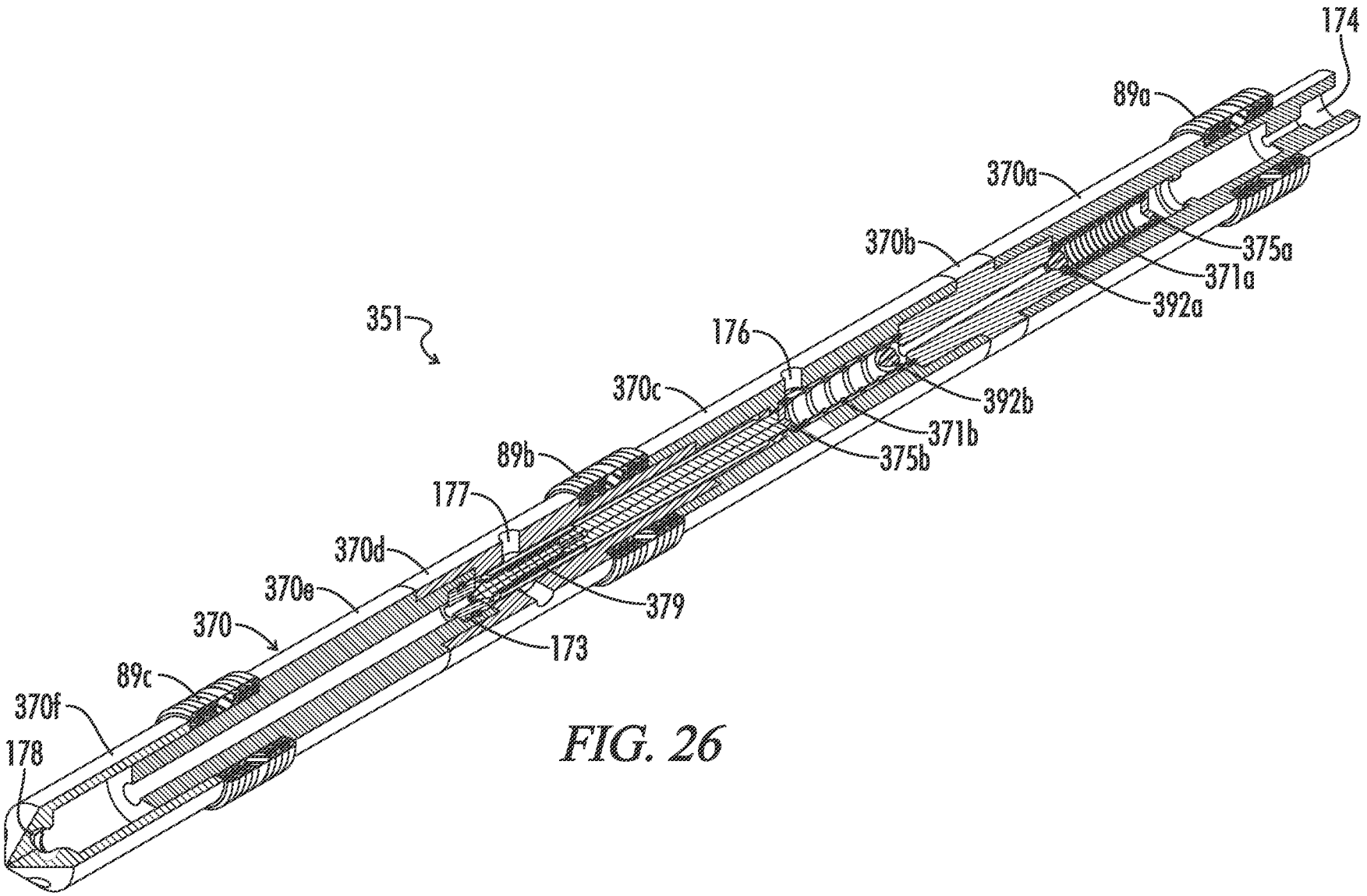
FIG. 26 is an isometric, quarter-sectional view of a sixth preferred embodiment 253 of the novel hydraulic valves of the subjection invention which may be incorporated into gas pump 40, which valve 253 is used as a gas supply valve and is shown in its closed position.
Figure 27A:
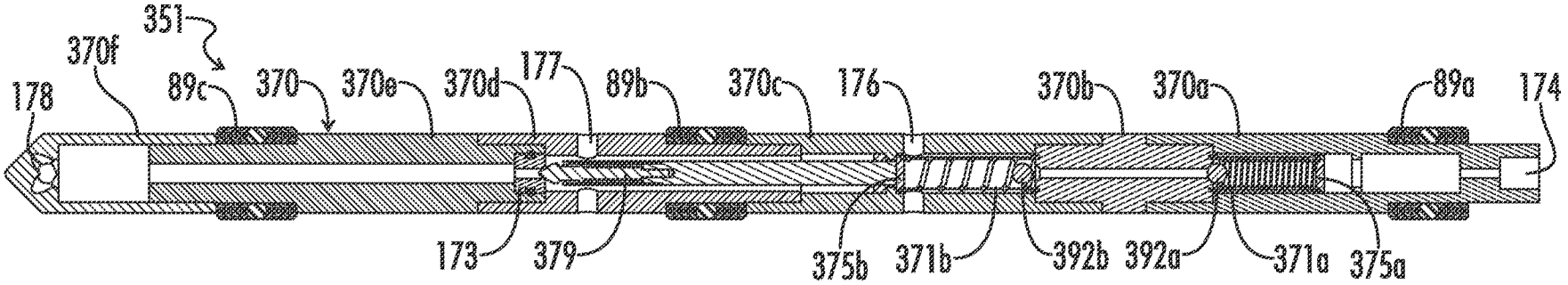
FIG. 27A is a lateral cross-sectional view of gas supply valve 353 in its closed position.
Figure 27B:
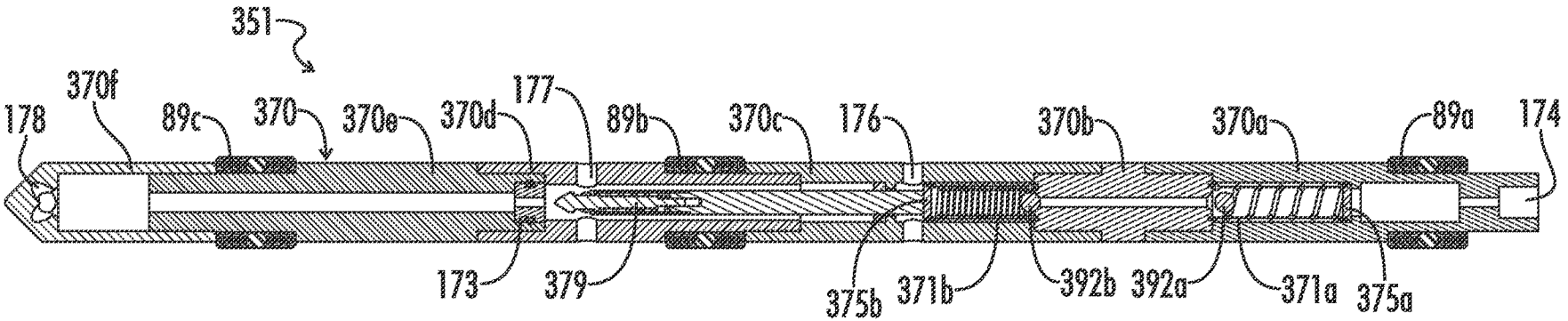
FIG. 27B is a lateral cross-sectional view of gas supply valve 353 in its open position.

A sixth preferred embodiment 353 of the novel gas control valves is shown in FIGS. 26-27. Valve 353 may be used as a gas supply valve in, for example, gas pump 40. As shown therein, gas supply valve 353 generally comprises a housing 370, a pair of cooperating bellows 371*a* and 371*b*, a valve stem 372, a spring-loaded stem tip 379, and a valve seat 173. Supply valve 353 is similar to gas supply valves 153 and 253 except that it utilizes a pair of cooperating bellows 371 instead of single bellows 171 and 271. Valve housing 370 is assembled from six subs 370*a* to 370*f*, for example, by threaded connections.

The lower end of upper bellows 371*a* is mounted to the upper end of housing sub 370*b* around a passage extending therethrough. The upper end of bellows 371*a* is closed by a bellows cap 375*a*. Bellows 371*a* extends upward into a lower sealed chamber defined primarily by housing sub 270*a*. The lower chamber of housing sub 370*a* may be filled with compressed gas introduced, for example, through a valved cap (not shown) threaded into port 174 defined by housing sub 370*a*. Preferably, however, the lower chamber will be filled with a silicon oil or other liquid to dampen the effects of sudden changes of pressure on bellows 371*a*. Compressed gas may be provided in the upper chambers and passages within upper housing sub 370*a*.

The upper end of lower bellows 371*b* is mounted to the lower end of housing sub 370*b* around the passage extending therethrough. The lower end of bellows 371*b* is closed by a bellows cap 375*b*. Bellows 371*b* extends downward into the control fluid actuating chamber defined by housing sub 370*c*. Both bellows 371 are filed with hydraulic fluid which can flow back and forth between bellows 371*a* and 371*b* through the passage in housing sub 370*b*.

Spring-loaded tip 379 of valve stem 372 provides a downward-facing valve body that seats on upward-facing valve seat 173. The upper end of valve stem 372 extends into the actuating chamber defined by housing sub 370*c* and is attached to the bellows cap 375*b* of lower bellows 371*b*.

Thus, gas supply valve 353 may be actuated by increasing and decreasing the fluid pressure in the actuating chamber. When the fluid pressure is relatively low, the pressure present in the lower chamber of housing sub 370*a* pushes fluid from upper bellows 371*a*, through the passage in housing sub 370*b*, and into lower bellows 371*b*. Upper bellows 371*a* collapses, lower bellows 371*b* expands, and valve stem 372 extends such that its tip 379 seats on valve seat 173 as shown in FIGS. 26 and 37A. Flow through valve seat 173 and the gas supply chamber within housing subs 370*c/d/e/f* is shut off.

Valve 353 may be opened, however, by sending a pressure signal through control line 45. Control fluid will be introduced into valve 353 via control fluid ports 176 provided in housing sub 370*c*. As pressure increases within the actuating chamber, fluid is pushed from lower bellows 371*b*, through the passage in housing sub 370*b*, and into upper bellows 371*a*. Lower bellows 371*b* collapses, upper bellows 371*a* expands, and valve stem 372 begins to travel upward. The spring is under compression when tip 379 is seated on valve seat 173. Thus, the spring will urge valve stem 372 upward and assist in pulling stem tip 379 off valve seat 173.

In any event, gas can flow into valve 353 through inlet ports 177, through valve seat 173, and out valve 353 through outlet ports 178. Valve 353 may be shut again by bleeding pressure out of control line 45. Since the lower chamber in housing sub 370*a* is pressurized by compressed nitrogen, upper bellows 371*a* will collapse again, lower bellows 371*b* will expand again, and stem tip 379 will be urged again against valve seat 173.

Preferably, as shown, check valves 292*a* and 292*b* are provided, respectively, within upper bellows 371*a* and lower bellows 371*b* to help avoid damage to bellows 371. Check valves 292 will shut off flow through the passage in housing sub 370*b* once a bellows 371 has been fully collapsed. Once flow through the passage is shut, the essentially incompressible fluid within the collapsed bellows 371 prevents it from being imploded. It also prevents fluid from blowing up the expanded bellows 371.

Like gas supply valve 153, gas vent valve 154 may incorporate a pair of cooperating bellows as exemplified by gas supply valve 353. Similar modifications may be made to allow dual-bellows to actuate a gas vent valve in substantially the same fashion. It also will be appreciated that the novel gas supply and vent valves have been illustrated as opening and shutting, respectively, in response to an increase in pressure in the control line. The pressure increase causes the valve body to pull off the seat in the gas supply valves and to be pulled onto the seat in the gas vent valves. The designs, however, may be switched such that a pressure increase shuts the gas supply valves and opens the gas vent valves.

First Preferred Control Line Valve

As discussed above, the novel gas pump systems preferably comprise gas supply and gas vent valves that are retrievably mounted in the production tubing. During installation and replacement of the valves, however, the fluid connection between the valves and the control line necessarily is temporarily disrupted. That is not necessarily a serious issue if the control line is a gas or a hydraulic line, but it can be if it is gas-over-hydraulic.

For example, when gas supply valve 153 and gas vent valve 154 are installed in their respective pocket mandrels 32 and shown in FIGS. 17-23, annular seals 89*a* and 89*b* provide sealed annular spaces allowing fluid communication between control line 45 and valves 153/154. When valves 153/154 are removed, fluid from control line 45 may flow into receptacle 36 of pocket mandrels 32 and into production tube 31. Any fluid escaping from control line 45 must be replaced before operations can continue. If control line 45 is filled with gas or hydraulic fluid, fluid can be replaced with some inconvenience, perhaps tolerable extra effort and time. If gas-over-hydraulic, however, the plug of hydraulic fluid at the bottom of control line 45 may easily flow out into production tube 31, but may require considerable time to refill.

Thus, the pocket mandrels in the production tubing of the novel systems preferably are provided with a poppet valve to control flow of control fluid from the control line into the pocket mandrel receptacle and ultimately to the gas control valves mounted therein. Suitable pocket mandrels with a poppet valve are disclosed in applicant's pending patent application entitled "Downhole Gas Control Valve and Gas Lift Systems," Ser. No. 17/028,845, filed concurrently herewith. They may be assembled into production tube 31 and dummy valves 50 and valves 51, 52, 53, and 54 installed therein substantially as described in respect to pocket mandrels 32.

Figure 28:
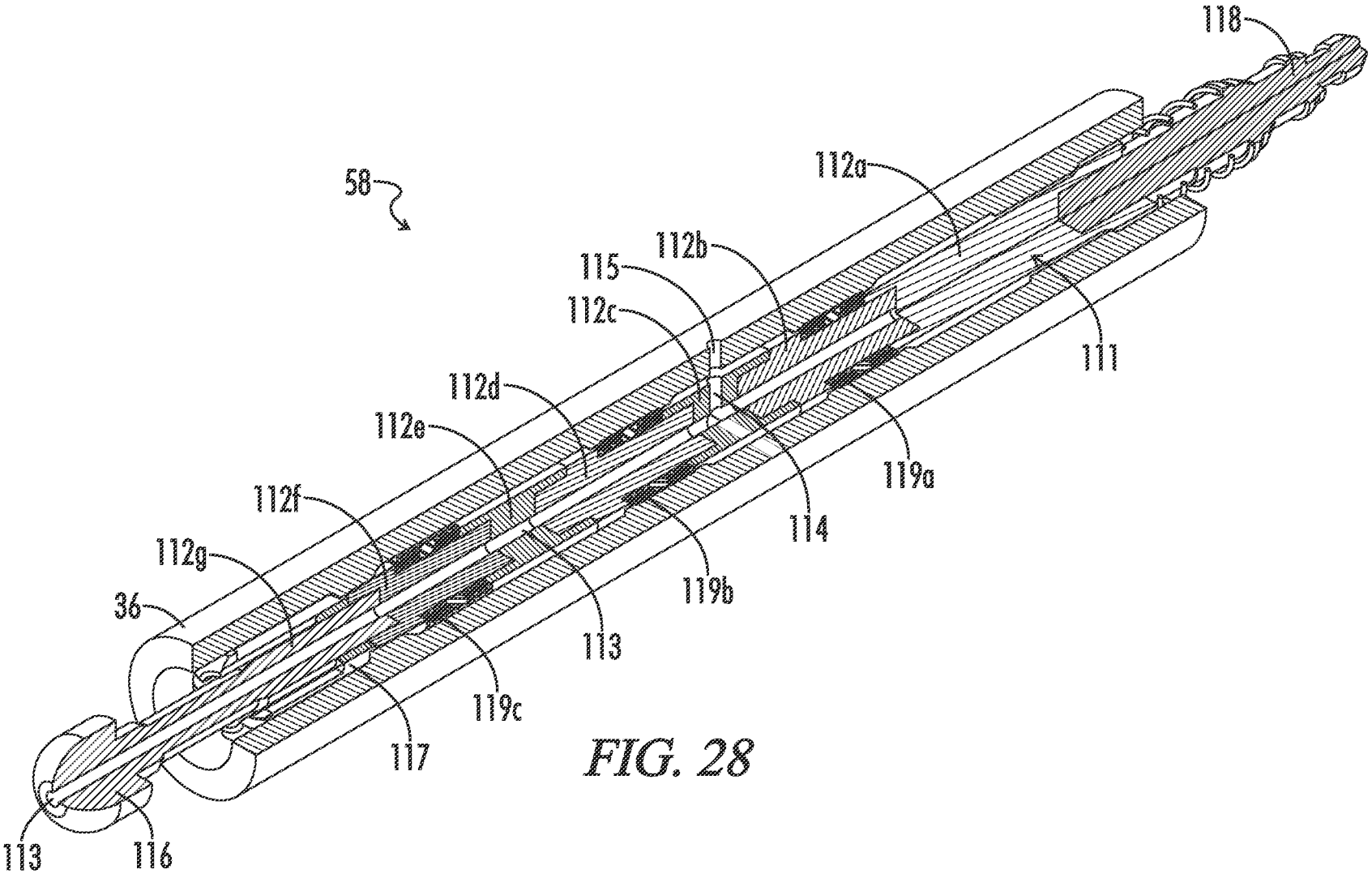
FIG. 28 is an isometric, quarter-sectional view of a first preferred embodiment 58 of the novel control line shut-off valves of the subjection invention which may be incorporated into gas pump 40, which shut-off valve 58 is shown in its open position.

Alternately, preferred embodiments of the novel gas pump systems may comprise a down-hole valve for shutting off flow in control line 45, such as shut-off valve 58 shown in FIGS. 2C to 2F and in greater detail in FIGS. 28-29. Shut-off valve 58 is a reciprocating, spool-type valve generally comprising a spool 111 that, when installed, utilizes a receptacle 36 of a pocket mandrel 32 as a valve housing.

That is, spool 111 has a generally cylindrical body 112 that is assembled from seven subs 112*a* to 112*g*, for example, by threaded connections. A central passage 113 extends axially through spool subs 112*b*-112*g*. A transverse passage 114 extends across spool sub 112*b* and intersects with central passage 113. Three annular seals 119 are mounted on and extend around the outer diameter of spool body 112.

The upper end of spool 111 is attached to a latch assembly 118, allowing it to be connected to and manipulated by a wireline tool. The lower end of spool 111 is provided with an assembly enabling it to be installed in receptacle 36 and, as described below, limiting its travel within receptacle 36.

Specifically, spool sub 112*g* generally has a reduced diameter relative to the rest of body 112, but terminates in an enlarged tip 116. A collet 117 is carried around the reduced diameter portion of spool sub 112*g*. During installation, tip 116 of spool sub 112*g* is able to pass through a restriction in a lower portion of receptacle 36. Collet 117 is initially caught by the restriction, but as spool 111 continues to travel downward into receptacle 36, the lower end of spool sub 112*f* will bear on collet 117. The fingers on collet 117 are compressed inward and expand again once they pass through the restriction. Once expanded, the fingers on collet 117 prevent both collet 117 and tip 116 of spool sub 112*g* from passing back through the restriction.

Receptacle 36 is provided with an inlet port 115 to which control line 45 (not shown) may be connected. A continuation of control line 45 (not shown) will be attached to the open, lower end of receptacle 36.

Figure 29A:
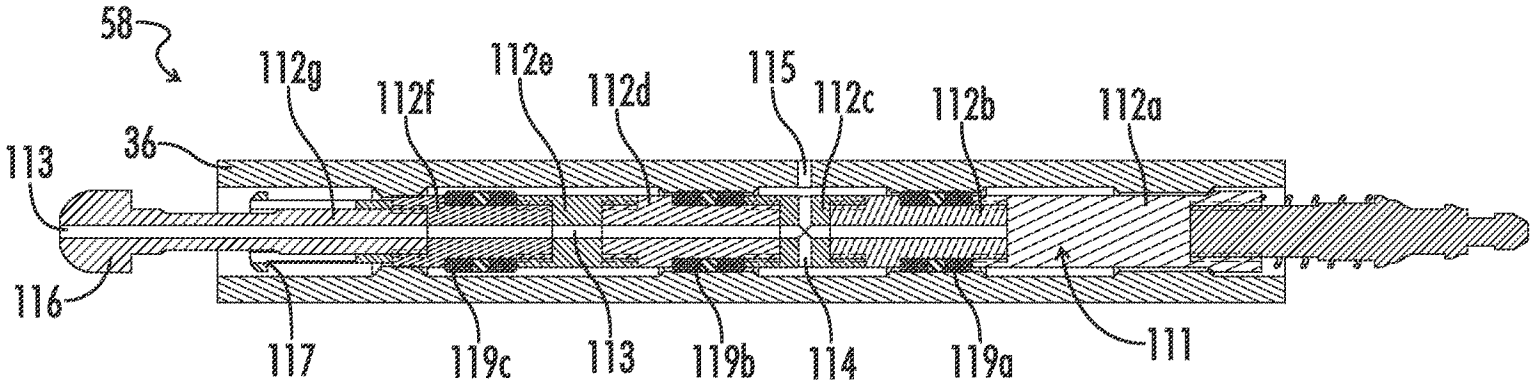
FIG. 29A is a lateral cross-sectional view of control line shut-off valve 58 in its open position.
Figure 29B:
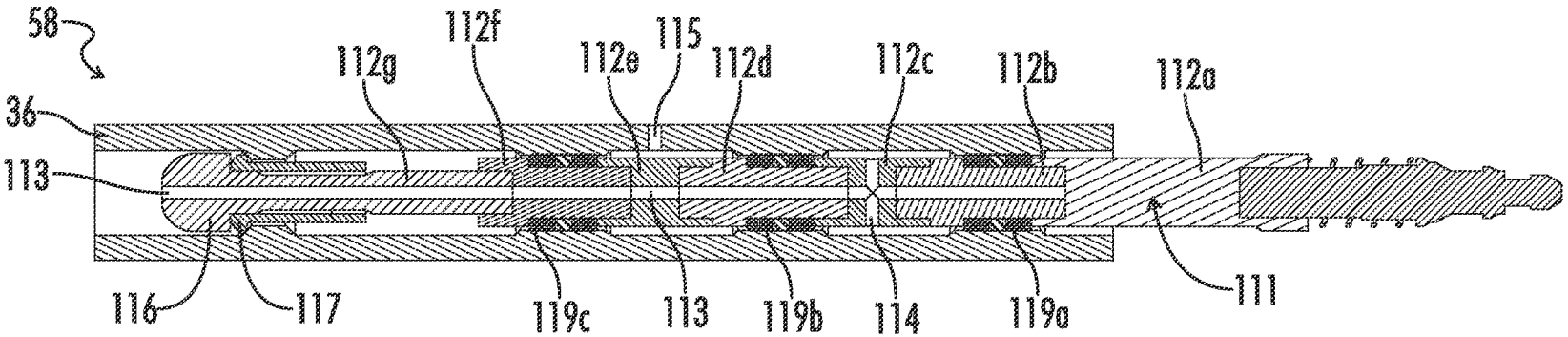
FIG. 29B is a lateral cross-sectional view of shut-off valve 58 in its closed position.

Shut-off valve 58 is normally open. In its normally open position, as shown in FIGS. 28 and 29A, transverse passage 114 in spool 111 is aligned with inlet port 115 in receptacle 36. Annular seals 189*a* and 189*b* are situated on either side thereof, allowing fluid from control line 45 to pass through inlet port 115, enter transverse passage 114, flow through central passage 113 and ultimately into the continuation of control line 45. It will be noted that the lower end of spool sub 112*f* bears on the restriction in receptacle 36, thus ensuring that inlet port 115 and transverse passage 114 are aligned.

Shut-off valve 58 may be closed by pulling up on spool 111. As it travels upward, collet 117 and tip 116 of spool sub 112*g* eventually bear on the restriction in receptacle 36, limiting further travel of spool 111. As may be seen in FIG. 29B, transverse passage 114 has moved out of alignment with inlet port 115. Seals 189*b* and 189*c* are situated on either side of inlet port 115 preventing fluid communication with transverse passage 114. Thus, flow through spool 111 is shut off.

If valves 153/154 require replacement, therefore, shut-off valve 58 may be shut to prevent loss of hydraulic fluid into production tubing. It may be situated as desired, but preferably shut-off valve 58 will be installed in a pocket mandrel 32 that is located above, but as close to valves 153/154 as is practical. Loss of hydraulic fluid will be minimized thereby. It also will be appreciated that shut-off valve 58 is preferred for its simplicity of design and operation, but other types of shut-off valves may be used if desired in the novel gas pump systems.

Gas lift system 30, gas pump 40, and other embodiments have been described as installed in a casing and, more specifically, a production casing used to fracture a well in various zones along the wellbore. A "casing," however, can have a fairly specific meaning within the industry, as do "liner" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. In essence, a "liner" is a "casing" that does not extend from the surface. "Tubing" refers to a smaller tubular conduit, usually less than 4.5" in diameter. The novel systems and pumps, however, are not limited in their application to casing as that term may be understood in its narrow sense. They may be used to advantage in liners, casings, and perhaps even in smaller conduits or "tubulars" as are commonly employed in oil and gas wells. A reference to casings shall be understood as a reference to all such tubulars.

While this invention has been disclosed and discussed primarily in terms of specific embodiments thereof, it is not intended to be limited thereto. Other modifications and embodiments will be apparent to the worker in the art.

What is claimed is:

1. A gas pump system for producing a well, said gas pump system comprising:

(a) production tubing adapted to convey fluid from said well to the surface;
(b) a tank adapted to collect liquid from said well;
(c) a packer sealing said annulus above said tank;
(d) a tank check valve adapted to allow liquid to flow into said tank from said well and to check liquid flow out of said tank;
(e) a dip tube in communication with said production tubing and said tank;
(f) a dip tube check valve adapted to allow liquid to flow up said dip tube into said production tubing and to check liquid from flowing down said dip tube;
(g) a gas supply line adapted to convey gas into said tank;
(h) a gas supply valve controlling flow through said gas supply line;
(i) a gas vent line adapted to vent gas from said tank; and
(j) a gas vent valve controlling flow through said gas vent line.

2. The gas pump system of claim 1, wherein said system comprises a sump line extending through said packer and a circulating valve adapted to allow liquid to flow down said sump line.

3. The gas pump system of claim 2, wherein said circulating valve is mounted in a pocket in said production tubing.

4. A gas pump system for producing a well, said gas pump system comprising:

(a) production tubing adapted to convey fluid from said well to the surface;
(b) a dip tube connected to said production tubing;
(c) a chamber communicating with said dip tube and adapted to collect liquid from said well, wherein said chamber is defined by an upper packer and a lower packer sealing an annulus surrounding said dip tube;
(d) a chamber check valve adapted to allow liquid to flow into said chamber from said well and to check liquid flow out of said chamber;
(e) a dip tube check valve adapted to allow liquid to flow up said dip tube into said production tubing and to check liquid from flowing down said dip tube;
(f) a gas supply line adapted to convey gas into said chamber;
(g) a gas supply valve controlling flow through said gas supply line;
(h) a gas vent line adapted to vent gas from said chamber;
(i) a gas vent valve controlling flow through said gas vent line;

(j) a sump line adapted to convey liquid above said upper packer into said chamber; and (k) a sump check valve adapted to allow liquid to flow through said sump line into said chamber and to check fluid flow out of said chamber.

5. The gas pump system of claim 4, wherein said sump check valve is mounted in a pocket in, said production tubing.

6. A gas pump system for producing a well, said gas pump system comprising:

(a) production tubing adapted to convey fluid from said well to the surface;

(b) a chamber adapted to collect liquid from said well;

(c) a chamber check valve adapted to allow liquid to flow into said chamber from said well and to check liquid flow out of said chamber;

(d) a dip tube in communication with said production tubing and said chamber;

(e) a dip tube check valve adapted to allow liquid to flow up said dip tube into said production tubing and to check liquid, from flowing down said dip tube;

(f) a gas supply line adapted to convey gas into said chamber;

(g) a hydraulic gas supply valve controlling flow through said gas supply line;

(h) a gas vent line adapted to vent gas from said chamber;

(i) a hydraulic gas vent line valve controlling flow through said gas vent line;

(j) a control line communicating with one or both of said gas supply valve and said gas vent valve; and (k) a shut-off valve controlling flow through said control line at a location in said well.

7. The gas pump system of claim 6, wherein said shut-off valve is located above and proximate to one or both of said gas supply valve and said gas vent valve.

8. The gas pump system of claim 6, wherein said control line is a gas-over-hydraulic control line.

9. The gas pump system of claim 6, wherein said shut-off valve is a linearly actuated spool-type valve.

* * * * *